US008329370B2

(12) United States Patent
Nakayama et al.

(10) Patent No.: US 8,329,370 B2
(45) Date of Patent: Dec. 11, 2012

(54) TONER, IMAGE FORMING APPARATUS, IMAGE FORMING METHOD, AND PROCESS CARTRIDGE

(75) Inventors: Shinya Nakayama, Numazu (JP); Akihiro Kotsugai, Numazu (JP); Akiyoshi Sabu, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 706 days.

(21) Appl. No.: 12/253,558

(22) Filed: Oct. 17, 2008

(65) Prior Publication Data

US 2009/0103950 A1 Apr. 23, 2009

(30) Foreign Application Priority Data

Oct. 19, 2007 (JP) ..... 2007-272868
Oct. 19, 2007 (JP) ..... 2007-272899
Oct. 19, 2007 (JP) ..... 2007-272920

(51) Int. Cl.
*G03G 9/00* (2006.01)

(52) U.S. Cl. ..... 430/108.24; 430/108.3; 430/109.3; 430/109.4

(58) Field of Classification Search ..... 430/108.24, 430/108.3, 109.3, 109.4
See application file for complete search history.

(56) References Cited

U.S. PATENT DOCUMENTS

| | | | | |
|---|---|---|---|---|
| 2,518,497 | A * | 8/1950 | Rust | 527/604 |
| 4,968,575 | A | 11/1990 | Matsumura et al. | |
| 4,981,939 | A | 1/1991 | Matsumura et al. | |
| 5,648,192 | A * | 7/1997 | Kuramae et al. | 430/108.2 |
| 6,087,318 | A | 7/2000 | Jadhav | |
| 6,656,654 | B2 * | 12/2003 | Higuchi et al. | 430/108.3 |
| 2006/0084001 | A1 * | 4/2006 | Nakanishi et al. | 430/109.4 |
| 2007/0141500 | A1 | 6/2007 | Sugimoto et al. | |
| 2007/0248380 | A1 | 10/2007 | Iwamoto et al. | |
| 2007/0281236 | A1 | 12/2007 | Watanabe et al. | |
| 2007/0281237 | A1 | 12/2007 | Iwamoto et al. | |
| 2008/0118855 | A1 | 5/2008 | Nakayama et al. | |
| 2008/0318143 | A1 * | 12/2008 | Nakayama et al. | 430/48 |

FOREIGN PATENT DOCUMENTS

| | | | |
|---|---|---|---|
| CN | 1711506 | A | 12/2005 |
| CN | 101017336 | A | 8/2007 |
| EP | 1 580 609 | A1 | 9/2005 |
| EP | 1 862 864 | A1 | 12/2007 |
| EP | 1 990 683 | A2 | 11/2008 |
| JP | 4-70765 | | 3/1992 |
| JP | 4-307557 | | 10/1992 |
| JP | 7-128911 | | 5/1995 |
| JP | 2830748 | | 9/1998 |
| JP | 2001-343787 | | 12/2001 |
| JP | 2002-365843 | | 12/2002 |
| JP | 2003-5432 | | 1/2003 |
| JP | 2007-139813 | | 6/2007 |
| JP | 2007-322926 | | 12/2007 |
| JP | 2007-322927 | | 12/2007 |
| WO | WO 2007/123273 | A1 | 11/2007 |

OTHER PUBLICATIONS

U.S. Appl. No. 11/943,929, filed Nov. 21, 2007, Shinya Nakayama et al.
U.S. Appl. No. 12/112,601, filed Apr. 30, 2008, Akiyoshi Sabu et al.
U.S. Appl. No. 12/118,006, filed May 9, 2008, Shinya Nakayama et al.
U.S. Appl. No. 12/142,311, filed Jun. 19, 2008, Shinya Nakayama et al.
Office Action issued May 25, 2011 in Chinese Patent Application No. 2008102463731 (with English translation).
Office Action dated Aug. 9, 2011, issued in Japanese Patent Application No. 2007-272899 (English translation).

* cited by examiner

*Primary Examiner* — Thorl Chea
(74) *Attorney, Agent, or Firm* — Oblon, Spivak, McClelland, Maier & Neustadt, L.L.P.

(57) ABSTRACT

An image forming apparatus including: a latent electrostatic image bearing member, a charging unit, an exposing unit, a developing unit, a transfer unit, and a fixing unit, wherein the toner contains at least a binder resin and a colorant, the binder resin contains a polyester resin obtained by polycondensation of an alcohol component with a carboxylic acid component containing a rosin compound, the amount of the rosin compound contained in the carboxylic acid component is 5% by mass or more based on the total mass of the alcohol component and carboxylic acid component, and the amount of an abietic acid contained in the toner is 1% by mass or less.

11 Claims, 17 Drawing Sheets

TONER, IMAGE FORMING APPARATUS, IMAGE FORMING METHOD, AND PROCESS CARTRIDGE

BACKGROUND OF THE INVENTION

1. Field of the Invention

The present invention relates to a toner to be used in electrophotographic apparatuses such as copiers, electrostatic printing appratuses, printers, facsimiles, and electrostatic recording apparatuses, also relates to an image forming apparatuse, an image forming method, and a process cartridge.

2. Description of the Related Art

Conventionally, there have been known various image forming methods by electrophotographic process. Generally, a latent electrostatic image is formed by charging a surface of a latent electrostatic image bearing member (otherwise referred to as "photoconductor", "electrophotographic photoconductor", or "image bearing member") and exposing the charged surface of the latent electrostatic image bearing member. Subsequently, the latent electrostatic image is developed using a toner to form a visible image on the latent electrostatic image bearing member. The visible image is directly transferred onto a recording medium or transferred thereonto via an intermediate transfer member, and the transferred image is heated and/or pressurized, thereby a recorded matter with an image formed on the recording medium can be obtained. A residual toner remaining on the latent electrostatic image bearing member that has gone through the transfer of the visible image is removed by a known method, such as the use of a blade, a brush, a roller or the like.

Generally, as full-color image forming apparatuses utilizing such an electrophotographic process, there are known two types of process. One electrophotographic process is called a single-electrophotographic process (or single drum method), in which one latent electrostatic bearing member is mounted in an image forming apparatus, and four-developing units corresponding to four colors of cyan, magenta, yellow and black are mounted. In such a single-electrophotographic process, a four-color visible image is formed on a latent electrostatic image bearing member or a recording medium. The single-process makes it possible to share the same units such as a charging unit, an exposing unit, a transfer unit and a cleaning unit which are disposed around a latent electrostatic image bearing member, and allows for a more compact and lower-cost design than the after-mentioned tandem process.

Meanwhile, the other electrophotographic process is called a tandem process (or tandem drum method) in which a plurality of latent electrostatic image bearing members is mounted in an image forming apparatus (see Japanese Patent Application Laid-Open (JP-A) No. 5-341617). Typically, a charging unit, a developing unit, a transfer unit, and a cleaning unit are disposed for each latent electrostatic image bearing member, they integrally form one image forming element, and a plural number of the image forming elements (typically four image forming elements) are loaded. In the tandem process, a one-color visible image is formed by one image forming element, four-color visible images are sequentially transferred onto a recording medium to thereby form a full-color image. The tandem process allows for forming visible images for each color by parallel processing, and thus it enables high-speed image formation. More specifically, the tandem process requires about only one-fourth the time required for image formation in the above-mentioned single electrophotographic process and enables high-speed printing four times as high as that of the single electrophotographic process. Further, the tandem process makes it possible to substantially enhance the durability of each unit in image forming elements, including latent electrostatic image bearing members. This is because, in the single electrophotographic process, one latent electrophotographic image bearing member is subjected to four times of each of the steps of charging, exposing, developing and transferring to form one full-color image. In contrast to the single electrophotographic process, the tandem process requires only one-time operation of the above steps with the use of one latent electrostatic image bearing member.

However, the tandem process has a disadvantage in that it requires arrangement of a plurality of image forming elements, and it results in large size of the entire image forming apparatus and high-costs.

To solve the problem, the following measures have been taken. Namely, a latent electrostatic image bearing member itself is made to have a smaller diameter, and the size of each of units disposed around the latent electrostatic image bearing member is reduced, thereby making one image forming element smaller. As a result, it achieves an effect on not only reduction in size of image forming apparatuses but also reduction in material costs, and the total reduction in cost has been achieved. However, with improved compactness and downsizing of image forming apparatuses, new problems have arisen, that is, each of units loaded in image forming elements needs to achieve high performance and drastically improved stability.

Further, recently, with increased requirements for energy conservation and higher speed processing of image forming apparatuses such as printers, copiers, and facsimiles, market demands for energy conservation and high-speed performance of these apparatuses have more increased. In order to achieve such performance, it is important to improve thermal efficiency of fixing units in image forming apparatuses.

Generally, in image forming apparatuses, an unfixed toner image is formed on a recording medium such as recording sheet, printing paper, photosensitive paper and electrostatic recording paper through the use of an indirect transfer process or a direct transfer method, according to an image forming process such as electrophotographic recording, electrostatic recording and magnetic recording. As fixing units for fixing such unfixed toner images, contact heating methods such as heat roller method, film heating method, electromagnetic induction heating method are widely used.

The heat roller type fixing units have inside thereof a heat source such as halogen lamp and have a basic structure of a pair of rotational rollers composed of a fixing roller whose temperature is adjusted to a predetermined temperature, and a pressurizing roller that is pressure contact with the fixing roller. A recording medium is inserted into a contact portion of the pair of rotational rollers (a so-called nip portion), conveyed, and an unfixed toner image is melted by applying heat and pressure to the unfixed toner image from the fixing roller and the pressurizing roller so as to be fixed on the recording medium.

Film heating type fixing units are proposed in Japanese Patent Application Laid-Open (JP-A) Nos. 63-313182 and 1-263679. In the film heating type fixing units, a recording medium is closely contacted with a heater which is stationarily supported by a support member via a thin fixing film having heat resistance, the fixing film is slid over the heater while being moved, and heat from the heater is supplied to the recording medium via the fixing film.

For the heater, a ceramic heater provided with a resistive layer on a ceramic substrate such as alumina and aluminum nitride which have physical properties of heat resistance, insulation properties, thermal conductivity, and the like. The use of such a fixing unit makes it possible to use a thin film with low heat volume as a fixing film and shorten the warm-up time, and enables quick-start and energy saving.

For the fixing unit of electromagnetic induction heating type, a technique is proposed in which Joule heat is generated due to the eddy current generated at a magnetic metal member through AC magnetic filed to thereby induce heat in a heater including the metal member (see Japanese Patent Application Laid-Open (JP-A) No. 8-22206).

In such a fixing unit of electromagnetic induction heating type, a film having a rubber-made elastic layer is placed between a heater and a recording medium in order to uniformly heat and melt a visible image in a fully wrapped state. When the rubber-made elastic layer is made of silicone rubber or the like, the heat responsiveness degrades due to its low thermal conductivity, and the temperature between the inside surface and the outside surface of a film which makes contact with toner significantly differs. When there exist a large amount of toner adhesion, the surface temperature of a belt surface rapidly decreases, which renders the fixing property to be ensured sufficiently, resulting in so-called cold offset.

Further, in the fixing step, a toner is required to have releasing property (otherwise referred to as "offset resistance" to a heating member. Such offset resistance can be improved by making a releasing agent exist on a surface of toner, however, when a not-specified toner is reused, not only the amount of a releasing agent residing on the toner surface may be reduced but also particles designed so as to have a core-shell structure with two or more layers may eccentrically exist on the toner surface, thereby the lower limit fixing temperature is inconveniently raised, causing insufficient low-temperature fixing property, i.e. energy saving fixing property. In a low-temperature fixing system that is required to provide further lower-temperature fixing property, a fixing defect occurs due to inorganic fine particles which eccentrically exist on the toner surface, and the fixing temperature width cannot be ensured.

While a toner excellent in low-temperature fixing property is requested, a toner having conflicting properties such as offset resistance and storage stability (blocking resistance) is requested. As a toner satisfying these requirements, toners are proposed which contain a polyester resin using rosins as acid component (see Japanese Patent Application Laid-Open (JP-A) Nos. 4-70765 and 2007-139813).

In the meanwhile, it is reported that as to a so-called capsulated toner composed of a core material and shells, chargeability and developing ability of the toner are improved by surface-treating a colorant in the core material with rosins such as natural rosins and abietic acid derivatives (see Japanese Patent Application Laid-Open (JP-A) No. 8-54755). It is also reported that a color toner containing a colorant that has been surface-treated with abietic acid is excellent in transferability, cleanability, and charge stability, and with the use of the toner makes it possible to obtain favorable full-color images (see Japanese Patent Application Laid-Open (JP-A) No. 7-128911).

In these techniques, rosin derivatives such as abietic acid having a heterocyclic aromatic ring are added to colorants. It is true that the dispersibility of the colorant is improved by adding these rosin derivatives, and transferability and charge stability are favorably exhibited in the early stage of use of the toner. However, these rosin derivatives are low-molecular weight materials and are not chemically bonded to binder resins. Therefore, a toner containing a large amount of a rosin derivative as a low-molecular weight material is likely to adhere onto a carrier in the case of a two-component developer and adhere onto a charge roller in the case of a one-component developer, and it is difficult to maintain the transferability and charge stability that have been obtained in the early stage of use. Further, in recent years, as the developing speed is increased, higher charge build-up property is requested. However, these toners do not have a sufficient charge build-up property.

Accordingly, it is desired to promptly provide an image forming apparatus, an image forming method and a process cartridge which are excellent in chargeability, anti-spent property (carrier-spent resistance), and transferability and are capable of forming high-quality images without causing a substantial degradation in its quality for a long period of time.

Meanwhile, in order to improve the charge build-up property of toner, the most common method is to add a charge controlling agent into a toner. Examples of typical charge controlling agents are chelate compounds with salicylic acid, oxysalicylic acid or the like as ligands. Metal complex salts of these salicylic acid derivatives are proposed in Japanese Patent Application Laid-Open (JP-A) No. 62-145255 and in paragraph 6 of Japanese Patent Application Publication (JP-B) No. 55-42752, for example. However, in these proposals, it is unfavorable in terms of environmental protection because the toners contain heavy metal such as Cr and Co. Then, in view of environmental protection, a number of salicylic acid derivatives that primarily contain Fe as a center metal and contain no heavy metals of Cr, Co, etc. are proposed. For example, effect of using a metal complex of salicylic acid derivatives having a carboxyl group or sulfoxyl group as a substituent is disclosed (see Japanese Patent Application Laid-Open (JP-A) No. 1-309072), and effect of using a combination of a specific resin and an iron complex containing salicylic acid as ligands is disclosed (see Japanese Patent Application Laid-Open (JP-A) Nos. 9-325520, 7-230188 and 2001-343787).

However, in these proposals, the effect is exhibited only when limited to the use of a combination of a specific resin and a metal complex of salicylic acid derivative. Further, in order to obtain uniformity of charge amount and stability among toner materials, it is important to uniformly and finely disperse any of these metal complexes of salicylic acid derivative in toner. However, it is difficult to sufficiently finely disperse these metal complexes in toner with the use of conventional toner binder resins, and there have been a such a problem with frequent occurrence of abnormal images such as toner fogging.

Accordingly, it is desired to promptly provide a toner capable of maintaining its excellent charge build-up property, charge stability and transferability without substantially causing smear onto carrier and charge rollers for a long period of time and to provide a developer using the toner and an image forming apparatus using the toner, each of which allows for forming extremely high-quality images without substantially causing change in color tone for a long period of time, and without substantially causing abnormal images such as a reduction in image density, and fogging.

Further, in a fixing step based on contact heating process, in which fixing is carried out using a heating member such as heat roller, toner is required to have releasing property (hereinafter, may be referred to as "offset resistance") to such a heating member. The offset resistance can be improved by adding a releasing agent into toner, and the state of toner residing inside the toner significantly affects the releasing property. It is desired that a releasing agent be uniformly dispersed in the toner, however, when excessively finely dispersed, the releasing agent is least likely to exude on the toner, and thus it is preferred that the releasing agent have an appropriate dispersion diameter. Polyester resins using aliphatic alcohol are highly compatible with commonly used releasing agents and have poor releasing property. However, polyester resins make it possible to set molecular weight high because of its rigidity of the structure, if the fixing is carried out at a same temperature. The polyester resins have more excellent heat-resistance/storage stability than styrene-acrylic resins. As to styrene-acrylic resins, when imparting fusibility at low temperature, it is necessary to set its molecular weight low. As a result, styrene-acrylic resins inconveniently become brittle and the heat-resistance/storage stability degrades, although these resins have advantages in that they are inexpensive, and the compatibility with releasing agents is readily controlled because of their degrees of design freedom, such as providing with a functional group.

For example, a number of methods of mixing and using a styrene-acrylic resin with a polyester resin have been proposed so far (for example, see Japanese Patent Application Laid-Open (JP-A) No. 2003-255611).

Further, a method of using a crystalline polyester resin and a styrene-acrylic resin is proposed (for example, see Japanese Patent Application Laid-Open (JP-A) No. 2006-171364).

However, in any of these proposals, depending on the compatibility between a styrene-acrylic resin and a polyester resin, smear of the resin component onto carrier and a change in physical properties are liable to occur in accordance with separation of the resin in the toner.

Further, use of a copolymer between a styrene-acrylic resin and a polyester resin is also proposed, however, it is necessary to introduce the styrene-acrylic resin into the polyester resin within the range where the low-temperature fixing property is not impaired, and it is problematic because the heat-resistance/storage stability is sometimes insufficient, and sufficient low-temperature fixing property cannot be obtained.

Furthermore, an example of using a crystalline polyester resin and a styrene-acrylic resin in combination is also proposed with expectation of improvement in low-temperature fixing property. However, the proposal has a problem with separation among resins and separation of pigment, etc. because of the crystallinity of the polyester resin.

To improve the compatibility between a styrene-acrylic resin and a polyester resin, methods of using a block polymer or a copolymer of polyester resin with a styrene-acrylic resin are proposed (for example, see Japanese Patent Application Laid-Open (JP-A) No. 2005-266400).

Further, as a method of introducing styrene-acrylic resin components at the time of granulation of toner, utilization of a chemical toner production method is proposed (see Japanese Patent Application Laid-Open (JP-A) No. 2001-265058 and Japanese Patent (JP-B) No. 3203451). However, according to the proposal, when a styrene-acrylic resin component is introduced to a polyester resin while maintaining fixing property of the polyester resin, it causes a problem with brittleness and heat-resistance/storage stability of styrene-acrylic resin sites.

Furthermore, a toner is proposed which contains a nonlinear crosslinked polyester resin using a rosin or rosins as acidic component(s) in a polyester resin (see Japanese Patent Application Laid-Open (JP-A) No. 4-70765). According to the proposal, an aliphatic alcohol, an aromatic alcohol, an unsaturated dicarboxylic acid having 4 to 10 carbon atoms, a terephthalic acid, and other carboxylic acids such as trimellitic acid are compounded in addition to rosin(s). However, a problem with odor specific to rosins arises when heated, and the rosin components which have low-molecular weight material are likely to adhere onto members such as charge rollers.

Thus, a toner which is provided with excellent low-temperature fixing property and excellent heat-resistance/storage stability and does not substantially cause smear of the toner and releasing agent onto a carrier and other members even in long-time use and related techniques have not yet been provided so far, and the current circumstance is that further improvements and developments of toner are desired.

BRIEF SUMMARY OF THE INVENTION

Firstly, the present invention aims to provide an image forming apparatus, an image forming method and a process cartridge which are excellent in chargeability, anti-spent property (carrier-spent resistance), and transferability and are capable of forming high-quality images for a long period of time without causing a substantial degradation in its quality.

Secondarily, the present invention aims to provide a toner capable of maintaining its excellent charge build-up property, charge stability and transferability for a long period of time without substantially causing smear onto carrier and charge rollers and to provide a developer using the toner and an image forming apparatus using the toner, each of which allows for forming extremely high-quality images for a long period of time without substantially causing change in color tone, and without substantially causing abnormal images such as a reduction in image density, and fogging.

Thirdly, the present invention aims to provide a toner which is provided with excellent low-temperature fixing property and excellent heat-resistance/storage stability without substantially causing smear of the toner and releasing agent onto carrier and other members even in long-time use and to provide a developer, an image forming apparatus, an image forming method and a process cartridge in each of which the toner is used.

Means for solving the aforementioned problems are as follows:

<A1> An image forming apparatus including at least:

a latent electrostatic image bearing member, a charging unit configured to charge a surface of the latent electrostatic image bearing member, an exposing unit configured to expose the charged surface of the latent electrostatic image bearing member to form a latent electrostatic image, a developing unit configured to develop the latent electrostatic image using a toner to form a visible image, a transfer unit configured to transfer the visible image onto a recording medium, and a fixing unit configured to fix the transferred image on the recording medium, wherein the toner contains at least a binder resin and a colorant, the binder resin contains a polyester resin obtained by polycondensation of an alcohol component with a carboxylic acid component containing a rosin compound, the amount of the rosin compound contained in the carboxylic acid component is 5% by mass or more based on the total mass of the alcohol component and carboxylic acid component, and the amount of an abietic acid contained in the toner is 1% by mass or less.

<A2> The image forming apparatus according to <A1>, wherein the charging unit is configured to charge the surface of the latent electrostatic image bearing member in a noncontact manner.

<A3> The image forming apparatus according to <A1>, wherein the charging unit is configured to charge the surface of the latent electrostatic image bearing member in a contact manner.

<A4> The image forming apparatus according to any one of <A1> to <A3>, wherein the developing unit has a magnetic field generation unit that stationarily fixed inside the developing unit, and a rotatable developer bearing member which bears on its surface a two-component developer composed of a magnetic carrier and a toner.

<A5> The image forming apparatus according to any one of <A1> to <A3>, wherein the developing unit has a developer bearing member to which the toner is supplied, and a layer thickness regulating member for forming a thin layer of toner on a surface of the developer bearing member.

<A6> The image forming apparatus according to any one of <A1> to <A5>, wherein the transfer unit is configured to transfer a visible image formed on the latent electrostatic image bearing member onto a recording medium.

<A7> The image forming apparatus according to any one of <A1> to <A6>, wherein a plurality of image forming elements are arranged, each of which includes at least a latent electrostatic image bearing member, a charging unit, a developing unit, and a transfer unit, and the transfer unit is configured to sequentially transfer visible images formed on each of the latent electrostatic image bearing members onto a recording medium whose surface moves so as pass a transfer position that faces each of the latent electrostatic image bearing members composing the plurality of image forming elements.

<A8> The image forming apparatus according to any one of <A1>to <A5>, wherein the transfer unit has an intermediate transfer member to which the visible image formed on the latent electrostatic image bearing member is primarily transferred, and a secondary transfer unit configured to secondarily transfer the visible image transferred to the intermediate transfer member onto a recording medium.

<A9> The image forming apparatus according to any one of <A1> to <A8>, further including a cleaning unit, and the cleaning unit has a cleaning blade that closely contacts with the surface of the latent electrostatic image bearing member.

<A10> The image forming apparatus according to any one of <A1> to <A8>, wherein the developing unit has a developer bearing member which closely contacts with the surface of the latent electrostatic image bearing member and is configured to develop a latent electrostatic image formed on the latent electrostatic image bearing member and collect a residual toner remaining on the latent electrostatic image bearing member.

<A11> The image forming apparatus according to any one of <A1> to <A10>, wherein the fixing unit has at least any one of a roller and a belt and is configured to fix the transferred image on the recording medium by heating and pressurizing the recording medium from a surface of the recording medium, which is opposite to a surface making contact with the toner.

<A12> The image forming apparatus according to any one of <A1>to <A10>, wherein the fixing unit has at least any one of a roller and a belt and is configured to fix the transferred image on the recording medium by heating and pressurizing the recording medium from a surface of the recording medium, which makes contact with the toner.

<A13> The image forming apparatus according to <A1> to <A12>, wherein the alcohol component in the polyester resin contains a divalent alcohol containing 65 mole % or more of an aliphatic diol.

<A14> The image forming apparatus according to <A13>, wherein the aliphatic diol contains 1,2-propanediol at a concentration of 65 mole % or more.

<A15> The image forming apparatus according to any one of <A1> to <A14>, wherein the carboxylic acid component further contains an aromatic dicarboxylic acid compound.

<A16> An image forming method including at least:

charging a surface of a latent electrostatic image bearing member, exposing the charged surface of the latent electrostatic image bearing member to form a latent electrostatic image, developing the latent electrostatic image using a toner to form a visible image, transferring the visible image onto a recording medium, and fixing the transferred image on the recording medium, wherein the toner contains at least a binder resin containing a polyester resin obtained by polycondensation of an alcohol component with a carboxylic acid component, a colorant, and a charge controlling agent containing a metal compound composed of a trivalent or higher polyvalent aromatic oxycarboxylic acid as a center metal, wherein the carboxylic acid component contains a rosin compound, the amount of the rosin compound contained in the carboxylic acid component is 5% by mass or more based on the total mass of the alcohol component and carboxylic acid component, and the amount of an abietic acid contained in the toner is 1% by mass or less.

<A17> The image forming method according to <A16>, wherein the charging step is carried out so that the surface of the latent electrostatic image bearing member is charged in a noncontact manner.

<A18> The image forming method according to <A16>, wherein the charging step is carried out so that the surface of the latent electrostatic image bearing member is charged in a contact manner.

<A19> The image forming method according to any one of <A16> to <A18>, wherein the developing step is carried out using a rotatable developer bearing member which bears on its surface a two-component developer composed of a magnetic carrier and a toner.

<A20> The image forming method according to any one of <A16> to <A18>, wherein the developing step is carried out using a developer bearing member to which the toner is supplied, and a layer thickness regulating member for forming a thin layer of toner on a surface of the developer bearing member.

<A21> The image forming method according to any one of <A16> to <A20>, wherein in the transferring step, a visible image formed on the latent electrostatic image bearing member is transferred onto a recording medium.

<A22> The image forming method according to any one of <A16> to <A21>, wherein a plurality of image forming elements are arranged, each of which includes at least a latent electrostatic image bearing member, a charging unit, a developing unit, and a transfer unit, and the transfer unit is configured to sequentially transfer visible images formed on each of the latent electrostatic image bearing members onto a recording medium whose surface moves so as pass a transfer position that faces each of the latent electrostatic image bearing members composing the plurality of image forming elements.

<A23> The image forming method according to any one of <A16> to <A20>, wherein the transferring step is carried out using an intermediate transfer member to which the visible image formed on the latent electrostatic image bearing member is primarily transferred, and a secondary transfer unit configured to secondarily transfer the visible image transferred to the intermediate transfer member onto a recording medium.

<A24> The image forming method according to any one of <A16> to <A23>, further including transferring step, wherein a cleaning blade is used which closely contacts with the surface of the latent electrostatic image bearing member.

<A25> The image forming method according to any one of <A16> to <A23>, wherein the developing step is carried out using a developer bearing member which closely contacts with the surface of the latent electrostatic image bearing member and is configured to develop a latent electrostatic image formed on the latent electrostatic image bearing member and collect a residual toner remaining on the latent electrostatic image bearing member.

<A26> The image forming method according to any one of <A16> to <A25>, wherein the transferred image is fixed on the recording medium by heating and pressurizing the recording medium from a surface of the recording medium, which is opposite to a surface making contact with the toner.

<A27> The image forming method according to any one of <A16> to <A25>, wherein the transferred image is fixed on the recording medium by heating and pressurizing the recording medium from a surface of the recording medium by heating and pressurizing the recording medium from a surface of the recording medium, which makes contact with the toner.

<A28> The image forming method according to any one of <A16> to <A27>, wherein the alcohol component in the polyester resin contains a divalent alcohol containing 65 mole % or more of an aliphatic diol.

<A29> The image forming method according to <A28>, wherein the aliphatic diol contains 1,2-propanediol at a concentration of 65 mole % or more.

<A30> The image forming method according to any one of <A16> to <A29>, wherein the carboxylic acid component further contains an aromatic dicarboxylic acid compound.

<A31> A process cartridge detachably mounted on a main body of an image forming apparatus, the process cartridge including at least:

a latent electrostatic image bearing member, and a developing unit configured to develop a latent electrostatic image formed on the latent electrostatic image bearing member using a toner to form a visible image, wherein the toner contains at least a binder resin and a colorant, the binder resin contains a polyester resin obtained by polycondensation of an alcohol component with a carboxylic acid component containing a rosin compound, the amount of the rosin compound contained in the carboxylic acid component is 5% by mass or more based on the total mass of the alcohol component and carboxylic acid component, and the amount of an abietic acid contained in the toner is 1% by mass or less.

<A32> The process cartridge according to <A31>, wherein the alcohol component in the polyester resin contains a divalent alcohol containing 65 mole % or more of an aliphatic diol.

<A33> The process cartridge according to <A32>, wherein the aliphatic diol contains 1,2-propanediol at a concentration of 65 mole % or more.

<A34> The process cartridge according to any one of <A31> to <A33>, wherein the carboxylic acid component further contains an aromatic dicarboxylic acid component.

An image forming apparatus of the present invention is equipped with a latent electrostatic image bearing member, a charging unit configured to charge a surface of the latent electrostatic image bearing member, an exposing unit configured to expose the charged surface of the latent electrostatic image bearing member to form a latent electrostatic image, a developing unit configured to develop the latent electrostatic image using a toner to form a visible image, a transfer unit configured to transfer the visible image onto a recording medium, and a fixing unit configured to fix the transferred image on the recording medium, wherein the toner contains at least a binder resin and a colorant, the binder resin contains a polyester resin obtained by polycondensation of an alcohol component with a carboxylic acid component containing a rosin compound, the amount of the rosin compound contained in the carboxylic acid component is 5% by mass or more based on the total mass of the alcohol component and carboxylic acid component, and the amount of an abietic acid contained in the toner is 1% by mass or less.

In the image forming apparatus of the present invention, the charging unit uniformly charges the surface of the latent electrostatic image bearing member; the exposing unit exposes the surface of the latent electrostatic image bearing member to form an electrostatic image; the developing unit develops the latent electrostatic image formed on the latent electrostatic image bearing member using a toner to form a visible image; the transfer unit transfers the visible image onto a recording medium, and the fixing unit fixes the transferred image on the recording medium. At this stage, a high-quality image excellent in charging property and transferability can be formed without causing a substantial degradation in its quality for a long period of time, because for the toner, a toner is used, in which the binder resin contains a polyester resin obtained by polycondensation of an alcohol component with a carboxylic acid component containing a rosin compound, the amount of the rosin compound contained in the carboxylic acid component is 5% by mass or more based on the total mass of the alcohol component and carboxylic acid component, and the amount of an abietic acid contained in the toner is 1% by mass or less.

The image forming method of the present invention includes at least charging a surface of a latent electrostatic image bearing member, exposing the charged surface of the latent electrostatic image bearing member to form a latent electrostatic image, developing the latent electrostatic image using a toner to form a visible image, transferring the visible image onto a recording medium, and fixing the transferred image on the recording medium, wherein the toner contains at least a binder resin containing a polyester resin obtained by polycondensation of an alcohol component with a carboxylic acid component and; and a colorant, wherein the carboxylic acid component contains a rosin compound, the amount of the rosin compound contained in the carboxylic acid component is 5% by mass or more based on the total mass of the alcohol component and carboxylic acid component, and the amount of an abietic acid contained in the toner is 1% by mass or less.

According to the image forming method of the present invention, in the charging step, the surface of the latent electrostatic image bearing member is uniformly charged. In the exposing step, the surface of the latent electrostatic image bearing member is exposed to form a latent electrostatic image. In the developing step, the latent electrostatic image formed on the latent electrostatic image bearing member is developed using a toner to form a visible image. In the transferring step, the visible image is transferred onto a recording medium. In the fixing step, the transferred image is fixed on the recording medium. At this stage, a high-quality image excellent in chargeability, anti-spent property (carrier-spent resistance), and transferability can be formed without causing a substantial degradation in its quality for a long period of time, because the binder resin in the toner contains a polyester resin obtained by polycondensation of an alcohol component with a carboxylic acid component containing a rosin compound, the amount of the rosin compound contained in the carboxylic acid component is 5% by mass or more based on the total mass of the alcohol component and carboxylic acid component, and the amount of an abietic acid contained in the toner is 1% by mass or less.

A process cartridge of the present invention includes at least a latent electrostatic image bearing member, and a developing unit configured to develop a latent electrostatic image formed on the latent electrostatic image bearing member using a toner to form a visible image, and is detachably mounted on a main body of an image forming apparatus. The process cartridge is excellent in chargeability, anti-spent property (carrier-spent property), and transferability, and the use of the process cartridge makes it possible to form high-quality images for a long period of time without causing a substantial degradation in its quality, because a toner is used, which contains at least a binder resin and a colorant, wherein the binder resin contains a polyester resin obtained by polycondensation of an alcohol component with a carboxylic acid component containing a rosin compound, the amount of the rosin compound contained in the carboxylic acid component is 5% by mass or more based on the total mass of the alcohol component and carboxylic acid component, and the amount of an abietic acid contained in the toner is 1% by mass or less.

Means for solving the aforementioned problems are as follows.

<B1> A toner containing at least:

a binder resin which contains a polyester resin obtained by polycondensation of an alcohol component with a carboxylic acid component;

a colorant; and a charge controlling agent containing a metal compound composed of a trivalent or higher polyvalent aromatic oxycarboxylic acid as a center metal, wherein the carboxylic acid component contains a rosin compound, the amount of the rosin compound contained in the carboxylic acid component is 5% by mass or more based on the total mass of the alcohol component and carboxylic acid component, and the amount of an abietic acid contained in the toner is 1% by mass or less.

<B2> The toner according to <B1>, wherein the metal compound composed of a trivalent or higher polyvalent aromatic oxycarboxylic acid is represented by General Formula (1), General Formula (1)

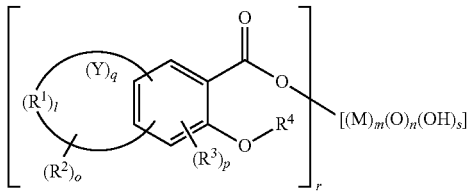

where $R^1$ represents any one of a carbon atom, a methine group and a methylene group, the methine group and the methylene group may include a hetero atom selected from N, S, O, and P; Y represents a cyclic structure bonded through a saturated bond or an unsaturated bond; each of $R^2$ and $R^3$ represents any one of a hydrogen atom, a halogen atom, a hydroxyl group, a nitro group, a nitroso group, a sulfonyl group, a cyano group, an alkyl group, an alkenyl group, an alkoxy group, an aryl group, an aryloxy group, an aralkyl group, an aralkyloxy group, an amino group, a carboxyl group and a carbonyl group, when each of "o" and "p" is an integer of 1 or more, $R^2$ and $R^3$ may be the same or different from each other, and $R^2$ and $R^3$ may be further substituted by a substituent; "l" is 0 or an integer of 3 to 12; "m" is an integer of 1 to 20; "n" is an integer of 0 to 20; "o" is an integer of 0 to 4; "p" is an integer of 0 to 4; "q" is an integer of 0 to 3; "r" is an integer of 1 to 20; "s" is an integer of 0 to 20; and M is a trivalent or higher center metal.

<B3> The toner according to any one of <B1> to <B2>, wherein the center metal is Fe.

<B4> The toner according to any one of <B1> to <B2>, wherein the center metal is Zr.

<B5> The toner according to any one of <B1> to <B4>, wherein the alcohol component contains a divalent alcohol containing 65 mole % or more of an aliphatic diol.

<B6> The toner according to <B5>, wherein the aliphatic diol contains 65 mole % or more of 1,2-propanediol.

<B7> The toner according to any one of <B1> to <B6>, wherein the carboxylic acid component further contains an aromatic dicarboxylic acid compound.

<B8> The toner according to any one of <B1> to <B7>, wherein the toner is at least one selected from a cyan toner, a magenta toner, a yellow toner, and a black toner.

<B9> A developer containing the toner according to any one of <B1> to <B8>.

<B10> An image forming apparatus including at least:

a latent electrostatic image bearing member, a charging unit configured to charge a surface of the latent electrostatic image bearing member, an exposing unit configured to expose the charged surface of the latent electrostatic image bearing member to form a latent electrostatic image, a developing unit configured to develop the latent electrostatic image using a toner to form a visible image, a transfer unit configured to transfer the visible image onto a recording medium, and a fixing unit configured to fix the transferred image on the recording medium, wherein the toner is the toner according to any one of <B1> to <B8>.

<B11> The image forming apparatus according to <B10>, wherein the developing unit has a magnetic field generation unit that stationarily fixed inside the developing unit, and a rotatable developer bearing member which bears on its surface a two-component developer composed of a magnetic carrier and a toner.

<B12> The image forming apparatus according to <B10>, wherein the developing unit has a developer bearing member to which the toner is supplied, and a layer thickness regulating member for forming a thin layer of toner on a surface of the developer bearing member.

<B13> An image forming method including at least:

charging a surface of a latent electrostatic image bearing member, exposing the charged surface of the latent electrostatic image bearing member to form a latent electrostatic image, developing the latent electrostatic image using a toner to form a visible image, transferring the visible image onto a recording medium, and fixing the transferred image on the recording medium, wherein the toner is the toner according to any one of <B1> to <B8>.

<B14> A toner container having:

a container to accommodate the toner according to any one of <B1> to <B8>.

<B15> A process cartridge including at least:

a latent electrostatic image bearing member, and a developing unit detachably mounted to a main body of an image forming apparatus and configured to develop a latent electrostatic image using the toner according to any one of <B1> to <B8> to form a visible image on the latent electrostatic image bearing member.

The toner of the present invention contains at least a binder resin, a colorant, and a charge controlling agent, the charge controlling agent contains a metal compound composed of a trivalent or higher polyvalent aromatic oxycarboxylic acid as a center metal, the binder resin contains a polyester resin obtained by polycondensation of an alcohol component with a carboxylic acid component containing a rosin compound, the amount of the rosin compound is 5% by mass or more based on the total mass of the alcohol component and carboxylic acid component, and the amount of an abietic acid contained in the toner is 1% by mass or less.

In the toner of the present invention, the metal compound composed of a trivalent or higher polyvalent aromatic oxycarboxylic acid serving as a center metal is fairly dispersed in the polyester resin, and the charge build-up property is also improved.

The toner is excellent in chargeability and transferability, and the use of the toner makes it possible to form high-quality images for a long period of time without causing a substantial degradation in its quality, because the binder resin contains a polyester resin obtained by polycondensation of an alcohol component with a carboxylic acid component which contains a rosin compound, the amount of the rosin component contained in the carboxylic acid component is 5% by mass or more to the total mass of the alcohol component and carboxylic acid component, and the amount of an abietic acid in the toner is 1% by mass or less. These components act synergically, thereby making it possible to maintain its excellent charge build-up property, charge stability and transferability for a long period of time without substantially causing smear onto carrier and charge rollers.

A developer of the present invention contains the toner of the present invention, and thus the use of the developer makes it possible to form high-quality images without substantially causing change in color tone for a long period of time, and without substantially causing abnormal images such as a reduction in image density, and fogging.

An image forming apparatus of the present invention is equipped with a latent electrostatic image bearing member, a charging unit configured to charge a surface of the latent electrostatic image bearing member, an exposing unit configured to expose the charged surface of the latent electrostatic image bearing member to form a latent electrostatic image, a developing unit configured to develop the latent electrostatic image using a toner to form a visible image, a transfer unit configured to transfer the visible image onto a recording medium, and a fixing unit configured to fix the transferred image on the recording medium, wherein the toner is the toner of the present invention.

In the image forming apparatus of the present invention, the charging unit uniformly charges the surface of the latent electrostatic image; the exposing unit exposes the surface of the latent electrostatic image bearing member to form a latent electrostatic image; the developing unit develops the latent electrostatic image formed on the latent electrostatic image bearing member using a toner to form a visible image; the transfer unit transfers the visible image onto a recording medium; and the fixing unit fixes the transferred image on the recording medium. In the process steps, as the toner, the toner of the present invention is used, and thus an extremely high-quality image can be formed without substantially causing change in color tone for a long period of time, and without abnormal images such as a reduction in image density, and fogging.

Means for solving the aforementioned problems are as follows:

<C1> A toner containing at least:

a binder resin containing a styrene-acrylic resin and a polyester resin, a colorant, and a releasing agent, wherein the polyester resin is obtained by polycondensation of an alcohol component with a carboxylic acid component containing a rosin compound, the amount of the rosin compound contained in the carboxylic acid component is 5% by mass or more based on the total mass of the alcohol component and carboxylic acid component, and the amount of an abietic acid contained in the toner is 1% by mass or less.

<C2> The toner according to <C1>, wherein the alcohol component contains a divalent alcohol containing 65 mole % or more of an aliphatic diol.

<C3> The toner according to <C2>, wherein the aliphatic diol contains 1,2-propanediol at a concentration of 65 mole % or more.

<C4> The toner according to any one of <C1> to <C3>, wherein the carboxylic acid component further contains an aromatic dicarboxylic acid.

<C5> The toner according to <C1> to <C4>, wherein the polyester resin is obtained by polycondensation of an alcohol component with a carboxylic acid component, the alcohol component contains a divalent alcohol containing 65 mole % or more of 1,2-propanediol, the carboxylic acid contains a purified rosin, and the polyester resin has a softening point of 80° C. or more and less than 120° C.

<C6> The toner according to any one of <C1> to <C5>, wherein the styrene-acrylic resin contains a styrene-methyl acrylate copolymer.

<C7> The toner according to any one of <C1> to <C5>, wherein the styrene-acrylic contains a styrene-butyl acrylate copolymer.

<C8> The toner according to any one of <C1> to <C7>, wherein the styrene-acrylic resin contains a crosslinking component.

<C9> The toner according to any one of <C1> to <C8>, wherein the mass ratio [(B)/(A)] of a polyester resin (B) to a styrene-acrylic resin (A) is 5/5 to 1/9.

<C10> The toner according to any one of <C1> to <C9>, wherein the releasing agent contains at least any one of a carnauba wax and a rice wax.

<C11> A developer containing:

the toner according to any one of <C1> to <C10>.

<C12> An image forming apparatus including at least:

a latent electrostatic image bearing member, a latent electrostatic image forming unit configured to form a latent electrostatic image on the latent electrostatic image bearing member, a developing unit configured to develop the latent electrostatic image using a toner to form a visible image, a transfer unit configured to transfer the visible image onto a recording medium, and a fixing unit configured to fix the transferred image on the recording medium, wherein the toner is the toner according to any one of <C1> to <C10>.

<C13> An image forming method including at least:

forming a latent electrostatic image on a latent electrostatic image bearing member, developing the latent electrostatic image using a toner to form a visible image, transferring the visible image onto a recording medium, and fixing the transferred image on the recording medium, wherein the toner is the toner according to any one of <C1> to <C10>.

<C14> A process cartridge including at least:

a latent electrostatic image bearing member, and a developing unit configured to develop a latent electrostatic image formed on the latent electrostatic image bearing member using a toner to form a visible image, wherein the toner is the toner according to any one of <C1> to <C10>.

<C15> A toner container including:

a container to accommodate a toner, wherein the toner is the toner according to any one of <C1> to <C10>.

The toner of the present invention contains at least a binder resin, a colorant, and a releasing agent, the binder resin contains a styrene-acrylic resin and a polyester resin, the polyester resin is obtained by polycondensation of an alcohol component and a carboxylic acid component containing a rosin compound, the amount of the rosin compound is 5% by mass based on the total mass of the alcohol component and carboxylic acid component, and the amount of an abietic acid contained in the toner is 1% by mass or less.

The toner of the present invention contains at least a polyester resin, a styrene-acrylic resin, a colorant, and a releasing agent. The polyester resin is obtained by polycondensation of an alcohol component and a carboxylic acid component containing a rosin compound. Sing the amount of the rosin compound is 5% by mass or more based on the total mass of the alcohol component and carboxylic acid component, and the amount of an abietic acid in the toner is 1% by mass or less, it makes it possible to fix a transferred image at extremely low-temperature, and the polyester resin contains more amount of ester component than a typical polyester resin, and thus the miscibility of acrylic acid or ester thereof and a releasing agent becomes favorable. As a result, the dispersibility of the releasing agent becomes excellent, and durability of the resin becomes excellent without causing phase separation of the resin and further low-temperature fixing property can be obtained while improving the heat resistance/storage stability of the resin.

Further, it is possible to obtain a toner having low-temperature fixing property due to the polyester resin while maintaining relatively favorable dispersibility of the releasing agent due to the styrene-acrylic resin. In other words, by the use of diol with a relatively short chain and a polyester resin having a rosin skeleton frame structure, it is possible to enhance the compatibility between the acrylic component and the releasing agent and to prevent low-temperature fixing property and phase separation due to the releasing agent.

The developer of the present invention contains the toner of the present invention and a carrier. Therefore, when an image is formed by electrophotography using the developer, a high-quality image excellent in low-temperature fixing property and provided with both low-temperature fixing property and heat-resistance/storage stability can be obtained without substantially causing smear of the toner and the releasing agent onto the carrier and other members even in long-time use.

The image forming apparatus of the present invention includes at least a latent electrostatic image bearing member, a latent electrostatic image forming unit configured to form a latent electrostatic image on the latent electrostatic image bearing member, a developing unit configured to develop the latent electrostatic image using a toner to form a visible image, a transfer unit configured to transfer the visible image onto a recording medium, and a fixing unit configured to fix the transferred image on the recording medium, in which as the toner, the toner of the present invention is used.

In the image forming apparatus of the present invention, the latent electrostatic image forming unit forms a latent electrostatic image; the developing unit develops the latent electrostatic image formed on the latent electrostatic image bearing member using a toner to form a visible image; the transfer unit transfers the visible image onto a recording medium; and the fixing unit fixes the transferred image on the recording medium. In the process steps, as the toner, the toner of the present invention is used, and thus an extremely high-quality image can be formed without substantially causing smear onto carrier and other members, and without substantially causing abnormal images such as a reduction in image density, and background smear, even in long-time use.

The image forming method of the present invention includes at least forming a latent electrostatic image on a latent electrostatic image bearing member, developing the latent electrostatic image using a toner to form a visible image, transferring the visible image onto a recording medium, and fixing the transferred image on the recording medium, in which as the toner, the toner of the present invention is used.

In the image forming method, a latent electrostatic image is formed on the latent electrostatic image bearing member by the latent electrostatic image forming step, the latent electrostatic image formed on the latent electrostatic image bearing member is developed using a toner to form a visible image by the developing step, the visible image is transferred onto a recording medium by the transferring step, and the transferred image is fixed on the recording medium by the fixing step. In the process steps, as the toner, the toner of the present invention is used, and thus an extremely high-quality image can be formed without substantially causing smear of the toner and releasing agent onto carrier and other members, and without substantially causing abnormal images such as a reduction in image density, and background smear, even in long-time use. In the process steps, as the toner, the toner of the present invention is used, and thus an extremely high-quality image can be formed without substantially causing smear of the toner and releasing agent onto carrier and other members, and without substantially causing abnormal images such as a reduction in image density, and background smear, even in long-time use.

The process cartridge of the present invention is detachably mounted to a main body of an image forming apparatus and equipped with at least a latent electrostatic image bearing member, and a developing unit configured to develop a latent electrostatic image formed on the latent electrostatic image bearing member using a toner to form a visible image. The process cartridge is very user-friendly and the toner of the present invention is used therein, and thus extremely high-quality images can be formed without substantially causing smear of the toner and releasing agent onto carrier and other members, and without substantially causing abnormal images such as reduction image density and background smear.

DETAILED DESCRIPTION OF THE INVENTION (Toner)

Figure 1:
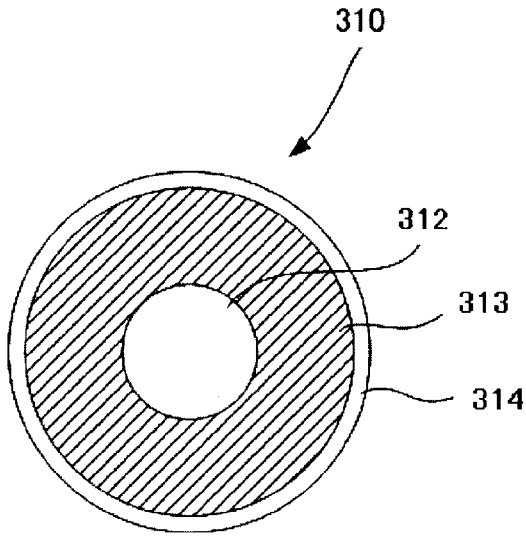
FIG. 1 is a schematic cross-sectional illustration showing one example of a charge roller in an image forming apparatus of the present invention.

A toner according to a first embodiment of the present invention contains at least a binder resin and a colorant, the binder resin contains a polyester resin obtained by polycondensation of an alcohol component with a carboxylic acid component containing a rosin compound, the amount of the rosin compound contained in the rosin compound is 5% by mass or more based on the total mass of the alcohol component and carboxylic acid component, and the amount of an abietic acid contained in the toner is 1% by mass or less.

A toner according to a second embodiment of the present invention contains at least a binder resin, a colorant, and a charge controlling agent, the charge controlling agent contains a metal compound composed of a trivalent or higher polyvalent aromatic oxycarboxylic acid as a center metal, the binder resin contains a polyester resin obtained by polycondensation of an alcohol component with a carboxylic acid component containing a rosin compound, the amount of the rosin compound contained in the carboxylic acid component is 5% by mass or more to the total mass of the carboxylic acid component, and the amount of an abietic acid contained in the toner is 1% by mass or less.

A toner according to a third embodiment of the present invention contains at least a binder resin, a colorant, and a releasing agent, the binder resin contains a styrene-acrylic resin and a polyester resin, the polyester resin is obtained by polycondensation of an alcohol component with a carboxylic acid component containing a rosin compound, the amount of the rosin compound contained in the carboxylic acid component based on the total mass of the alcohol component and carboxylic acid component is 5% by mass or more, and the amount of an abietic acid contained in the toner is 1% by mass or less.

<Binder Resin>

The binder resin is characterized in that a polyester resin obtained by polycondensation of an alcohol component with a carboxylic acid component containing a rosin compound is contained, and the amount of an abietic acid in the toner is adjusted.

In the present invention, the rosin compound in the carboxylic acid component primarily contains an abietic acid. If the abietic acid derived from the rosin compound remains in toner, the toner easily adheres onto a carrier and a charge roller, and smear of the toner is likely to occur, resulting in an increase in reduction in charged amount with time. The residue of abietic acid remaining in the toner reduces the function of the charge controlling agent in the toner, leading to a degradation in charge build-up property of the toner.

However, in the present invention, a rosin skeleton is introduced into the polyester resin, and the introduction of rosin skeleton improves the dispersibility of the colorant and charge controlling agent, further, the amount of abietic acid remaining in the toner is reduced, and the reduction in residual amount of the abietic acid prevents carrier and charge rollers from smearing and further prevents the function of addition of the charge controlling agent from degrading. It is considered that for this reason, the toner can maintain its excellent charge build-up property, charge stability and transferability for a long period of time, and the use of the toner makes it possible to form high-quality images without substantially causing abnormal images such as a change in color tone, a reduction in image density, and fogging, even in long-time use.

From the above viewpoints, in the toner of the present invention, the amount of an abietic acid contained is 1.0% by mass, preferably 0.9% by mass or less, more preferably 0.5% by mass or less, still more preferably 0.3% by mass or less, and it is particularly desirable that the toner contain substantially no abietic acid.

In the present invention, as described above, the rosin compound contained in the carboxylic acid component primarily contains an abietic acid. Therefore, it is impossible to obtain a toner, in which the amount of the abietic acid is adjusted to a value within the predetermined range, by only reducing the amount of the rosin compound used within the range where the effect of the present invention is exhibited. For this reason, in the present invention, as a method of reducing the residual amount of abietic acid in the toner, the following are exemplified: for instance, (1) a method of increasing the reaction rate of the rosin compound by using as an alcohol component an aliphatic diol excellent in reactivity; (2) a method of using a modified rosin in which an unsaturated fatty acid is modified with an unsaturated fatty acid and the amount of an abietic acid is reduced beforehand; (3) a method of increasing the reaction rate of the rosin compound by controlling the reaction time, the reaction temperature and the depressurizing rate during a production of the polyester; (4) a method, in which after reaction of a raw material monomer, a low-molecular weight component contained in the polyester is removed by steam distillation or water-dropping; and (5) a method of using as an alcohol component an aliphatic diol in which both two hydroxyl groups are primary hydroxyl groups; and so forth.

-Alcohol Component-

As described above, for the alcohol component composed of the polyester resin, aliphatic diol is preferably used. By the use of an aliphatic diol which is superior in reactivity to aromatic alcohol, as an alcohol component, the rosin compound is easily incorporated into the polyester resin and the amount of an abietic acid contained in the toner can be reduced. The rosin compound is further incorporated into the polyester resin by first adding the rosin compound in a reaction system along with an aliphatic alcohol so as to react with the aliphatic alcohol.

The aliphatic diol is not particularly limited and may be suitably selected in accordance with the intended use. For instance, aliphatic alcohols having 2 to 6 carbon atoms are desirable. Each of these may be used alone or in combination. Of these, ethylene glycol, 1,2-propanediol, and 1,3-propanediol are more desirable, and from the perspective of maintaining the glass transition temperature of the resin high and ensuring the storage stability of the toner, 1,2-propanediol, and 1,3-propanediol are particularly desirable. Specifically, 1,2-propanediol which is an alcohol having 3 carbon atoms and a secondary hydroxyl group, has a greater effect of preventing reduction in glass transition temperature of resins and reduction in storage stability of toner than alcohols having 4 or more carbon atoms and a secondary hydroxyl group. The amount of 1,2-propanediol contained in the aliphatic diol is preferably 65 mole % or more, more preferably 70 mole % or more, and still more preferably 80 mole % to 100 mole %.

When an unmodified rosin is used as the rosin compound, which will be described below in detail, it is preferred that the alcohol component contain an aliphatic diol, in which both of two hydroxyl groups are primary hydroxyl groups, such as 1,3-propanediol, as well as 1,2-propanediol, from the perspective of reactivity. The amount of such an aliphatic diol like 1,3-propanediol in the aliphatic diol is preferably 30 mole % or less and more preferably 10 mole % to 20 mole %.

The amount of the aliphatic diol in a divalent alcohol component is preferably 65 mole % or more, and more preferably 80 mole % to 100 mole %.

Examples of divalent alcohol components other than the aliphatic diol include aromatic alcohols of alkyleneoxide adducts of bisphenol A such as polyoxypropylene-2,2-bis(4-hydroxyphenyl)propane, and polyoxyethylene -2,2-bis(4-hydroxyphenyl)propane; hydrogenated bisphenol A and alkyleneoxide adducts thereof, i.e. alkylene (having 2 to 4 carbon atoms) oxide (with the average addition number of moles of 1 to 16) adducts The amount of the divalent alcohol component in the alcohol component is preferably 60 mole % to 100 mole %, more preferably 60 mole % to 95 mole %, and still more preferably 65 mole % to 90 mole %.

-Carboxylic Acid Component-

As described above, the carboxylic acid contains a rosin compound.

In the present invention, rosin is a natural resin obtained from pine resin, and the primary component thereof is a resin acid such as abietic acid, neoabietic acid, palustric acid, pimaric acid, isopimaric acid, sandaracopimaric acid, dehydroabietic acid, and levopimaric acid or a mixture thereof.

Examples of the rosin compound also include the following: natural rosins broadly categorized into tall rosins obtainable from tall oil which is obtained as by-product in processes of producing pulp; gum rosins obtainable from pine oleoresin, and wood rosins obtainable from pine stub; besides modified rosins such as isomerized rosins, dimerized rosins, polymerized rosins, disproportionated rosins, and hydrogenated rosins. However, in the present invention, it is preferable to use a modified rosin that is modified with unsaturated fatty acid, in which the amount of abietic acid is reduced beforehand.

A modified rosin that is modified with unsaturated fatty acid can be obtained by addition-reacting an unsaturated fatty acid and a rosin. More specifically, it can be obtained through Diels-Alder reaction or ene reaction under heating treatment of levopimaric acid, abietic acid or palustric acid, each of which has conjugated double bond among main components of rosin, and an unsaturated fatty acid.

For the modified rosin, the rosins known in the art can be used, however, natural rosin is preferable from the perspective of its color, and tall rosin is more preferable from the perspective of low-temperature fixing property.

Examples of the unsaturated fatty acid used to modify rosin include (meth)acrylic acid, maleic acid, maleic anhydride, fumaric acid, and itaconic acid.

In the present invention, the term "(meth)acrylic" or means acrylic or methacrylic, and thus "(meth)acrylic acid" means acrylic acid or methacrylic acid. As a modified rosin that is modified with (meth)acrylic acid, acrylic acid-modified rosin which is modified with acrylic acid, which is less sterically-hindered, from the perspective of reaction activity in Diels-Alder reaction or ene reaction.

A method of producing a modified rosin that is modified with unsaturated fatty acid is not particularly limited and may be suitably selected in accordance with the intended use. For example, a modified rosin can be obtained by mixing rosin with unsaturated fatty acid and heating the components at a temperature of 180° C. to 260° C. through Diels-Alder reaction or ene reaction so that the unsaturated fatty acid is added to an acid having a conjugated double bond. The modified rosin obtained may be directly used or may be purified and then used after subjected to a treatment such as distillation.

The amount of the rosin compound based on the total mass of the alcohol component and carboxylic acid component is preferably 5% by mass or more, more preferably 5% by mass to 40% by mass, still more preferably 10% by mass to 40% by mass, particularly preferably 15% by mass to 40% by mass, and most preferably 25% by mass to 40% by mass.

As carboxylic acid components other then the rosin compound, an aromatic dicarboxylic acid compound composed of phthalic acid, isophthalic acid, terephthalic acid and the like are preferable. The amount of the aromatic dicarboxylic acid compound contained in the alcohol component is preferably 40 moles to 95 moles, more preferably 50 moles to 90 moles, and still more preferably 60 moles to 80 moles, based on 100 moles of the alcohol component.

Note that in the present invention, carboxylic acid, carboxylic acid anhydride and alkyl ester of carboxylic acid are collectively called carboxylic acid compound.

At least any of the alcohol component and the carboxylic acid component may contain a raw material containing trivalent or higher polyvalent monomers. The amount of the raw material containing trivalent or higher polyvalent monomers used, based on 100 moles of the divalent alcohol component, is preferably 40 moles or less, and more preferably 5 moles to 30 moles.

In the raw material containing trivalent or higher polyvalent monomers, as a trivalent or higher polyvalent carboxylic acid compound, trimellitic acid or derivative thereof is preferable; as a trivalent or higher polyhydric alcohol, glycerin, pentaerythritol, trimethylolpropane, sorbitol or alkylene (having 2 to 4 carbon atoms) oxide adducts (with the average addition number of moles of 1 to 16) are exemplified. Of these, glycerin is preferable in terms of its efficiency in improving low-temperature fixing property.

-Esterified Catalyst-

A polycondensation reaction between the alcohol component and the carboxylic acid component is preferably carried out in presence of an esterified catalyst. Examples of the esterified catalyst include Lewis acids such as p-toluene sulfonic acid; titanium compounds, and tin (II) compounds having no Sn—C bond. Of these, titanium compounds and tin (II) compounds having not Sn—C bond are particularly preferable.

As the titanium compounds, titanium compounds having Ti—O bonds are preferable, and titanium compounds having alkoxy groups, alkenyloxy groups or acyloxy groups each of which has the total number of carbon atoms of 1 to 28 are more preferable.

Examples of the titanium compounds include titanium diisopropylate bis-triethanol aminate [$Ti(C_6H_{14}O_3N)_2(C_3H_7O)_2$], titanium diisopropylate bis-diethanol aminate $Ti(C_4H_{10}O_2N)_2(C_3H_7O)2$], titanium dipentylate bis-triethanol aminate [$Ti(C_6H_{14}O_3N)_2(C_5H_{11}O)_2$], titanium diethylate bis -triethanol aminate[$Ti(C_6H_{14}O_3N)_2(C_2H_{15}O)_2$], titanium dihydroxyoctylate bis-triethanol aminate [$Ti(C_6H_{14}O_3N)_2(OHC_8H_{16}O)_2$], titanium distearate bis-triethanol aminate [$Ti(C_6H_{14}O_3N)_2(Cl_8H_{37}O)_2$], titanium triisopropylate triethanol aminate [$Ti(C_6H_{14}O_3N)_1(C_3H_7O)_3$], and titanium monopropylate tris(triethanol aminate) $Ti(C_6H_{14}O_3N)_3(C_3H_7O)_1$]. Of these, titanium diisopropylate bis-triethanol aminate, titanium diisopropylate bis-diethanol aminate, and titanium dipentylate bis-triethanol aminate are particularly preferable. These are available from Matsumoto Trading Co., Ltd. as commercial products.

Specific examples of other preferred titanium compounds include tetra-n-butyltitanate [$Ti(C_4H_9O)_4$], tetrapropyltitanate [$Ti(C_3H_7O)4$], tetrastearyltitanate [$Ti(C_{18}H_{37}O)_4$], tetramyristyl titanate [$Ti(C_{14}H_{29}O)_4$], tetraoctyl titanate [$Ti(C_8H_{17}O)_4$], dioctyldihydroxyoctyl titanate [$Ti(C_8H_{17}O)_2(OHC_8H_{16}O)_2$], and dimyristyldioctyl titanate [$Ti(C_{14}H_{29}O)_2(C_8H_{17}O)_2$]. Of these, tetrastearyl titanate, tetramyristyl titanate, tetraoctyl titanate, and dioctyldihydroxyoctyl titanate are desirable. These may be obtained, for example, by reacting halogenated titanium with corresponding alcohol, and are available from Nisso Co., Ltd. as commercial products.

The amount of the titanium compound existing in the alcohol component and the carboxylic acid component, based on the total mass 100 parts by mass of the alcohol component and the carboxylic acid component, is preferably 0.01 parts by mass to 1.0 part by mass, and more preferably 0.1 parts by mass to 0.7 parts by mass.

As the tin (II) compounds having no Sn—C bond, tin (II) compounds having Sn—O bonds, and tin (II) compounds having Sn—X bonds (X represents a halogen atom) are desirable. Tin (II) compounds having Sn—O bonds are more desirable.

Examples of the tin (II) compounds having Sn—O bonds include tin (II) carboxylate having a carboxylic acid group with 2 to 28 carbon atoms such as tin (II) oxalate, tin (II) diacetate, tin (II) dioctanoate, tin (II) dilaurate, tin (II) distearate, and tin (II) dioleate; dialkoxy tin (II) having an alkoxy group with 2 to 28 carbon atoms such as dioctyloxy tin (II), dilauloxy tin (II), distearoxy tin (II), and dioleyloxy tin (II); tin (II) oxides; and tin (II) sulfides.

As the tin (II) compounds having Sn—X bonds (X represents a halogen atom), for example, halogenated tin (II) such as tin (II) chloride, tin (II) bromide are exemplified. Among these, from the viewpoint of effect of charge build-up property and catalytic ability, tin (II) fatty acid represented by $(R^1COO)_2Sn$ ($R^1$ represents an alkyl group having 5 to 19 carbon atoms or alkenyl group having 5 to 19 carbon atoms), dialkoxy tin (II) represented by $(R^2O)_2Sn$ ($R^2$ represents an alkyl group having 6 to 20 carbon atoms or alkenyl group having 6 to 20 carbon atoms), and tin (II) oxide represented by SnO are desirable. Tin (II) fatty acid represented by $(R^1COO)_2Sn$ and tin (II) oxide are more desirable. Tin (II) dioctanoate, tin (II) distearate, and tin (II) oxide are still more desirable.

The amount of the tin (II) compound having no Sn—C bond existing in the alcohol component and the carboxylic acid component, based on the total mass 100 parts by mass of the alcohol component and the carboxylic acid component, is preferably 0.01 parts by mass to 1.0 part by mass, and more preferably 0.1 parts by mass to 0.5 parts by mass.

When the titanium compound is used in combination with the tin (II) compound having no Sn—C bond, the total amount of the titanium compound and tin (II) compound existing in the alcohol component and the carboxylic acid component is preferably 0.01 parts by mass to 1.0 part by mass, and more preferably 0.1 parts by mass to 0.5 parts by mass, based on the total mass 100 parts by mass of the alcohol component and the carboxylic acid component.

The polycondensation between the alcohol component and the carboxylic acid component can be carried out, for example, in presence of the esterified catalyst under inactive gas atmosphere at a temperature of 180° C. to 250° C.

As a method of reducing the amount of abietic acid by means of reducing the amount of unreacted rosin, steam distillation treatment may be employed.

Water to be mixed with a resin at the time of the steam distillation treatment may be in a liquid state or in a gas state (water vapor), and the amount of water to be mixed per 100 parts by mass of a resin to be obtained is preferably 0.1 parts by mass to 50 parts by mass, more preferably 0.5 parts by mass to 40 parts by mass, and still more preferably 1 part by mass to 30 parts by mass, from the perspective of controlling the affect on physical properties of the resin.

The resin is preferably mixed with water under temperature conditions in the range of 100° C. to 300° C., more preferably in the range of 130° C. to 250° C., and particularly preferably in the range of 150° C. to 240° C., from the perspective of distillation efficiency of water and the viscosity of a reactant mixture.

In the mixing of a resin and water, the addition rate of water based on 100 parts by mass of a resin to be obtained is preferably 0.002 parts by mass/min to 0.5 parts by mass/min, more preferably 0.008 parts by mass/min to 0.3 parts by mass/min, and still more preferably 0.008 parts by mass/min to 0.2 parts by mass/min.

The timing of the mixing of a resin and water is not particularly limited, and the mixing may be carried out at any time, as long as the mixing is carried out during the time from the completion of addition of rosin to the time point when a reactant resin is extracted from a reaction vessel which includes a reactant mixture that has been subjected to the entire polycondensation reaction. However, preferably, during the polycondensation reaction, and more preferably, until just before a reactant resin is extracted, the resin is in a state of being mixed with water.

A method of mixing of a resin and water is not particularly limited and may be suitably selected in accordance with the intended use. A method of blowing water vapor at 100° C. to 260° C. into a resin is preferable, and it is particularly preferable that the temperature of the water vapor be 120° C. to 180° C. When a bubbling method of blowing air or nitrogen gas is employed and the resin has a high viscosity, each of bubbles generated expands, and no mutual interaction exists between the bubbles and the resin. Therefore, with this method, it is impossible to obtain a sufficient effect. In contrast, by blowing water vapor into the resin, water is uniformly diffused across a wide area of the resin as fine water vapor bubbles, and thus it is assumed that the use of the blowing method makes it possible to separate unreacted rosin from the rosin compound.

The softening point of the polyester resin is preferably 80° C. or higher and lower than 160° C., more preferably 90° C. to 150° C., and still more preferably 95° C. to 150° C., from the perspective of reducing the adhesion amount of toner onto carrier and charge roller, etc. The softening point can be readily adjusted by controlling, for example, the time spent for polymerization.

The glass transition temperature of the polyester resin is preferably 45° C. to 75° C. and more preferably 50° C. to 65° C., from the perspective of fixing property, storage stability and durability of toner. The acid value of the polyester resin is preferably 1 mgKOH/g to 90 mgKOH/g and more preferably 10 mgKOH/g to 50 mgKOH/g, from the perspective of chargeability and environmental stability of toner.

Note that in the present invention, the polyester resin may be a polyester resin that is modified to an extent where the physical properties are not substantially impaired. Examples of the modified polyester resin include polyester resins that are grafted or blocked with phenol, urethane, epoxy resin or the like by any of the methods described in Japanese Patent Application Laid-Open (JP-A) Nos. 11-133668, 10-239903, 8-20636 etc.; complex resins having two types or more resin units containing polyester unit(s).

The amount of the polyester resin obtained by using a predetermined amount of the rosin compound, in the binder resin, is preferably 70% by mass or more, more preferably 80% by mass or more, still more preferably 90% by mass or more, and particularly preferably, it is substantially 100% by mass.

The toner according to the third embodiment contains as a binder resin the following styrene-acrylic resin, in addition to the polyester resin.

-Styrene-Acrylic Resin-

The styrene-acrylic resin is not particularly limited, and those typically known in the art can be used. Examples thereof include styrene-methylacrylate copolymers, styrene-ethylacrylate copolymers, styrene-butylacrylate copolymers, styrene-propylacrylate copolymers, styrene-methylmethacrylate copolymers, styrene-ethylmethacrylate copolymers, styrene-butylmethacrylate copolymers or mixtures thereof, mutual copolymers thereof, and derivatives thereof. Of these, from the perspective of fixing property and heat-resistance/storage stability, styrene-butylacrylate copolymers, and styrene-methylacrylate copolymers are particularly preferable.

The styrene-acrylic resin preferably contains a crosslinking component(s). With this, it is possible for the toner to exhibit appropriate elasticity when heated and melted, while benefiting from the polyester resin in terms of low-temperature fixing property and obtain an excellent effect of hot-offset resistance without the heat-resistance/storage stability being impaired. As to introduction of a crosslinking component into the styrene-acrylic resin, for example, it is easy to copolymerize a radically polymerizable ethylene polyfunctional monomer. Examples of the radically polymerizable ethylene polyfunctional monomer include divinylbenzene, hexandioldiacrylate, ethyleneglycol dimethacrylate, ethylene glycol dimethacrylate, diethylene glycoldimethacrylate, diethyleneglycol diacrylate, triethylene glycoldiacrylate, neopentylglycol dimethacrylate, and neopentylglycol acrylate. In addition to the radically polymerizable ethylene polyfunctional monomers, monomers having reactive groups in pendant groups, for example, glycidyl methacrylate, methylol acrylamide, acrolein or the like can be used. Of these, divinylbenzene, and hexanedioldiacrylate are particularly preferable.

The mass ratio [(B)/(A)] of the polyester resin (B) to the styrene-acrylic resin (A) is preferably 5/5 to 1/9 and more preferably 3/7 to 1/9. Within the mass ratio range, the toner can exhibit favorable low-temperature fixing property and excellent heat-resistance/storage stability.

Note that as the binder resin, other resin, for example, an epoxy resin, a polycarbonate resin, a polyurethane resin or the like may be used in combination within the range the effect of the present invention is not impaired.

<Charge Controlling Agent>

In the toner according to the second embodiment, the charge controlling agent contains at least one metal compound composed of a trivalent or higher polyvalent aromatic oxycarboxylic acid as a center metal.

The metal compound whose center metal is a trivalent or higher polyvalent aromatic oxycarboxylic acid can be excellently dispersed in the binder resin of the present invention and is excellent in charge build-up property. When the metal compound is used in production of a toner, a charge controlling agent that has not been finely dispersed will not be exposed on the surface of toner particles, causing less variation in charged amount between toner particles, and the toner can obtain a sharp distribution of charge amount and has less component parts with low-charge amount. Further, the toner will suffer from no inhibition of charging due to an abietic acid present in the toner, and thus the toner is excellent in charge stability as well. Therefore, it is considered that when the toner is used, high-quality images can be obtained without substantially causing abnormal images such as a reduction in image-transfer rate, a reduction in image density, and fogging.

As the metal compound composed of a trivalent or higher polyvalent aromatic oxycarboxylic acid as a center metal, for example, a compound represented by the following General Formula (1) is preferable.

General Formula (1)

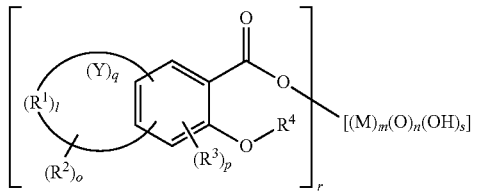

In the General Formula (1), $R^1$ represents any of a carbon atom, a methine group, and a methylene group, each of the methine group and the methylene group may contain a hetero atom selected from N, S, O and P; Y represents a ring structure bonded with a saturated bond or an unsaturated bond; each of $R^2$ and $R^3$ represents a hydrogen atom, a halogen atom, a hydroxyl group, a nitro group, a nitroso group, a sulfonyl group, a cyano group, an alkyl group, an alkenyl group, an alkoxy group, an aryl group, an aryloxy group, an aralkyl group, an aralkyloxy group, an amino group, a carboxyl group, and a carbonyl group, when each of "o" and "p" is an integer of 1 or more, $R^2$ and $R^3$ may be the same or different from each other and may be further substituted by a substituent; "l" is 0 or an integer of 3 to 12; "m" is an integer of 1 to 20; "n" is an integer of 0 to 20; "o" is an integer of 0 to 4, "p" is an integer of 0 to 4; "q" is an integer of 0 to 3; "r" is an integer of 1 to 20; and "s" is an integer of 0 to 20; and M is a trivalent or higher polyvalent center metal.

As an alkyl group contained in the $R^2$ and $R^3$, an alkyl group having 1 to 18 carbon atoms is preferable. Examples of such an alkyl group include methyl group, ethyl group, propyl group, isopropyl group, butyl group, isobutyl group, sec-butyl group, tert-butyl group, pentyl group, isopentyl group, neopentyl group, hexyl group, heptyl group, octyl group, nonyl group, decyl group, undecyl group, dodecyl group, vinyl group, benzyl group, phenethyl group, styryl group, cyclopentyl group, cyclohexyl group, cycloheptyl group, and cyclohexenyl group.

Examples of the aryl group include phenyl group, tolyl group, xylyl group, styryl group, naphthyl group, anthryl group, and biphenyl group.

Examples of the alkoxy group include methoxy group, ethoxy group, butoxy group, propyoxy group, hexyloxy group, cyclohexyloxy group, heptyloxy group, octyloxy group, tertiary octyloxy group, 2-ethylhexyloxy group, decyloxy group, dodecyloxy group, and octadecyloxy group.

Examples of the aryloxy group include phenyloxy group, naphthyloxy group, and anthranyloxy group.

Examples of the aralkyl group include benzyl group, phenylethyl group, and phenylpropyl group.

Examples of the alkenyl group include vinyl group, allyl group, propenyl group, isopropenyl group, butenyl group, hexenyl group, cyclohexenyl group, and octenyl group.

Examples of the substituent that is further substituted by the substituent represented by $R^2$ or $R^3$ include a halogen atom; alkyl groups such as nitro group, cyano group, methyl group, and ethyl group; methoxy group, and ethoxy group; aryloxy group such as phenoxy group; aryl group such as phenyl group and naphthyl group; and aralkyl group.

Examples of the ring structure represented by Y include aliphatic ring, aromatic ring, and heterocyclic ring.

As the center metal M, all trivalent or higher polyvalent metals are usable, however, preferred examples thereof include Fe, Ni, Al, Ti, and Zr. Of these, Fe and Zr are particularly preferable for its excellence in charge build-up property. From the viewpoint of safety, Fe is preferably used. In terms that the compound is white in color and suitable for color toner, Zr is preferable.

When the metal compound composed of aromatic oxycarboxylic acid has a trivalent or higher polyvalent center metal, the metal compound can be excellently dispersed in a polyester resin containing 1,2-propanediol as an alcohol component and the toner will be excellent in charge build-up property. In contrast, when the center metal is divalent, the toner will be excellent in charge build-up property, however, the metal compound cannot be favorably dispersed in a polyester resin containing 1,2-propanediol as an alcohol component, resulting in incapability of obtaining preventive effect against reduction in charge amount caused by degradation of toner with time. Therefore, for the metal compound composed of a trivalent or higher polyvalent aromatic oxycarboxylic acid, a compound represented by the General Formula (1) is preferably used.

The aromatic oxycarboxylic acid site in the metal compound composed of a trivalent or higher polyvalent aromatic oxycarboxylic acid can be represented by the following General Formula (2).

General Formula (2)

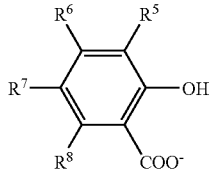

In the General Formula (2), each of $R^5$, $R^6$, $R^7$ and $R^8$ is preferably a hydrogen atom, a straight-chain alkyl group having 1 to 18 carbon atoms, a branched alkyl group having 1 to 18 carbon atoms or an aryl group; $R^5$, $R^6$, $R^7$and $R^8$ may be the same or different from each other; further, each combination of $R^5$ and $R^6$, $R^6$ and $R^7$, and $R^7$ and $R^8$ may be bonded to form an aromatic ring that may have a substituent or an aliphatic ring that may have a substituent.

As for the alkyl group and aryl group, the same ones described above in the General Formula (1) are exemplified.

The following describes specific examples of the aromatic oxycarboxylic acid site represented by the General Formula (2), however, the aromatic oxycarboxylic acid site is not limited thereto.

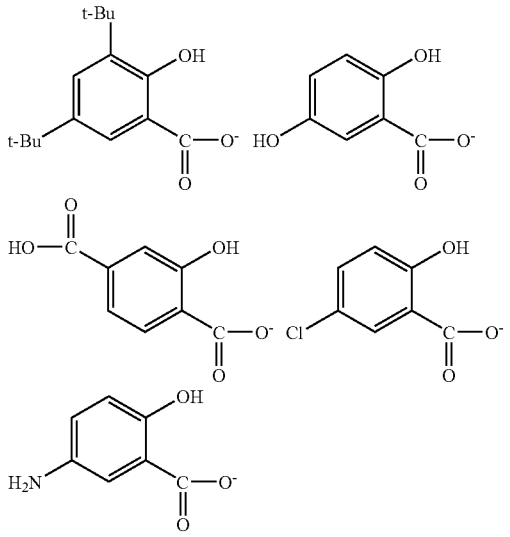

In the above formulas, t-Bu represents a tertiary butyl group.

The following describes specific examples of a metal compound composed of aromatic oxycarboxylic acid represented by the General Formula (1), the metal compound composed of aromatic oxycarboxylic acid is not limited thereto. Each of these compounds may be used alone or in combination.

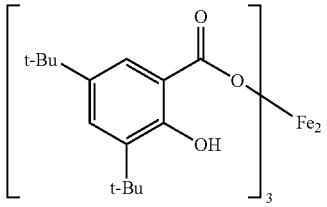

where t-Bu represents a tertiary butyl group.

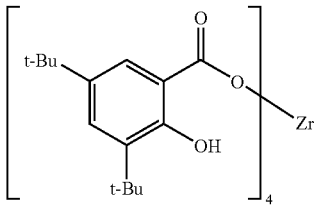

where t-Bu represents a tertiary butyl group.

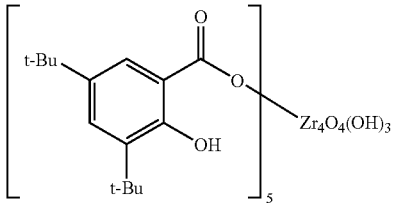

where t-Bu represents a tertiary butyl group.

The amount of the metal compound composed of a trivalent or higher polyvalent aromatic oxycarboxylic acid as a center metal contained in the toner cannot be unequivocally determined because it is determined by the toner production method employed, including the structure of the resin used, and the dispersion method. However, the amount of the metal compound contained is preferably 0.1 parts by mass to 10 parts by mass, more preferably 0.5 parts by mass to 5 parts by mass, and still more preferably 0.5 parts by mass to 2 parts by mass, based on 100 parts by mass of the binder resin. When the amount of the metal compound is less than 0.1 parts by mass, charge build-up property and effect of charge stability with time may not be readily obtained. When it is more than 10 parts by mass, it may result in an exceedingly large charged amount and/or degradation of low-temperature fixing property.

In the toners according to the first and third embodiments, a conventionally known charge controlling agent may be used in combination in accordance with the necessity, within the range where the effect of the present invention is not impaired. Such a charge controlling agent is not particularly limited and may be suitably selected in accordance with the intended use. Examples thereof include triphenylmethane dyes, molybdenum acid chelate pigments, rhodamine dyes, alkoxy-based amines, quaternary ammonium salts (including fluorine-modified quaternary ammonium salts), alkylamide, phosphorous monomers or compounds thereof, tungsten monomers or compounds thereof, fluorine-based activators, metal salts of salicylic acid, and metal salts of salicylic acid derivatives. Each of these may be used alone or in combination. The charge controlling agent may be fused and kneaded along with a masterbatch and then dissolved or dispersed in a toner composition, or may be directly added to the organic solvent along with necessary components of the toner so as to be dissolved or dispersed therein. Alternatively, the charge controlling agent may be fixed on a surface of the toner, after production of toner particles.

In the present invention, a charge controlling agent for controlling the charge amount of toner may be used. The charge controlling agent is not particularly limited and may be suitably selected from among those known in the art in accordance with the intended use. However, when a colored material is used, the toner sometimes changes in color tone, and thus a colorless material or a material close to white in color is preferably used. For example, triphenylmethane dyes molybdenum acid chelate pigments, rhodamine dyes, alkoxy-based amines, quaternary ammonium salts (including fluorine-modified quarternary ammonium salts), alkylamide, phosphorous monomers or compounds thereof, tungsten monomers or compounds thereof, fluorine-based activators, metal salts of salicylic acid, and metal salts of salicylic acid derivatives.

For the charge controlling agent, commercially available products may be used. Examples of commercially available products thereof include BONTRON P-51 composed of quaternary ammonium salt, E-82 composed on oxynaphthoic metal complex, E-84 composed of salicylic metal complex, and E-89 composed of phenol condensate (all manufactured by Orient Chemical Industries, Ltd.); TP-302 and TP-415 each composed of molybdenum complex of quaternary ammonium salt (all manufactured by Hodogaya Chemical Co.); COPY CHARGE PSY VP2038 composed of quaternary ammonium salt, COPY BLUE PR composed of triphenyl methane derivative, COPY CHARGE NEG VP2036 and COPY CHARGE NX VP434 each composed of quaternary ammonium salt (all manufactured by Hochst Corporation); LRA-901, and LR-147 (boron complex) (all manufactured by Japan Carlit Co., Ltd.); quinacridone, azo pigments; and polymer based compounds having a functional group such as sulfonic acid group, carboxyl group, and quaternary ammonium salt.

The amount of the charge controlling agent contained in the toner cannot be unequivocally determined because it differs depending on the type of the binder resin used, presence or absence of additives, the dispersion method, and the like. However, it is preferably 0.1 parts by mass to 10 parts by mass, and more preferably 0.2 parts by mass to 5 parts by mass, based on 100 parts by mass of the binder resin. When the amount of the charge controlling agent is less than 0.1 parts by mass, the charge controllability may not be sometimes obtained, and when it is more than 10 parts by mass, the effect of addition of the charge controlling agent may be reduced due to the excessive charge amount of the toner to increase the electrostatic attraction force of the toner with respect to a developing roller, causing a degradation in flowability of the developer and a reduction in image density.

-Colorant-

The colorant is not particularly limited and may be suitably selected from among known dyes and pigments in the art. Examples thereof include carbon blacks, nigrosine dyes, iron black, Naphthol Yellow S, Hansa Yellow (10G, 5G, G), cadmium yellow, yellow iron oxide, yellow ocher, chrome yellow, Titan Yellow, Polyazo Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, anthracene yellow BGL, isoindolinone yellow, colcothar, red lead oxide, lead red, cadmium red, cadmium mercury red, antimony red, Permanent Red 4R, Para Red, Fire Red, parachloroorthonitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Heio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS, BC), indigo, ultramarine blue, iron blue, anthraquinone blue, fast violet B, Methylviolet lake, cobalt purple, manganese violet, dioxane violet, anthraquinone violet, chrome green, zinc green, chromium oxide, viridian green, emerald green, pigment green B, naphthol green B, green gold, acid green lake, malachite green lake, phthalocyanine green, anthraquinone green, titanium oxide, zinc flower and lithopone. Each of these may be used alone or in combination.

Color of the colorant is not particularly limited and may be suitably selected in accordance with the intended use. For instance, colorants for black toner, and colorants for color toner are exemplified. These may be used alone or in combination.

Examples of the colorants for black toner include carbon blacks (C.I. Pigment Black 7) such as furnace black, lamp black, acetylene black, and channel black; copper-based or iron-based dyes (C.I. Pigment Black 11), and titanium oxide; and organic pigments such as aniline black (C.I. Pigment black 1).

For coloring pigments for magenta toner, for example, C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 163, 177, 179, 202, 206, 207, 209, 211; C.I. Pigment Violet 19; C.I. Bat Red 1, 2, 10, 13, 15, 23, 29, and 35 are exemplified.

For coloring pigments for cyan toner, for example, C.I. Pigment Blue 2, 3, 15, 15:1, 15:2, 15:3, 15:4, 15:6, 16, 17, 60; C.I. Bat Blue 6; C.I. Acid Blue 45 or copper phthalocyanine pigments having 1 to 5 substituted phthalimidemethyl groups in a phthalocyanine skeleton, Green 7, and Green 36 are exemplified.

For coloring pigments for yellow toner, for example, C.I. Pigment Yellow 0-16, 1, 2, 3, 4, 5, 6, 7, 10, 11, 12, 13, 14, 15, 16, 17, 23, 55, 65, 73, 74, 83, 97, 110, 151, 154, 180; C.I. Bat Yellow 1, 3, 20, and Orange 36.

The amount of the colorant contained in the toner is not particularly limited and may be suitably selected in accordance with the intended use, however, it is preferably 1% by mass to 15% by mass, and more preferably 3% by mass to 10% by mass. When the amount of the colorant is less than 1% by mass, degradation in tinting power of the toner is observed, and when it is more than 15% by mass, it causes defective dispersion of the pigment in the toner, leading to a degradation in tinting power and a degradation in electric properties.

The colorant may be combined with a resin so as to be used as a masterbatch. The resin is not particularly limited and may be suitably selected from known resins in accordance with the intended use; examples thereof include polyesters, polymers of styrenes or substituted styrenes, styrene copolymers, polymethyl methacrylates, polybutyl methacrylates, polyvinyl chlorides, polyvinyl acetates, polyethylenes, polypropylenes, epoxy resins, epoxy polyol resins, polyurethanes, polyamides, polyvinyl butyral, polyacrylic acid resins, rosins, modified rosins, terpene resins, aliphatic hydrocarbon resins, alicyclic hydrocarbon resins, aromatic petroleum resins, chlorinated paraffin and paraffin wax. These may be used alone or in combination.

Examples of polymers of styrenes or substituted styrenes include polystyrene, poly-p-chlorostyrene and polyvinyl toluene. Examples of styrene copolymers include styrene-p-chlorostyrene copolymers, styrene -propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-butyl acrylate copolymers, styrene-octyl acrylate copolymers, styrene-ethyl methacrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic ester copolymers.

The masterbatches may be obtained by mixing or kneading a resin and a colorant under high shearing force. In order to improve interaction between the colorant and the resin, an organic solvent may be preferably added to the colorant and the resin. In addition, the "flushing process" in which a wet cake of a colorant is applied directly is preferable because drying is not necessary. In the flushing process, a water-based paste containing a colorant and water is mixed or kneaded with a resin and an organic solvent so that the colorant moves towards the resin, and that the water and the organic solvent are removed. The materials are preferably mixed or kneaded using a high-shear dispersing device, such as a triple roll mill.

-Releasing Agent-

The releasing agent is not particularly limited and may be suitably selected from among those known in the art in accordance with the intended use. Examples thereof include carbonyl group-containing waxes, polyolefin waxes, and waxes composed of long-chain hydrocarbon. Each of these may be used alone or in combination. Of these, carbonyl group-containing waxes are preferable.

Examples of the carbonyl group-containing waxes include polyalkanoic acid esters, polyalkanol esters, polyalkanoic acid amides, and dialkylketones. Examples of the polyalkanoic acid esters include carnauba waxes, montan waxes, trimethylolpropane tribehenate, pentaerythritol tetrabehenate, pentaerythritol diacetatebehenate, glycerin tribehenate, and 1,18-octadecanedioldistearate. Examples of the polyalkanol esters include trimellitic acid tristearyl, and distearyl maleate. Examples of the polyalkanoic acid amides include dibehenylamides. Examples of the polyalkylamides include trimellitic acid tristearylamides. Examples of the dialkylketones include distearylketones. Of these carbonyl group-containing waxes, polyalkanoic acid esters are particularly preferable.

Examples of the polyolefin waxes include polyethylene waxes, and polypropylene waxes.

Examples of the long-chain hydrocarbon include paraffin waxes, and sazol waxes.

The melting point of the releasing agent is not particularly limited and may be suitably selected in accordance with the intended use, however, it is preferably 40° C. to 160° C., more preferably 50° C. to 120° C., and particularly preferably 60°

C. to 90° C. When the melting point is lower than 40° C., it may adversely affect the heat-resistance/storage stability, and it is higher than 160° C., cold-offset is likely to occur at the time of fixing at low-temperature.

The melting point of the releasing agent can be determined by the following method. Firstly, the temperature of a releasing agent sample is raised to 200° C. using a differential scanning calorimeter (DSC210, manufactured by Seiko Electronics Industries Co., Ltd.), cooled to 0° C. at a temperature decrease rate of 10° C./min. The temperature of the cooled sample is then raised at a temperature increase rate of 10° C./min, and the maximum peak temperature of heat of melting is determined as the melting point of the sample.

The melt viscosity of the releasing agent is, as a measurement value of 20° C. higher than the melting point of the wax, preferably 5 cps to 1,000 cps, and more preferably 10 cps to 100 cps. When the melt viscosity is lower than 5 cps, the releasing property of the toner may sometimes degrade, and when it is higher than 1,000 cps, effects of hot-offset property and low-temperature fixing property may not be sometimes obtained.

The amount of the releasing agent contained in the toner is not particularly limited and may be suitably selected in accordance with the intended use, however, it is preferably 40% by mass or less, and more preferably 3% by mass to 30% by mass.

When the amount of the releasing agent is more than 40% by mass, the flowability of the toner may sometimes degrade.

-External Additives-

The external additives are not particularly limited and may be suitably selected from among those known in the art in accordance with the intended use. Examples thereof include silica fine particles, hydrophobized silica fine particles, fatty acid metal salts (for example, zinc stearate, aluminum stearate, etc.); metal oxides (for example, titania, alumina, tin oxides, antimony oxides, etc.) or hydrophobized products thereof, and fluoropolymers. Of these, hydrophobized silica fine particles, titania particles, and hydrophobized titania fine particles.

Examples of commercially available products of silica fine particles include HDK H 2000, HDK H 2000/4, HDK H 2050EP, HVK21, HDK H1303 (all produced by Hochst Corporation); and R972, R974, RX200, RY200, R202, R805, and R812 (all produced by Nippon AEROSIL CO., LTD.). Examples of commercially available products of titania fine particles include P-25 (produced by Nippon AEROSIL CO., LTD.); STT-30 and STT-65C-S (all produced by Titanium Industry Co., Ltd.), TAF-140 (produced by Fuji titanium Industry Co., Ltd.); and MT-150W, MT-500B, MT-600B and MT-150A (all produced by TAYCA CORPORATION). Examples of commercially available products of hydrophobized titanium fine particles include T-805 (produced by Nippon AEROSIL CO., LTD.); STT-30A, STT-65S-S and STT-65 S -S (all produced by Titanium Industry Co., Ltd.); TAF-550T and TAF-1500T (all produced by Fuji titanium Industry Co., Ltd.); MT-100S and MT-100T (all produced by TAYCA CORPORATION); and IT-S (produced by ISHIHARA INDUSTRY CO., LTD.).

The hydrophobized silica fine particles, hydrophobized titania fine particles, and hydrophobized alumina fine particles can be obtained by surface-treating hydrophilic fine particles with a silane coupling agent such as methyltrimethoxysilane, and octyltrimethoxysilane.

Examples of hydrophobizing agents include silane coupling agents such as dialkyldihalogenated silane, trialkylhalogenated silane, alkyltrihalogenated silane, and hexaalkyldisilazane; silylation agents; silane coupling agents having fluorinated alkyl groups; organic titanate-based coupling agents, aluminum-based coupling agents, silicone oil, and silicone varnish.

Further, silicone oil-treated inorganic fine particles are also preferably used which are obtained by surface-treating inorganic fine particles with silicone oil under application of heat.

Examples of the inorganic fine particles include silica, alumina, titanium oxides, barium titanate, magnesium titanate, calcium titanate, strontium titanate, iron oxides, copper oxides, zinc oxides, tin oxides, silica sand, clay, mica, wollastonite, diatomite, chromium oxides, cerium oxides, colcothar, antimony trioxides, magnesium oxides, zirconium oxides, barium sulfates, barium carbonate, calcium carbonate, silicon carbide, and silicon nitride. Of these, silica, and titanium dioxide are particularly preferable.

Examples of the silicone oil include dimethyl-silicone oils, methylphenyl-silicone oils, chlorophenyl-silicone oils, methylhydrogen-silicone oils, alkyl-modified silicone oils, fluorine-modified silicone oils, polyether-modified silicone oils, alcohol-modified silicone oils, amino-modified silicone oils, epoxy-modified silicone oils, epoxy-polyether-modified silicone oils, phenol-modified silicone oils, carboxyl-modified silicone oils, mercapto-modified silicone oils, acryl or methacryl-modified silicone oils, and α-methyl-styrene-modified silicone oils.

The average primary particle diameter of the inorganic fine particles is preferably 1 nm to 100 nm, and more preferably 3 nm to 70 nm. When the average particle diameter is smaller than 1 nm, the inorganic fine particles are embedded in toner particles, and the function is hardly exhibited, and when it is larger than 100 nm, the particles may unevenly damage the surface of a latent electrostatic image bearing member used. As the external additives, inorganic fine particles and hydrophobized inorganic fine particles can be used together, however, the average particle diameter of primary particles that have been hydrophobized is preferably 1 nm to 100 nm, and more preferably 5 nm to 70 nm. It is more preferable that the inorganic fine particles contain at least two types of hydrophobized inorganic fine particles having an average primary particle diameter of 20 nm or smaller and contain at least one type of inorganic fine particles having an average primary particle diameter as well. Further, the inorganic fine particles preferably have a specific surface area, measured by the BET method, of 20 $m^2/g$ to 500 $m^2/g$.

The amount of the external additives added in the toner is preferably 0.1% by mass to 5% by mass, and more preferably 0.3% by mass to 3% by mass.

As the external additives, resin fine particles can be added as well. Examples of the resin fine particles include polystyrenes obtained by soap-free emulsification polymerization, suspension polymerization, or dispersion polymerization; copolymers of methacrylic acid esters or acrylic acid esters; polycondensation products of silicone, benzoguanamine, nylon, or the like; and polymer particles composed of thermosetting resin. The use of such resin fine particles in combination makes it possible to reinforce the charging property of toner, reduce the amount of oppositely charged toner particles and reduce the occurrence of background smear. The amount of the resin fine particles added in the toner is preferably 0.01% by mass to 5% by mass, and more preferably 0.1% by mass to 2% by mass.

-Other Component-

The other components are not particularly limited and may be suitably selected in accordance with the intended use. For instance, flowability improvers, cleanability improvers, magnetic materials, and metal soaps are exemplified.

The flowability improver is added for surface-treating the toner to increase the hydrophobicity and is capable of preventing the flowability and the charging property of the toner from degrading when stored under high-humidity environments. Examples of the flowability improver include silane coupling agents, silylating agents, fluorinated alkyl group-containing silane coupling agents, organic titanate-based coupling agents, aluminum-based coupling agents, silicone oils, and modified silicone oils.

The cleanability improver is added to the toner for removing an untransferred developer which is remaining on a latent electrostatic image bearing member and an intermediate transfer. Examples of the cleanability improver include fatty acid metal salts such as zinc stearate, calcium stearate, and stearic acid; and polymer fine particles produced by soap-free emulsification polymerization such as polymethyl methacrylate fine particles, and polystyrene fine particles. As the polymer fine particles, those having a relatively narrow particle size distribution and a volume average particle diameter of 0.01 μm to 1 μm are preferable.

The magnetic material is not particularly limited and may be suitably selected from among those known in the art in accordance with the intended use. Examples thereof include iron powder, magnetite, and ferrite. Of these, those of white in color are preferable in terms of color tone.

<Toner Production Method>

The toner production method is not particularly limited and may be suitably selected from among known toner production methods in accordance with the intended use. For example, kneading pulverization method, polymerization method, dissolution suspension method, and spray granulation method are exemplified. Of these methods, kneading pulverization method is particularly preferable, from the perspective of dispersibility of metal compounds of aromatic oxycarboxylic acid and colorants and productivity of toner.

-Kneading Pulverization Method-

In the kneading pulverization method, toner base particles of the toner are produced by melt kneading toner materials containing, for example, at least a binder resin, a colorant, and a charge controlling agent to obtain a kneaded mixture, and pulverizing the kneaded mixture into particles and then classifying the particles. In the melt kneading, the toner materials are mixed, and the mixture is placed in a melt-kneader and fused and kneaded. As to the melt kneader, single-screw or double-screw continuous kneaders and batch kneaders using roll mill can be used. For a specific unit for kneading the toner materials, KTK type double-screw extruder manufactured by KOBE STEEL, LTD.; TEM type double-screw extruder manufactured by TOSHIBA MACHINE CO., LTD.; double-screw extruder manufactured by KCK Co., Ltd.; PCM type double-screw extruder manufactured by Ikegai Corp.; Co-kneader manufactured by Buss Co. are preferably used. The melt kneading is preferably carried out under appropriate conditions so as not to cut off molecular chains of the binder resin. Specifically, the melt kneading temperature is set with reference to the softening point of the binder resin. If the melt kneading temperature is excessively higher than the softening point of the binder resin, molecular chains of the binder resin are strongly cut off, and if it is excessively lower than the softening point of the binder resin, the toner materials may not be progressively dispersed.

In the pulverization, a kneaded mixture obtained in the kneading treatment is pulverized. It is preferable that firstly, the kneaded mixture is coarsely crushed, and then finely pulverized. On this occasion, the mixture is preferably pulverized by being crashed to a collision board in a jet stream, and pulverized in a narrow gap between a mechanically rotating rotator and a stator.

In the classification, the pulverized product obtained in the pulverization is classified so as to obtain particles having a predetermined particle size. For example, the classification is carried out by removing fine particles with the use of a cyclone, a decanter, or a centrifuge separator.

After completion of the pulverization and classification, the pulverized product is classified in an air stream classifier using a centrifugal force, thereby toner base particles having predetermined particle size can be produced.

Subsequently, external additives are added to toner base particles. By mixing and stirring the toner base particles and external additives in a mixer, the surfaces of the toner base particles are coated with the external additives while the external additives being dissolved and crushed. On this occasion, it is important, in terms of durability of toner, to make external additives such as inorganic fine particles and resin fine particles uniformly and tightly adhere to the toner base particles.

Color of the toner is not particularly limited and may be suitably selected in accordance with the intended use, however, a full-color toners composed of a black toner, a cyan toner, a magenta toner and a yellow toner are preferable. The color of the toner may be at least one selected from these colors.

The weight average particle diameter of the toner is not particularly limited and may be suitably adjusted in accordance with the intended use. However, in order to high-quality images excellent in granularity, image sharpness, and thin-line reproductivity, the weight average particle diameter is preferably 3 μm to 10 μm, and more preferably 4 μm to 7 μm. When the weight average particle diameter is less than 3 μm, the flowability and transferability of toner may sometimes degrade, although images formed are excellent in image sharpness and thin line reproductivity.

The weight average particle diameter of the toner can be measured in accordance with the following manner, for example.

- measurement device: COULTER MULTISIZER III (manufactured by Beckman Coulter Co.)
- aperture diameter: 100 μm
- analysis software: BECKMAN COULTER MULTISIZER 3 Ver. 3.51 (manufactured by Beckman Coulter Co.)
- electrolyte: ISOTON III (manufactured by Beckman Coulter Co.)
- dispersion liquid: 10% by mass of surfactant (alkylbenzene sulfonic acid salt, NEOGEN SC-A, produced by Daiichi Kogyo Seiyaku Co., Ltd.)
- dispersion conditions: 10 mg of a measurement sample is added to 5 mL of the dispersion liquid and dispersed in a supersonic dispersing device for 1 minute. Thereafter, 25 mL of the electrolyte is added to the dispersion liquid and further dispersed in the ultrasonic dispersing device for 1 minute.
- measurement conditions: 100 mL of the electrolyte and the dispersion liquid are added to a beaker, 30,000 particles are measured at a concentration with which the particle diameters of 30,000 particles can be measured in 20 seconds. Based on the resulting particle size distribution, the weight average particle diameter of the measurement sample is determined.

(Developer)

A developer of the present invention contains at least the toner and contains other suitably selected components such as carrier. The developer may be a one-component developer or a two-component developer. When used in high-speed printers responsive to increased information processing speed in recent years, a two-component developer is preferable, in terms of improvement in life cycle.

In the case of the one-component developer using the toner, there was little valuation in particle diameter of the toner, and toner filming to a developing roller as a developer bearing member and toner fusion to members such as a blade for making toner have a thin layer rarely occur even when the toner inflows and outflows, and it is possible to obtain excellent and stable developing property and images even under long-term use (agitation) in the image developing unit.

-Carrier-

The carrier is not particularly limited and may be suitably selected in accordance with the intended use, however, the carrier preferably has a core material and a resin layer for coating the core material.

The core material is not particularly limited and may be suitably selected from among those known in the art. For example, 50 emu/g to 90 emu/g of manganese-strontium (Mn—Sr) material or manganese-magnesium (Mn—Mg) material is preferable. In terms of ensuring the image density, highly magnetized materials such as iron powder (100 emu/g or more) and magnetite (75 emu/g to 120 emu/g) are preferable. In terms of capability of weakening the abutting to a latent electrostatic image bearing member on which surface the toner is standing and in terms that it is advantageous in obtaining high-quality images, weakly magnetized materials such as copper-zinc (Cu—Zn) materials (30 emu/g to 80 emu/g) are preferable. Each of these materials may be used alone or in combination.

The particle diameter of the core material, based on the average particle diameter (volume average particle diameter ($D_{50}$)) is preferably 10 μm to 200 μm, and more preferably 40 μm to 100 μm. When the average particle diameter (volume average particle diameter ($D_{50}$) is smaller than 10 μm, it may sometimes cause carrier scattering may occur due to an increase in the amount of fine particles in the carrier particle distribution and the reduced magnetization per particle. When it is greater than 200 μm, toner scattering may sometimes occur, and in the case of a full-color image with a large area of solid part, in particular, the reproductivity of the solid part may sometimes degrade.

Material of the resin layer is not particularly limited and may be suitably selected from among resins known in the art. Preferred examples thereof include amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, copolymers of vinylidene fluoride with acryl monomer, copolymers of vinylidene fluoride with vinyl fluoride, fluoro-tarpolymers (tri or multiple-fluoride copolymers) such as tarpolymer of tetrafluoroethylene, vinylidene fluoride with non-fluoride monomer, and silicone resins. Each of these may be used alone or in combination. Of these, silicone resins are particularly preferable.

The silicone resin is not particularly limited and may be suitably selected from among typically known silicone resins in accordance with the intended use. Examples thereof include straight silicone resins composed only of organosiloxane bond; and silicone resins that have been modified with alkyd resin, polyester resin, epoxy resin, acrylic resin, or urethane resin.

For the silicone resin, commercially available products can be used. Examples of the straight silicone resins include KR271, KR255 and KR152 produced by Shin-Etsu Chemical Co., Ltd.; and SR2400, SR2406, and SR2410 produced by DOW CORNING TORAY SILICONE CO., LTD.

For the modified silicone resin, commercially available products can be used. Examples of the modified silicone resin include KR206 (alkyd-modified), KR5208 (acryl-modified), ES1001N (epoxy-modified), and KR305 (urethane modified) produced by Shin-Etsu Chemical Co., Ltd.; and SR2115 (epoxy-modified) and SR2110 (alkyd-modified) produced by DOW CORNING TORAY SILICONE CO., LTD.

Each of these silicone resins may be used alone, and components capable of crosslinking reaction, charge amount controlling components and the like may be used in combination therewith.

In the resin layer, conductive powder may be added in accordance with the necessity. Examples of the conductive powder include metal powder, carbon black, titanium oxide, tin oxide, and zinc oxide. The average particle diameter of these conductive powders is preferably 1 μm or less. When the average particle diameter is greater than 1 μm, control of electric resistance may become difficult.

The resin layer can be formed by the following method. Firstly, the surface of the core material is evenly coated by a known coating method, with a coating solution that has been prepared by dissolving the silicone resin etc. in a solvent, followed by being dried and baked. Examples of the coating method include dipping method, spraying method, and brush coating method.

The solvent is not particularly limited and may be suitably selected in accordance with the intended use. Examples thereof include toluene, xylene, methylethylketone, methylisobutylketone, Cellosolve, and butylacetate.

The baking method is not particularly limited. It may be an external heating method or an internal heating method. For example, a fixed type electric furnace, a fluid type electric furnace, a rotary type electric furnace or the like may be used. Alternatively, a microwave may be used.

The amount of the resin layer in the carrier is preferably 0.01% by mass to 5.0% by mass. When the amount is less than 0.01% by mass, the resin layer may not sometimes be evenly formed on the surface of the core material. When the amount is more than 5.0% by mass, the resin layer is formed excessively thick to cause granulation among carrier particles, and carrier particles uniform in size may not sometimes be obtained.

When the developer is a two-component developer, the amount of the carrier in the two-component developer is not particularly limited and may be suitably selected in accordance with the intended use. For example, it is preferably 90% by mass to 98% by mass, and more preferably 93% by mass to 97% by mass.

The mixture ratio of the toner in the two-component developer to the carrier is preferably 1 part by mass to 10.0 parts by mass based on 100 parts by mass of the carrier.

(Image Forming Apparatus and Image Forming Method)

An image forming apparatus of the present invention includes at least a charging unit, an exposing unit, a developing unit, a transfer unit, and a fixing unit, may include a cleaning unit, and may further include other units suitably selected in accordance with the necessity, such as a charge eliminating unit, a recycling unit, and a controlling unit. Note that a combination of a charging unit and an exposing unit is sometimes referred to as a latent electrostatic image forming unit.

An image forming method of the present invention includes at least a charging step, an exposing step, a developing step, a transferring step, and a fixing step, may include a cleaning step, and may further include other steps suitably selected in accordance with the necessity, such as a charge eliminating step, a recycling step, and a controlling step. Note that a combination of a charging step and an exposing step is sometimes referred to as a latent electrostatic image forming step.

The image forming method of the present invention can be suitably carried out by the image forming apparatus of the present invention; the charging step can be carried out by the charging unit; the exposing step can be carried out by the exposing unit; the transferring step can be carried out by the transfer unit; the fixing step can be carried out by the fixing unit; the cleaning step can be carried out by the cleaning unit; and the other steps can be carried out by the other units.

<Latent Electrostatic Image Bearing Member>

The latent electrostatic image bearing member is not particularly limited as to the material, shape, structure, size and the like, and may be suitably selected in accordance with the intended use. For the shape, drum-shape, sheet-shape, and endless belt-shape are exemplified. The structure of the latent electrostatic image bearing member may be a single-layer structure or a laminate structure. The size of the latent electrostatic image bearing member can be suitably selected in accordance with the size and specification of the image forming apparatus employed. As to the material of the latent electrostatic image bearing member, for example, inorganic photoconductors such as amorphous silicon, selenium, CdS, and ZnO; and organic photoconductors (OPC) such as polysilane, and phthalopolymethine.

The amorphous silicon photoconductor is provided with a photosensitive layer composed of a-Si, on a support which is heated at 50° C. to 400° C., by a layer forming method such as vacuum evaporation method, sputtering method, ion-plating method, heat CVD method, optical CVD method, and plasma CVD method. Among these layer forming methods, plasma CVD method is particularly preferable. Specifically, a method is preferable in which a raw material gas is decomposed by means of a high frequency wave or microwave glow discharge, and a photosensitive layer composed of a-Si is formed on a support with the use of the decomposed gas.

The organic photoconductors (OPC) are widely used for the following reasons: (1) optical properties such as its breadth of optical absorption wavelength range, and its largeness of optical absorption amount; (2) electric properties such as high-sensitivity, and stable charge property; (3) wide selection of materials; (4) ease of production; (5) low-cost; and (6) non-toxicity. Layer structures of such organic photoconductors are broadly classified into single-structure and laminate structure.

A single-layer photoconductor is provided with a support, and a single-layer photosensitive layer on the support, and further provided with a protective layer, an intermediate layer and other layers.

The photoconductor of the laminate structure is provided with a support and a laminated photosensitive layer, on the support, which has at least a charge generating layer, and a charge transporting layer in this order, and is further provided with a protective layer, an intermediate layer, and other layers in accordance with the necessity.

<Charging Step and Charging Unit>

The charging step is a step of charging a surface of a latent electrostatic image bearing member, and is carried out by means of the charging unit.

The charging unit is not particularly limited as long as being capable of applying a voltage to the surface of the latent electrostatic image bearing member to charge the surface, and it may be suitably selected in accordance with the intended use. Charging units are broadly classified into the following two types: (1) contact type charging units each configured to charge a surface of a latent electrostatic image bearing member in a contact manner; and (2) non-contact type charging units each configured to charge a surface of a latent electrostatic image bearing member in a non-contact manner.

-Contact Type Charging Unit-

For the contact type charging unit (1), for example, conductive or semiconductive charge rollers, magnetic brushes, fur brushes, films, and rubber blades. Of these, the charge roller allows for drastically reducing the amount of ozone generation as compared with corona discharge type devices, is excellent in stability in repetitive use of the latent electrostatic image bearing member, and is effective in preventing image degradation.

The magnetic brush is composed of a nonmagnetic conductive sleeve supporting various types of ferrite particle such as Zn—Cu ferrite particle, and a magnet roll incorporated in the nonmagnetic conductive sleeve. When a fur brush is used as a charging unit, a material of the fur brush is, for example, a fur that becomes conductive by treatment with, for example, carbon, copper sulfide, a metal or a metal oxide, and the fur is coiled or mounted to a metal or another metal core rod which becomes conductive by treatment.

FIG. 1 is a cross-sectional view schematically showing one example of a charge roller. A charge roller 310 has a metal core rod 312 formed in a cylindrical shape as a conductive support, a resistance controlling layer 313 formed on the outer circumferential surface of the metal core rod 312, and a protective layer 314 which coats the surface of the resistance controlling layer 313 to prevent leakage.

The resistance controlling layer 313 is formed by extrusion molding or injection molding a thermoplastic resin composition containing at least a thermoplastic resin and a polymer ion conductive agent on the circumferential surface of the metal core rod 312.

The volume specific resistance value of the resistance controlling layer 313 is preferably $10^6$ Ω·cm to $10^9$ Ω·cm. When the volume specific resistance value is higher than $10^9$ Ω·cm, the charged amount is insufficient, and it may be difficult for the photoconductor drum to have enough charge potential to obtain images with no nonuniformity of tones and colors. When the volume specific resistance value is lower than $10^6$ Ω·cm, it may possibly cause a leakage to the entire photoconductor drum.

A thermoplastic resin used for the resistance controlling layer 313 is not particularly limited and may be suitably selected in accordance with the intended use. Examples thereof include polyethylene (PE), polypropylene (PP), polymethyl methacrylate (PMMA), polystyrene (PS) or copolymers of polystyrene (AS, ABS, etc.).

For the polymer ion conductive agent, a polymer ion conductive agent is used which has a resistance value of about $10^6$ Ω·cm to $10^{10}$ Ω·cm as a single substance and is capable of easily lowering the resistance of resin. As an example of the polymer ion conductive agent, a compound containing a polyether ester amide component is exemplified. To adjust the resistance value of the resistance controlling layer 313 within the range, the amount of the polymer ion conductive agent blended to 100 parts by mass of the thermoplastic resin is preferably 30 parts by mass to 70 parts by mass.

Further, as the polymer ion conductive agent, a quaternary ammonium salt group-containing polymer compound can also be used. For the quaternary ammonium salt group-containing polymer compound, for example, quaternary ammonium salt group-containing polyolefins are exemplified. To adjust the resistance value of the resistance controlling layer 313 within the range, the amount of the quaternary ammonium salt group-containing polymer compound blended to 100 parts by mass of the thermoplastic resin is preferably 10 parts by mass to 40 parts by mass.

The polymer ion conductive agent can be dispersed in the thermoplastic resin by means of a biaxial kneader, a kneader or the like. Since the polymer ion conductive agent is uniformly dispersed on the molecular level in the thermoplastic resin composition, the resistance controlling layer 313 has no variation in resistance value associated with a dispersion defect of conductive materials, which are generally observed in a resistance controlling layer in which a conductive pigment is dispersed. Further, because the polymer ion conductive agent is a polymer compound, it is uniformly dispersed and fixed in the thermoplastic resin composition, rarely causing bleed-out.

The protective layer 314 is formed so as to have a resistance value higher than that of the resistance controlling layer 313. It is thereby possible to avoid a leakage to defective portions of the photoconductor drum. However, when the protective layer 314 has an excessively high resistance value, the charge efficiency is reduced. Thus, the difference in resistance value between the protective layer 314 and the resistance controlling layer 313 is preferably $10^3$ Ω·cm or less.

For a material used for the protective layer 314, a resin material is preferably used in terms of its excellence in film formability. For the resin material, for example, fluorine resin, polyamide resin, polyester resin, and polyvinyl acetal resin are preferable in that they are excellent in nonadhesiveness and can prevent toner adhesion. Further, these resin materials generally have electrical insulating properties, and thus when the protective layer 314 is formed using the resin material singularly, the charge roller will have insufficient properties. To avoid the problem, various conductive agents are dispersed in the resin material to thereby control the resistance value of the protective layer 314. Further, to improve the adhesion between the protective layer 314 and the resistance controlling layer 313, a reactive curing agent such as isocyanate may be dispersed in the resin material.

The charge roller 310 is connected to a power source, and a predetermined voltage is applied to the charge roller 310. The voltage may be a direct current (DC) voltage alone, but the voltage preferably includes an alternating current (AC) voltage superimposed on a direct current (DC) voltage. By applying an AC voltage to the charge roller 310, the surface of the photoconductor drum can be uniformly charged.

Figure 2:
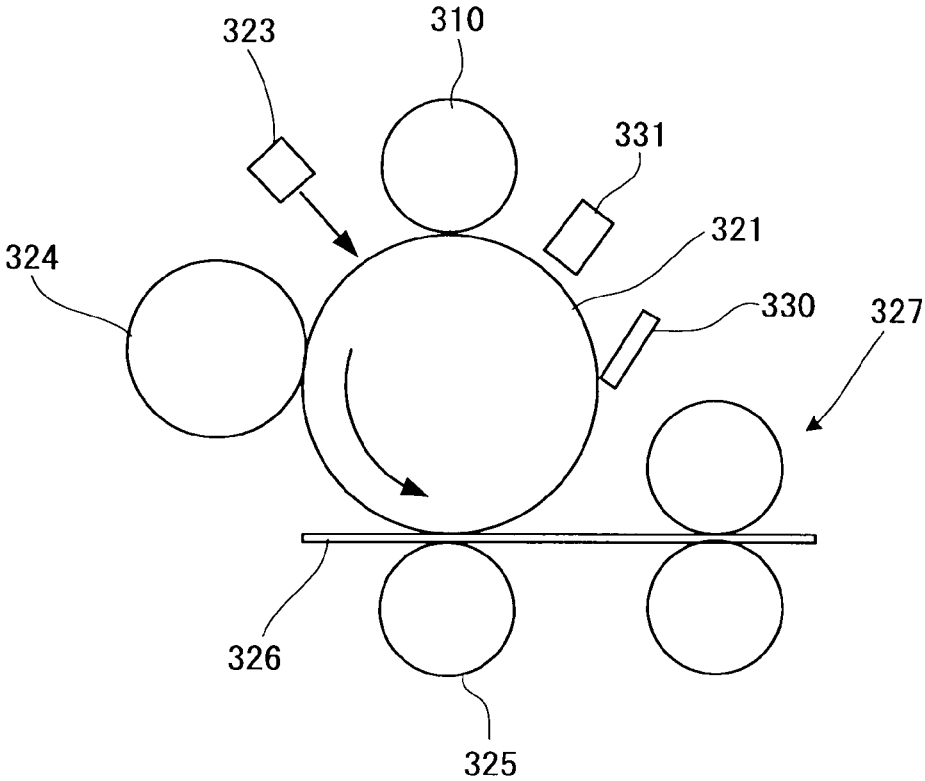
FIG. 2 is a schematic illustration exemplarily showing a case where a contact type charge roller is used in an image forming apparatus of the present invention.

FIG. 2 is a schematic view showing one example in which a contact type charge roller 310 as illustrated in FIG. 1 is used as a charging unit in an image forming apparatus according to the present invention. In FIG. 2, around the periphery of a photoconductor drum 321 as a latent electrostatic image bearing member, there are placed in the following order: a charging unit 310 for charging the surface of the photoconductor drum 321, an exposing unit 323 for forming a latent electrostatic image on the charge processing surface, a developing unit 324 for forming a visible image by making a toner adhere on the latent electrostatic image formed on the photoconductor drum surface, a transfer unit 325 for transferring the visible image formed on the surface of the photoconductor drum 321 onto a recording medium 326, a fixing unit 327 for fixing the transferred image on the recording medium 326, a cleaning unit 330 for removing and collecting a residual toner remaining on the photoconductor drum 321, and a charge eliminating device 331 for removing a residual potential on the photoconductor drum 321. For the charging unit, the contact type charge roller 310 as illustrated in FIG. 1 is provided, and the surface of the photoconductor drum 321 is uniformly charged by the charge roller 310.

-Non-contact Type Charging Unit-

For the non-contact type charging unit (2), for example, a non-contact charger utilizing a corona discharge, a needle electrode device, and a solid discharging device; a conductive or semiconductive charge roller provided with a minute gap with a latent electrostatic image bearing member are exemplified.

The corona discharge method is a non-contact charging method which gives positive or negative ions generated by corona discharge in an air to the surface of a latent electrostatic image bearing member, and there are the following types of corona discharging devices: a corotron charger having properties capable of giving a fixed charge amount to a latent electrostatic image bearing member, and a scorotron charger having properties capable of giving a fixed potential to a latent electrostatic image bearing member. The corotron charger is composed of a casing electrode which occupies a half space around a discharge wire and the discharge wire placed nearly the center thereof.

The scorotron charger has a structure similarly to the corotron charger, except that it further has a grid electrode, and the grid electrode is arranged at the position which is 1.0 mm to 2.0 mm away from the surface of a latent electrostatic image bearing member.

Figure 3:
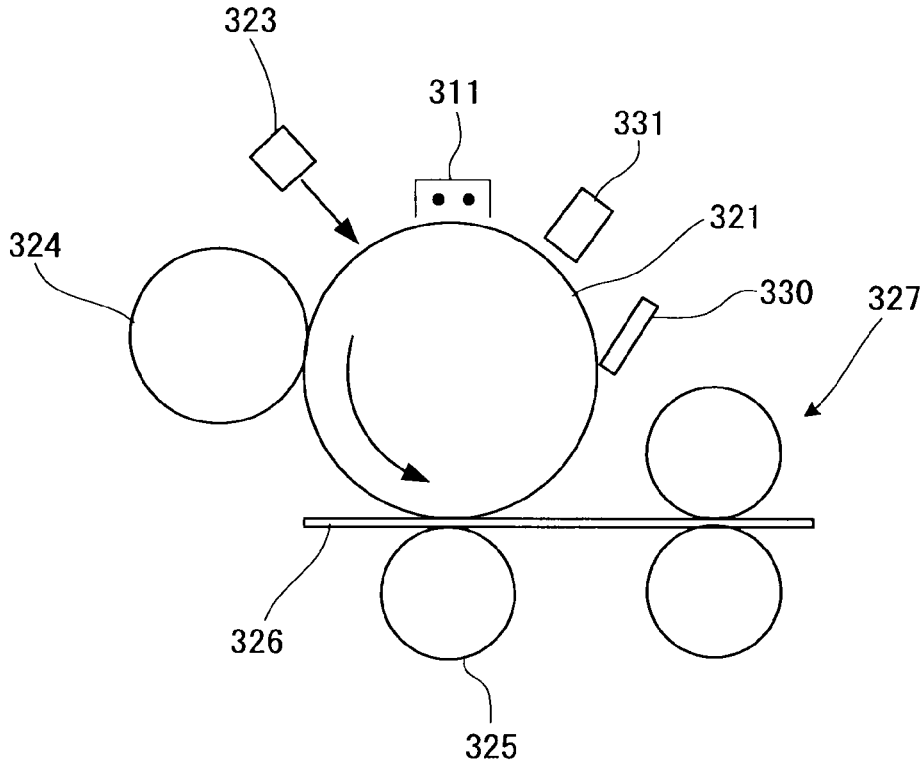
FIG. 3 is a schematic illustration exemplarily showing a case where a non-contact type corona charger is used in an image forming apparatus of the present invention.

FIG. 3 is a schematic view showing one example in which a non-contact type corona charger is used as a non-contact type corona charger in an image forming apparatus according to the present invention. In FIG. 3, the same parts as used in FIG. 2 are given the same reference numerals.

As the charging unit, a non-contact type corona charger 311 is provided, and the surface of a photoconductor drum 321 is uniformly charged by the corona charger 311.

As for a charge roller provided with keeping a minute gap with respect to the latent electrostatic image bearing member, the charge roller is improved so as to keep a minute gap with respect to the latent electrostatic image bearing member. The minute gap is preferably from 10 μm to 200 μm, and more preferably from 10 μm to 100 μm.

Figure 4:
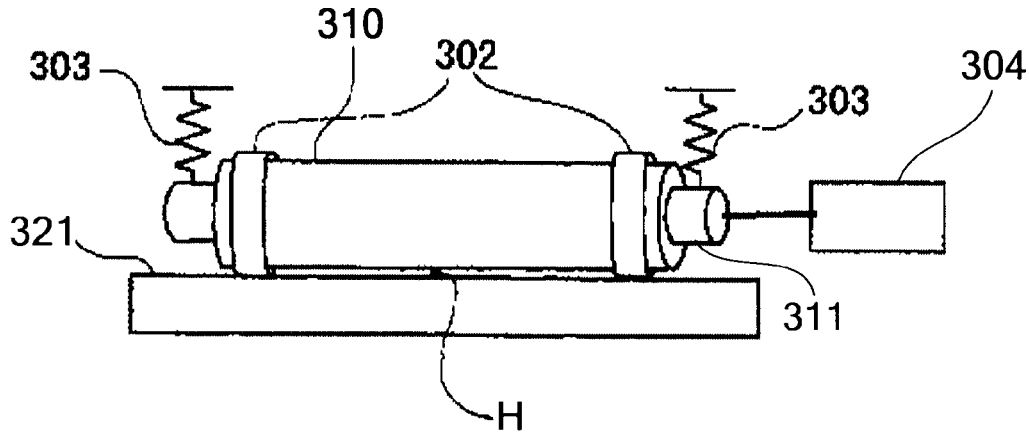
FIG. 4 is a schematic illustration showing one example of a non-contact type charge roller in an image forming apparatus of the present invention.

FIG. 4 is a schematic view showing one example of a non-contact type charge roller. In FIG. 4, a charge roller 310 is provided while keeping a minute gap H with respect to a photoconductor drum 321. The minute gap H can be set by winding a spacer member having a fixed thickness at the non-imaged area of both ends of the charge roller 310, thereby allowing the surface of the spacer member to contact with the surface of the photoconductor drum 321. In FIG. 4, the reference numeral 304 denotes a power source.

In FIG. 4, to keep the minute gap H, a film 302 is wound at both ends of the charge roller 310 to form a spacer member. This spacer 302 is brought into contact with the photoconductive surface of the latent electrostatic image bearing member to obtain a fixed minute gap H in the image area between the charge roller and the latent electrostatic image bearing member. Also, as an applied bias, an AC superposition type voltage is applied, and the latent electrostatic image bearing member is charged by discharge generated at the minute gap H between the charge roller and the latent electrostatic image bearing member. As illustrated in FIG. 4, maintaining accuracy of the minute gap H is improved by pressurizing an axis 311 of the charge roller 310 using a spring 303.

The spacer member and the charge roller may be integrally formed into a single unit. At this time, at least the surface of a gap section is made of an insulating material. Consequently, discharge at the gap section is eliminated and a discharge product is accumulated at the gap section, and thus it is possible to prevent the toner from adhering onto the gap section because of tackiness of the discharge product, resulting in a widen gap.

As the spacer member, a thermal contraction tube may be used. For the thermal contraction tube, for example, SUMITUBE for 105° C. (trade name: F105, manufactured by Sumitomo Chemical Co., Ltd) is exemplified.

<Exposing Step and Exposing Unit>

The exposing step is a step of exposing the charged surface of the latent electrostatic image bearing member and is carried out by means of the exposing unit.

The exposing may be carried out, for example, by imagewise exposing the surface of the latent electrostatic image bearing member using the exposing unit.

The optical systems used for the exposure may be broadly classified into analogue optical systems and digital optical systems. The analogue optical systems are those projecting directly an original image onto the surface of a photoconductor, and the digital optical systems are those where image information is input as electric signals, the electric signals are then converted into optical signals and the photoconductor is exposed to form an image.

The exposing unit is not particularly limited and may be suitably selected in accordance with the intended use as long as being capable of imagewise exposing the surface of a photoconductor that has been charged by a charging unit. Examples of the exposing unit include various exposure systems such as optical reproducing systems, rod-lens-eye systems, optical laser systems, optical liquid crystal shutter systems, and LED optical systems.

In the present invention, a backlight system may be employed for the exposure, in which the latent electrostatic image bearing member is imagewise-exposed from the back side thereof.

<Developing Step and Developing Unit>

The developing step is a step of developing the latent electrostatic image using the toner or developer of the present invention to form a visible image.

The visible image can be formed, for example, by developing the latent electrostatic image using the toner or the developer by means of the developing unit.

The developing unit is not particularly limited and may be suitably selected from among conventional developing devices as long as being capable of developing a latent electrostatic image using, for example, a toner or developer. For example, a developing system is preferably exemplified which has at least a developing unit capable of housing the toner or the developer and supplying the toner or the developer to a latent electrostatic image.

For the toner, any of the above-mentioned toners according to the first embodiment to the third embodiment can be used.

The developing unit may employ a dry developing process or may employ a wet developing process. Further, the developing unit may be a monochrome developing unit or may be a multi-color developing unit. Preferably, a developing unit is exemplified which has a stirrer that can frictionally stir the toner or the developer so as to be charged and a rotatable magnet roller.

In the developing unit, for example, the toner and the carrier are mixed and agitated, which causes a friction to charge the toner and maintains the charged toner in a state of being held vertically on the surface of the rotating magnet roller to form a magnetic brush thereon. The magnet roller is set near the latent electrostatic image bearing member, therefore, a part of the toner constituting the magnetic brush formed on the surface of the magnetic roller transfers to the surface of the latent electrostatic image bearing member by electrical attraction. As a result, the latent electrostatic image is developed using the toner, and a visible image formed of the toner is then formed on the surface of the latent electrostatic image bearing member.

The developer housed in the developing unit contains the toner of the present invention, and it may be a one-component developer or may be a two-component developer.

[One Component Developing Unit]

As the one-component developing unit, for example, a one-component developing device is preferably used, which has a developer bearing member and a layer thickness controlling member that forms a toner-thin layer on the surface of the developer bearing member.

Figure 5:
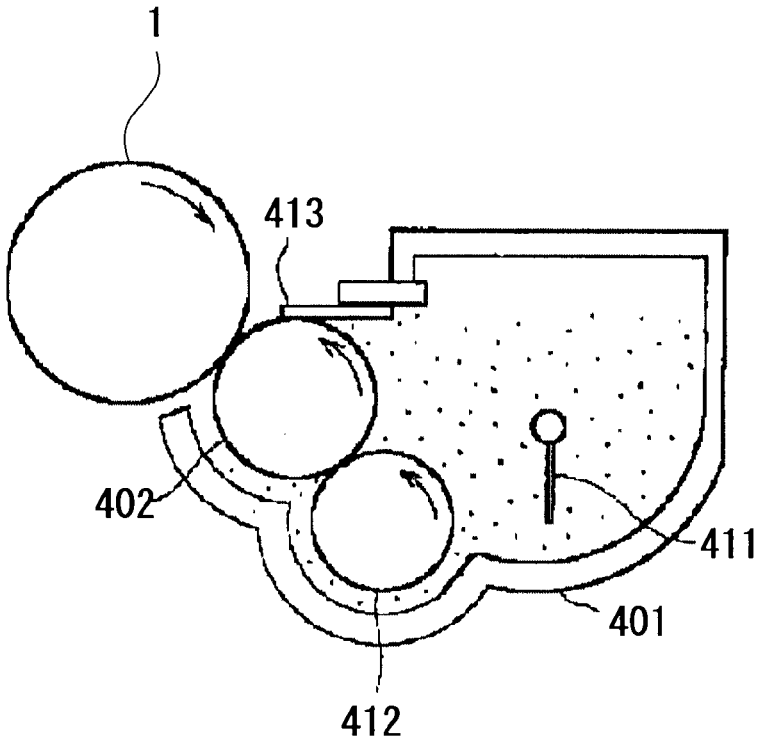
FIG. 5 is a schematic illustration showing one example of a one-component developing unit in an image forming apparatus of the present invention.

FIG. 5 is a schematic view showing one example of a one-component developing unit. This one-component developing unit is configured to develop a latent electrostatic image formed on the surface of a photoconductor drum 1 using a one-component developer composed of a toner and to transport a toner layer onto the surface of a developing roller 402 so as to be in contact with the photoconductor drum 1 that serves as a latent electrostatic image bearing member, thereby forming the toner layer on the surface of the developing roller 402, which is called a contact one-component developing process.

In FIG. 5, the toner housed in a casing 401 is agitated by rotation of an agitator 411 serving as an agitating unit to be mechanically supplied to a supplying roller 412 serving as a toner supplying member. The supplying roller 412 is formed of foamed polyurethane, etc., has flexibility and is structured to easily hold the toner in a cell having a diameter of 50 μm to 500 μm. The JIS-A hardness of a supplying roller is relatively low of 10° to 30° and thus the supplying roller can be uniformly abutted against the surface of the developing roller 402.

The supplying roller 412 is driven to rotate in the same direction as the rotational direction of the developing roller 402, i.e. such that at the opposed area to the developing roller 402, the surface of the supplying roller 412 moves in the reverse direction to the rotational direction of the developing roller 402. The linear velocity ratio (supplying roller/developing roller) between both rollers is preferably 0.5 to 1.5. The supplying roller 412 may be driven to rotate in the reverse direction to the rotational direction of the developing roller 402, i.e. such that at the opposed area to the developing roller 402, the surface of the supplying roller 412 moves in the same direction to the rotational direction of the developing roller 402. In this embodiment, the supplying roller 412 is driven to rotate in the same direction as the rotational direction of the developing roller 402, and the linear velocity ratio is set to 0.9. The penetration amount of the supplying roller 412 to the developing roller 402 is set to 0.5 mm to 1.5 mm. In this embodiment, when a unit effective width is 240 mm (A4 size, vertical width), the required torque is 14.7 N·cm to 24.5 N·cm.

The developing roller 402 has a surface layer composed of a rubber material on a conductive substrate and has a diameter of 10 mm to 30 mm, the surface of which is coarsely formed so as to have a surface roughness Rz of 1 μm to 4 μm. The surface roughness Rz to the average particle diameter of the toner is preferably 13% to 80%. Thereby, the toner can be conveyed without being buried in the surface of the developing roller 402. Especially, the surface roughness Rz of the developing roller 402 is preferably in a range from 20% to 30% of the average particle diameter of the toner.

Examples of the rubber material include silicone rubbers, butadiene rubbers, NBR rubbers, hydrin rubbers, and EPDM rubbers. It is preferred that the surface of the developing roller 402 be coated with a coat layer to particularly stabilize the stability with time. For a material used for the coat layer, silicone materials and TEFLON (registered) materials are exemplified. The silicone materials are excellent in charging properties of toner, and the TEFLON (registered) materials are excellent in releasing property. To obtain conductivity, a conductive material such as carbon black may be contained in the coat layer in an appropriate amount. The thickness of the coat layer is preferably 5 μm to 50 μm. When the thickness is out of the range, it may be liable to cause a problem that the coat layer is susceptible to fracture.

A toner having a predetermined polarity (in this embodiment, the toner has a negative polarity) that resides on or inside the supplying roller 412 is caught at the contact point between the supplying roller 412 and the developing roller 402 rotating in the reverse direction to the rotational direction of the supplying roller 412 to obtain a negative electrical charge by friction charge effect, the toner thereby being held on the developing roller 402 by the generated electrostatic force and by conveying effect due to the surface roughness of the developing roller. However, the toner layer formed on the surface of the developing roller 402 at that time has not a uniform thickness and adheres thereon in an excessive amount (1 mg/cm$^2$ to 3 mg/ cm$^2$). Then, by abutting a controlling blade 413 as a layer thickness controlling member against the surface of the developing roller 402, a toner-thin layer having a uniform thickness is formed on the surface of the developing roller 402. The tip of the controlling blade 413 faces downstream in the rotational direction of the developing roller 402, and the center portion of the controlling blade 413 is abutted against the surface of the developing roller 402, which is so-called a "belly contact". However, the controlling blade 413 may be set in the reverse direction, and an edge abutment can also be employed.

The material used for the controlling blade 413 is preferably a metal such as SUS304, and the thickness thereof is 0.1 mm to 0.15 mm. Besides metals, a rubber material such as polyurethane having a thickness of 1 mm to 2 mm and a resin material having a relatively high hardness such as silicone resin can be used. Because the controlling blade 413 can be made to have a low resistance by mixing carbon black or the like, instead of using a metal, a bias power source is connected to the controlling blade 413, thereby an electric field can be formed between the controlling blade 413 and the developing roller 402.

The controlling blade 413 serving as a layer thickness controlling member preferably has a free end length from the holder of 10 mm to 15 mm. When the free end length is longer than 15 mm, the size of the developing roller becomes large, and the developing rolled cannot be housed in a compact image forming apparatus, and when shorter than 10 mm, it may easily cause vibrations when the controlling blade 413 is brought into contact with the surface of the developing roller 402, and abnormal images such as lateral-gradual image non-uniformity may easily occur on images.

The abutment pressure of the controlling blade 413 is preferably in the rage of 0.049 N/cm to 2.45 N/cm. When the abutment pressure is higher than 2.45 N/cm, the adhesion amount of the toner on the surface of the developing roller 402 is reduced and the charged amount of the toner is excessively increased. Therefore, image density may be lowered due to the reduced developed amount of toner. When the abutment pressure is lower than 0.049 N/cm, an agglomerate of toner may pass by the controlling blade without uniformly forming a thin layer, and the image quality may significantly degrade. In this embodiment, for the developing roller 402, the one having a JIS-A hardness of 300° was used, for the controlling blade 413, an SUS plate of 0.1 mm in thickness was used, and the abutment pressure therebetween was set to 60 gf/cm. By this setting, a targeted adhesion amount of toner could be obtained on the developing roller.

The contact angle of the controlling blade 413 serving as a layer thickness controlling member to the tangent line of the developing roller 402 in a direction that the tip faces the downstream of the developing roller 402 is preferably 10° to 45°. The unnecessary portion for forming a toner-thin layer interposed between the controlling blade 413 and developing roller 402 is separated from the developing roller 402 and a thin layer is formed with a uniform thickness of intended 0.4 mg/cm$^2$ to 0 8 mg/cm$^2$. At this stage, the toner charge is finally −10 μC/g to −30 μC/g, then the toner is used for developing a latent electrostatic image on the photoconductor drum 1.

In accordance with the one-component developing device in this embodiment, the distance between the surface of the photoconductor drum 1 and the surface of the developing roller 402 is narrower than those of conventional two-component developing units, thereby increasing the developing ability and making possible to develop with lower voltages.

[Two-component Developing Unit]

The two-component developing unit preferably has a magnetic field-generating unit fixed therein and a rotatable developer bearing member that carries on its surface a two-component developer composed of a magnetic carrier and toner.

Figure 6:
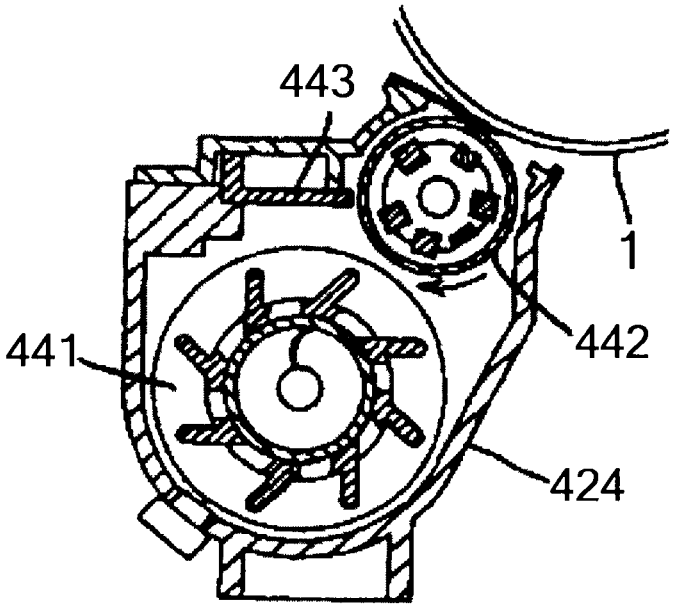
FIG. 6 is a schematic illustration showing one example of a two-component developing unit in an image forming apparatus of the present invention.

FIG. 6 is a schematic view showing one example of a two-component developing unit that uses a two-component developer composed of a magnetic carrier and a toner. In this two-component developing unit of FIG. 6, a developer is stirred and transported by a screw 441 and sent to a developing sleeve 442. The two-component developer sent to the developing sleeve 442 is regulated by a doctor blade 443 serving as a layer thickness controlling member, and the supplied amount of the developer is controlled by a doctor gap, which is a space between the doctor blade 443 and the developing sleeve 442. When the doctor gap is too small, the amount of developer is insufficient, leading to insufficient image density, and when the doctor gap is too large, the developer is excessively supplied in amount, causing a problem of carrier attachment on the photoconductor drum 1. Therefore, the developing sleeve 442 is equipped therein with a magnet that forms a magnetic field so as to hold the developer vertically on the peripheral surface, and the developer is held vertically in a form of chains on the developing sleeve 442 along the magnetic field lines that are radiated from the magnet in the normal line direction, forming a magnetic brush.

The developing sleeve 442 and the photoconductor drum 1 are arranged so as to be adjacent to each other with a certain space (development gap) therebetween and a developing region is formed where the developing sleeve 442 and the photoconductor drum 1 are facing each other. The developing sleeve 442 is made of non-magnetic substance such as aluminum, brass, stainless steel, and conductive resin in a form of cylinder, and it is rotated by a rotary drive mechanism (not depicted). The magnetic brush is transported to the developing region by the rotation of the developing sleeve 442. A developing voltage is applied to the developing sleeve 442 by means of a power source for development (not depicted), the toner on the magnetic brush is separated from the carrier by means of development field formed between the developing sleeve 442 and the photoconductor drum 1, and is developed on the latent electrostatic image on the photoconductor drum 1. It is also possible for the developing voltage to be overlapped with alternating current.

The development gap can be set to approximately 5 times to 30 times as much as the particle diameter of the developer, and when the particle diameter of the developer is 50 μm, the development gap can be set to 0.5 mm to 1.5 mm. When the development gap is wider than the above, it is difficult to obtain desired image density.

It is also preferable that the doctor gap be approximately equivalent or somewhat larger than the development gap. The drum diameter or drum linear velocity of the photoconductor drum 1 and the sleeve diameter or sleeve linear velocity of the developing sleeve 442 are determined depending on the copying speed or size of the apparatus, etc. The ratio of the sleeve linear velocity to the drum linear velocity is preferably 1.1 or more for obtaining required image density. It is also possible to install a sensor in a position after being developed and control the process condition by detecting the amount of toner adhesion amount from optical reflectance.

<Transferring Step and Transfer Unit>

The transferring step is a step of transferring the visible image onto a recording medium and is carried out by means of a transfer unit. The transfer units are broadly classified into transfer units where a visible image on a latent electrostatic image bearing member is directly transferred onto a recording medium, and secondary transfer units where a visible image is primarily transferred onto an intermediate transfer member and then the visible image is secondarily transferred onto the recording medium.

The visible-image transfer may be carried out, for example, by charging the photoconductor using a transferring charger, which may be performed by the transfer unit. In a preferable aspect, the transfer unit has a primary transfer unit that transfers the visible image to the intermediate transfer member to form a composite transfer image, and a secondary transfer unit that transfers the composite transfer image to the recording medium.

-Intermediate Transfer Member-

The intermediate transfer member is not particularly limited and may be suitably selected from among conventional transfer members in accordance with the intended use. Preferred examples thereof include transfer belts and transfer rollers.

The stationary friction coefficient of the intermediate transfer member is preferably 0.1 to 0.6, and more preferably 0.3 to 0.5. The volume resistance of intermediate transfer member is preferably more than several Ω·cm and less than $10^3$ Ω·cm. The volume resistance within the range of several Ω·cm to $10^3$ Ω·cm may prevent charging of the intermediate transfer member itself, and the charge from the charging unit is unlikely to remain on the intermediate transfer member, therefore, transfer nonuniformity at the secondary transferring may be prevented and the application of transfer bias at the secondary transferring becomes relatively easy.

Materials used for the intermediate transfer member is not particularly limited and may be suitably selected from conventional ones in accordance with the intended use. Examples of the material are as follows: (1) materials with high Young's modulus (tension elasticity) used as a single layer belt such as polycarbonates (PC), polyvinylidene fluoride (PVDF), polyalkylene terephthalate (PAT), blend materials of PC/PAT, blend materials of ethylene tetrafluoroethylene copolymer (ETFE) and PC, blend materials of ETFE and PAT, blend materials of PC and PAT, and thermosetting polyimides of carbon black dispersion. These single layer belts having high Young's modulus are small in their deformation against stress during image formation and are particularly advantageous in that registration error is less likely to occur during color image formation; (2) a double or triple layer belt using the belt having high Young's modulus as a base layer is available, where being added with a surface layer and an optional intermediate layer around the peripheral side of the base layer. The double or triple layer belt has a capability of preventing drop-out in a lined image that is caused by hardness of the single layer belt; and (3) an elastic belt with relatively low Young's modulus is available that incorporates a rubber or an elastomer. This belt is advantageous in that there is almost no print defect of unclear center portion in a line image due to its softness. Additionally, by making width of the belt wider than drive roller or tension roller and thereby using the elasticity of edge portions that extend over the rollers, it can prevent meandering of the belt. It is also cost effective for not requiring ribs or units to prevent meandering. Of these, the elastic belt (3) is preferable in particular.

The elastic belt deforms corresponding to the surface roughness of toner layers and the recording medium having low smoothness in the transfer section. In other words, since elastic belts deform complying with local roughness and an appropriate adhesiveness can be obtained without excessively increasing the transfer pressure against toner layers, it is possible to obtain transfer images having excellent uniformity with no void in characters even on a recording medium of low smoothness.

The resin used for the elastic belt is not particularly limited and may be suitably selected in accordance with the intended use. Examples thereof include polycarbonate resins, fluorine resins (such as ETFE and PVDF); polystyrene resins, chloropolystyrene resins, poly-a-methylstyrene resins; styrene resins (monopolymers or copolymers containing styrene or styrene substituents) such as styrene-butadiene copolymers, styrene-vinyl chloride copolymers, styrene-vinyl acetate copolymers, styrene-maleic acid copolymers, styrene-acrylate copolymers (such as styrene-methyl acrylate copolymers, styrene-ethyl acrylate copolymers, styrene-butyl acrylate copolymers, styrene-octyl acrylate copolymers, and styrene-phenyl acrylate copolymers), styrene-methacrylate copolymers (such as styrene-methyl methacrylate copolymers, styrene-ethyl methacrylate copolymers and styrene-phenyl methacrylate copolymers); styrene-α-chloromethyl acrylate copolymers, styrene-acrylonitrile acrylate copolymers, methyl methacrylate resins, and butyl methacrylate resins; ethyl acrylate resins, butyl acrylate resins, modified acrylic resins (such as silicone-modified acrylic resins, vinyl chloride resin-modified acrylic resins and acrylic urethane resins); vinyl chloride resins, styrene-vinyl acetate copolymers, vinyl chloride-vinyl acetate copolymers, rosin-modified maleic acid resins, phenol resins, epoxy resins, polyester resins, polyester polyurethane resins, polyethylene resins, polypropylene resins, polybutadiene resins, polyvinylidene chloride resins, ionomer resins, polyurethane resins, silicone resins, ketone resins, ethylene-ethylacrylate copolymers, xylene resins, polyvinylbutylal resins, polyamide resins and modified polyphenylene oxide resins. These resins may be used alone or in combination with two or more.

The rubber used for the elastic belt is not particularly limited and may be suitably selected in accordance with the intended use. Examples thereof include natural rubber, butyl rubber, fluorine-based rubber, acryl rubber, EPDM rubber, NBR rubber, acrylonitrile-butadiene-styrene rubber, isoprene rubber, styrene-butadiene rubber, butadiene rubber, ethylene-propylene rubber, ethylene-propylene terpolymers, chloroprene rubber, chlorosulfonated polyethylene, chlorinated polyethylene, urethane rubber, syndiotactic 1,2-polybutadiene, epichlorohydrin-based rubber, silicone rubber, fluorine rubber, polysulfide rubber, polynorbornene rubber, and hydrogenated nitrile rubber. These rubbers may be used alone or in combination of two or more.

The elastomer used for the elastic is not particularly limited and may be suitably selected in accordance with the intended use. Examples thereof include polystyrene thermoplastic elastomers, polyolefin thermoplastic elastomers, polyvinyl chloride thermoplastic elastomers, polyurethane thermoplastic elastomers, polyamide thermoplastic elastomers, polyurea thermoplastic elastomers, polyester thermoplastic elastomers, and fluorocarbon thermoplastic elastomers. These elastomers may be used alone or in combination of two or more.

The conductive agent used for the elastic belt for adjusting resistance is not particularly limited and may be suitably selected in accordance with the intended use. Examples thereof include carbon black, graphite, metal powders such as aluminum and nickel; conductive metal oxides such as tin oxide, titanium oxide, antimony oxide, indium oxide, potassium titanate, antimony tin oxide (ATO), and indium tin oxide (ITO). The conductive metal oxides may be coated with insulating fine particles such as barium sulfate, magnesium silicate, and calcium carbonate.

The material used for the surface layer is required to prevent contamination of the photoconductor due to elastic material as well as to reduce the surface frictional resistance of the transfer belt so that toner adhesion is lessened while improving the cleaning ability and the secondary transfer property. The surface layer preferably contains a binder resin such as polyurethane resin, polyester resin, and epoxy resin and materials that reduce surface energy and enhance lubrication, for example, powders or particles such as fluorine resin, fluorine compound, carbon fluoride, titanium dioxide, and silicon carbide. In addition, it is possible to use a material such as fluorine rubber that is treated with heat so that a fluorine-rich layer is formed on the surface and the surface energy is reduced.

The method to produce the elastic belt is not particularly limited and may be suitably selected in accordance with the intended use. Examples thereof include (1) centrifugal forming in which material is poured into a rotating cylindrical mold to form a belt, (2) spray coating method in which a liquid coating solution is sprayed to form a film, (3) dipping method in which a cylindrical mold is dipped into a solution of material and then pulled out, (4) injection mold method in which material is injected into inner and outer molds, (5) a method in which a compound is applied onto a cylindrical mold and the compound is vulcanized and ground.

The method to prevent the elastic belt from elongating is not particularly limited and may be suitably selected in accordance with the intended use. Examples thereof include (1) a method in which materials that prevent elongation are added to a core layer and (2) a method in which a rubber layer is formed on a core layer which is less stretchable.

The material that prevents elongation is not particularly limited and may be suitably selected in accordance with the intended use. For example, natural fibers such as cotton, and silk; synthetic fibers such as polyester fibers, nylon fibers, acrylic fibers, polyolefin fibers, polyvinyl alcohol fibers, polyvinyl chloride fibers, polyvinylidene chloride fibers, polyurethane fibers, polyacetal fibers, polyfluoroethylene fibers, and phenol fibers; inorganic fibers such as carbon fibers, glass fibers, and boron fibers;, metal fibers such as iron fibers, and copper fibers; and materials that are in a form of a weave or thread may be preferably used.

The method for forming the core layer is not particularly limited and may be suitably selected in accordance with the intended use. Examples thereof include (1) a method in which a weave that is woven in a cylindrical shape is placed on a mold or the like and a coating layer is formed on top of it, (2) a method in which a weave that is woven in a cylindrical shape is dipped in a liquid rubber or the like so that coating layer(s) are formed on one side or on both sides of the core layer and (3) a method in which a thread is twisted helically around a mold or the like with an arbitrary pitch, and then a coating layer is formed thereon.

As the coated layer comes to thicker, elongation and contraction of the surface comes to more significant and the surface layer is susceptible to cracks, causing significant elongation and contraction of images, therefore, excessive thickness such as above 1 mm is undesirable.

The transfer unit, i.e. the primary transfer unit and the secondary transfer unit, preferably has at least a transferer that is configured to charge so as to separate the visible image formed on the latent electrostatic image bearing member and transfer the visible image onto a recording medium. One transferer or two transferers may be used. Examples of the transferer include corona transferers utilizing corona discharge, transfer belts, transfer rollers, pressure-transfer rollers, and adhesion-transferers.

A typical recording medium is regular paper, and it is not particularly limited and may be suitably selected as long as being capable of receiving transferred, unfixed image after developing; and PET bases for OHP may also be used.

-Transfer Unit for Tandem Image Forming Apparatus-

The tandem image forming apparatus has at least image forming elements arranged in plural numbers including a latent electrostatic image bearing member, a charging unit, a developing unit, and a transfer unit. The tandem image forming apparatus can form full-color images at higher speeds because it has four image forming elements for yellow, magenta, cyan and black, forms each visible image in parallel by means of four image forming elements and superimposes one another on a recording medium or intermediate transfer member.

Figure 7:
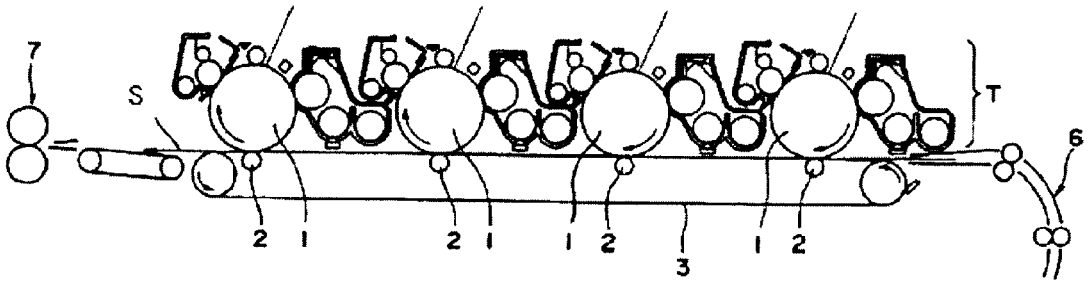
FIG. 7 is a schematic illustration showing one example of a transfer unit of direct transfer mode in a tandem image forming apparatus of the present invention.
Figure 8:
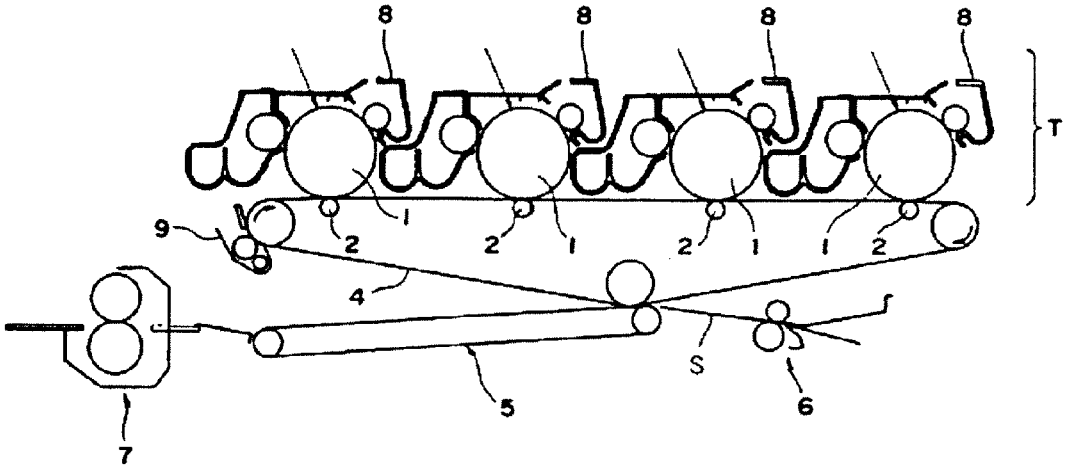
FIG. 8 is a schematic illustration showing one example of a transfer unit of indirect transfer mode in a tandem image forming apparatus of the present invention.

There are two types of tandem image forming apparatus: (1) direct transfer type and (2) indirect transfer type: in (1) direct transfer type, visible images formed on each of photoconductors 1 are transferred sequentially by a transfer unit 2 onto a recording medium S whose surface is being transported so as to pass through the transfer position, which is facing each of the photoconductors 1 constituting a plurality of image forming elements as illustrated in FIG. 7; and in (2) indirect transfer type, visible images on each photoconductor 1 of a plurality of image forming elements are temporarily transferred sequentially by a primary transfer unit 2 to the surface of an intermediate transfer member 4 and then all the images on the intermediate transfer member 4 are transferred together onto the recording medium S at a time by a secondary transfer unit 5 as illustrated in FIG. 8. Note that in FIG. 8, as a secondary transfer unit, a transfer-conveying belt is used, but it may be in a roller shape.

The direct transfer type (1), as compared to the indirect transfer type (2), has a drawback of glowing in size in a transporting direction of the recording medium because a paper feeding unit 6 must be placed on the upper side of a tandem image forming section T where the photoconductors 1 are aligned, whereas a fixing unit 7 must be placed on the lower side of the apparatus. In contrast, the indirect transfer type (2) is advantageous in that the secondary transfer site may be installed relatively freely, and the paper feeding unit 6 and the fixing unit 7 may be placed together with the tandem image forming section T, making it possible to be downsized.

To avoid size-glowing in the transporting direction of the recording medium in the direct transfer type (1), the fixing unit 7 must be placed close to the tandem image forming section T. However, it is impossible to place the fixing unit 7 in a way that gives enough space for the recording medium S to bend, and the fixing unit 7 may easily affect the image forming on the upper side by the impact generated from the leading end of the recording medium S as it approaches the fixing unit 7 (this becomes conspicuous with a thick sheet), or by the difference between the transporting speed of the recording medium when it passes through the fixing unit 7 and the transporting speed of the recording medium when it is transported by the transfer-conveying belt. In contrast, the indirect transfer type allows the fixing unit 7 to be placed in a way that gives recording medium S an enough space to bend and the fixing unit 7 has almost no effect on the image formation.

For above reasons, the indirect transfer type tandem image forming apparatus is particularly interested recently. And this type of color image forming apparatus as illustrated in FIG. 8, prepares for the next image formation by removing a residual toner remaining on the photoconductors 1 by photoconductor cleaning units 8 to clean the surface of the photoconductors 1 after the primary transfer. It also prepares for the next image formation by removing a residual toner remaining on the intermediate transfer member 4 by an intermediate transfer member cleaning unit 9 to clean the surface of the intermediate transfer member 4 after the secondary transfer.

<Fixing Step and Fixing Unit>

The fixing step is a step of fixing the transferred visible image on a recording medium using a fixing unit.

The fixing unit is not particularly limited and may be suitably selected in accordance with the intended use, however, a fixing device having fixing members and a heat source for heating the fixing member is preferably used.

The fixing members are not particularly limited and may be suitably selected in accordance with the intended use, as long as they can be in contact with each other to form a nip.

Examples of the fixing members include a combination of an endless belt and a roller, and a combination of a roller and a roller. In view of shorter warm-up period and energy saving, a combination of an endless belt and a roller or induction heating where the transferred image is heated from the surfaces of fixing members, is preferably employed.

The fixing member is exemplified by conventional heating and pressurizing units, i.e. a combination of a heating unit and a pressurizing unit. For the heating and pressurizing units, in the case of the combination of an endless belt and a roller, it is exemplified by a combination of a heating roller, a pressurizing roller, and an endless belt, and in the case of the combination of a roller and a roller, it is exemplified by a combination of a heating roller and a pressurizing roller.

In the case where the fixing member is an endless-shaped belt, preferably, the endless-shaped belt is made of materials having a small heat capacity, and includes one in which, for example, there is provided on a base an offset preventing layer. Materials forming the base include, for example, nickel and polyimide. Materials forming the offset preventing layer include, for example, silicone rubbers, and fluorine-based resins.

In the case where the fixing member is a roller, preferably, a metal core rod of this roller is made of a non-elastic member in order to prevent the deformation or deflection due to a high pressure. These non-elastic members are not particularly limited and may be suitably selected depending on the purpose. For example, the non-elastic members preferably include high thermal conductivity materials such as aluminum, iron, stainless steel, and brass. Moreover, the roller is preferably covered with an offset preventing layer at the surface thereof. Materials constituting this offset preventing layer may be suitably selected depending on the purpose without particular limitation, and preferably include, for example, RTV silicone rubber, tetrafluoroethylene-perfluoroalkyl vinylether (PFA), and polytetrafluoroethylene (PTFE).

In the fixing step, the toner image is transferred onto the recording medium, the recording medium having an image may be passed through the nip to thereby the image being fixed on the recording medium or the image may be transferred and also fixed simultaneously at the nip.

In addition, the fixing step may be carried out for each color toner at every transferring onto the recording medium or may be carried out for color toner images all together in a state where all the color toners are superimposed.

The nip is formed by contacting at least two fixing members each other.

The nip pressure may be suitably selected depending on the purpose without particular limitation; preferably, the pressure is 5 $N/cm^2$ or more, more preferably 7 $N/cm^2$ to 100 $N/cm^2$, and still more preferably 10 $N/cm^2$ to 60 $N/cm^2$. When the nip pressure is excessively high, the roller durability may degrade. In contrast, when the nip pressure is lower than 5 $N/cm^2$, it may result in insufficient anti-offset property.

The fixing temperature of the toner, i.e. the surface temperature of the fixing member heated by the heating unit, may be properly selected depending on the purpose; preferably, the temperature is 120° C. to 170° C., and more preferably 120° C. to 160° C. When the fixing temperature is lower than 120° C., it may result in insufficient fixing property, and when higher than 170° C., it is undesirable in terms of energy saving.

The fixing unit is broadly classified into (1) internal heating mode, i.e. the fixing unit is equipped with at least one of rollers and belts, the heating energy is supplied to the surface that is not in contact with toner, and the image transferred onto the recording medium is heated and pressurized to thereby fix the image, and (2) external heating mode, i.e. the fixing unit is equipped with at least one of rollers and belts, the heating energy is supplied to the surface that is in contact with toner, and the image transferred onto the recording medium is heated and pressurized to thereby fix the image. It is also possible to use a combination of them.

For the (1) fixing unit adopting the internal heating mode, for example, the fixing member itself may be equipped with a heating unit therein. Examples of the heating unit are heaters and halogen lamps.

-Fixing Unit Adopting External Heating Mode-

For the (2) fixing unit adopting the external heating mode, for example, an aspect is preferable in which at least part of one or more surfaces of the fixing members is heated by a heating unit. The heating unit is not particularly limited and may be suitably selected in accordance with the intended use. Examples thereof include electromagnetic induction-heating units.

The electromagnetic induction-heating unit is not particularly limited and may be suitably selected in accordance with the intended use. However, the electromagnetic induction-heating unit preferably has a magnetic field generating unit and a heat-generating unit that generates heat by electromagnetic induction.

The electromagnetic induction-heating unit may preferably be composed of an induction coil placed so as to be accessible to the fixing member such as a heating roller, a shielding layer on which the induction coil is formed, and an insulating layer formed on the surface opposed to the surface of the shielding layer on which the induction coil is formed. The heating roller is preferably of a magnetic material or heat pipe.

It is preferred that the induction coil be placed to surround the half-cylinder of the heating roller at the side opposite to the site where the heating roller and the fixing member are in contact with each other.

-Fixing Unit Adopting Internal Heating Mode-

Figure 9:
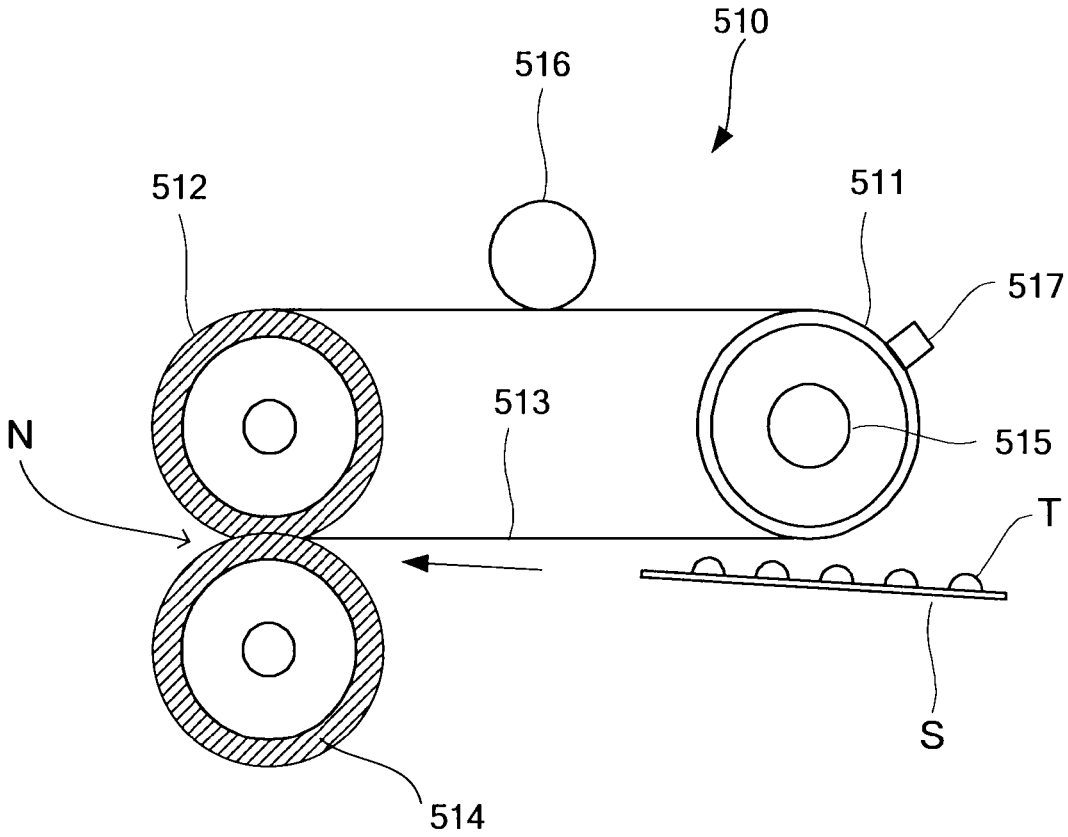
FIG. 9 is a schematic illustration showing one example of a belt type fixing unit in an image forming apparatus of the present invention.

FIG. 9 exemplarily shows a belt-type fixing unit adopting internal heating mode. A belt-type fixing unit 510 illustrated in FIG. 9 is equipped with a heating roller 511, a fixing roller 512, a fixing belt 513 and a pressurizing roller 514.

The fixing belt 513 is spanned over the heating roller 511 and the fixing roller 512 that are rotatably located inside thereof and is heated at a predetermined temperature by the heating roller 511. The heating roller 511 incorporates a heat source 515 inside thereof and is configured to be capable of controlling temperature by a temperature sensor 517 mounted near. The fixing roller 512 is rotatably located inside the fixing belt 513 while being in contact with the inner surface of the fixing belt 513. The pressurizing roller 514 is rotatably located outside of the fixing belt 513 while being in contact with the outer surface of the fixing belt 513 so as to press-contact with the fixing roller 512. The surface hardness of the fixing belt 513 is lower than that of the pressurizing roller 514, and at a nip N formed between the fixing roller 512 and the pressurizing roller 514, the middle region between the introduction end and the ejection end of a recording medium S is situated near the fixing roller 512 than the introduction end and the ejection end of the recording medium S.

In the belt-type fixing unit 510 illustrated in FIG. 9, first, the recording medium S formed thereon with a toner image T to be fixed is transported to the heating roller 511, the toner image T formed on the recording medium S is heated to be a molten state by the heating roller 511 and the fixing belt 513 that have been heated to a predetermined temperature by the action of the activated heat source 515 incorporated into the heating roller 511, with keeping this state, the recording medium S is inserted into the nip N formed between the fixing roller 512 and the pressurizing roller 514, the recording medium S is then contacted with the surface of the fixing belt 513 that rotates in synchronization with the rotation of the fixing roller 512 and the pressurizing roller 514 and is press-contacted when passing through the nip N, thereby the toner image T being fixed on the recording medium S.

Next, the recording medium S with the toner image fixed thereon is passed through between the fixing roller 512 and the pressurizing roller 514 and is separated from the fixing belt 513 to be transported to a tray (not depicted). At this point, the recording medium S is ejected toward the side of the pressurizing roller 514, and thus the recording medium is prevented from wrapping around the fixing belt 513 which is to be cleaned with a cleaning roller 516.

Figure 10:
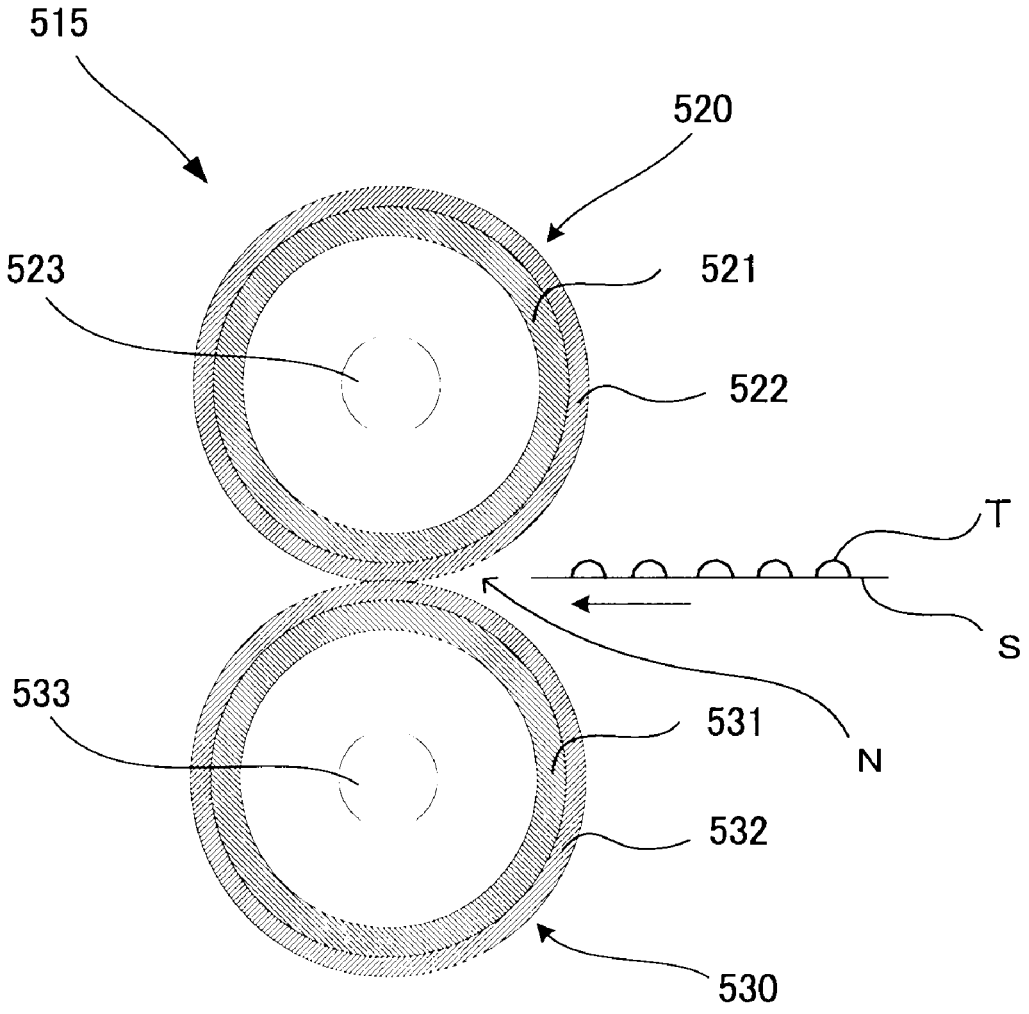
FIG. 10 is a schematic illustration showing one example of a heat roller type fixing unit in an image forming apparatus of the present invention.

A heat-roll fixing device 515 illustrated in FIG. 10 is equipped with a heating roller 520 as the above-mentioned fixing member, and a pressurizing roller 530 placed so as to be in contact with the heating roller 520.

The heating roller 520 is formed in a hollow metal cylinder 521, the surface of which is coated with an offset-preventing layer 522, and the inside of which a heat lamp 523 is provided. The pressurizing roller 530 is formed in a metal cylinder 531, the surface of which is coated with an offset-preventing layer 532. In the pressurizing roller 530, the metal cylinder 531 may be formed in a hollow shape, and a heat lamp 533 may be provided inside thereof.

The heating roller 520 and the pressurizing roller 530 are biased by a spring (not depicted) so as to be rotatably provided in a state of being in contact with each other, thereby forming a nip N. The surface hardness of the offset-preventing layer 522 in the heating roller 520 is lower than that of the offset-preventing layer 532 in the pressurizing roll 530, and at a nip N formed between the heating roller 520 and the pressurizing roller 530, the middle region between the introduction end and the ejection end of a recording medium S is situated near the heating roller 520 than the introduction end and the ejection end of the recording medium S.

In the heat-roll fixing device 515 illustrated in FIG. 10, first, the recording medium S formed thereon with a toner image T to be fixed is transported to the nip N formed between the heating roller 520 and the pressurizing roller 530, the toner image T formed on the recording medium S is heated to be a molten state by the heating roller 520 that has been heated to a predetermined temperature by the action of the activated heat lamp 523 incorporated into the heating roller 520, and simultaneously, the recording medium S is press-contacted by the pressing force of the pressurizing roller 530, thereby the toner image T being fixed on the recording medium S.

Next, the recording medium S with the toner image fixed thereon is passed through between the fixing roller 520 and the pressurizing roller 530 and transported to a tray (not depicted). At this point, the recording medium S is ejected toward the side of the pressurizing roller 530, and thus the recording medium S is prevented from wrapping around the heating roller 520 which is to be cleaned with a cleaning roller (not depicted).

-Fixing Unit Adopting External Heating Mode-

Figure 11:
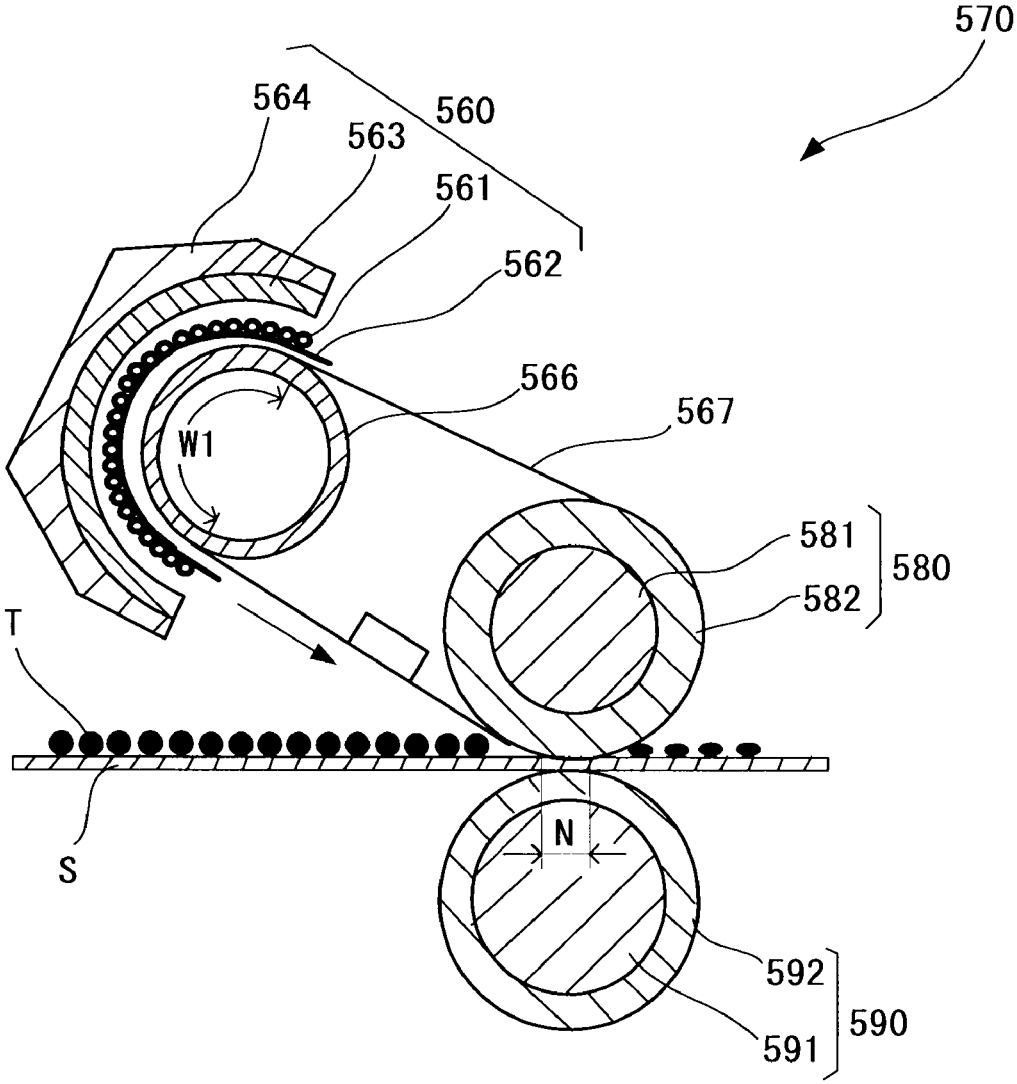
FIG. 11 is a schematic illustration showing one example of an electromagnetic induction heating type fixing unit in an image forming apparatus of the present invention.

FIG. 11 shows an electromagnetic induction heating type fixing device 570 as an example of the fixing unit adopting external heating mode. This electromagnetic induction heating type fixing device 570 is equipped with a heating roller 566, a fixing roller 580, a fixing belt 567, a pressurizing roller 590, and an electromagnetic induction heating unit 560.

The fixing belt 567 is spanned over the heating roller 566 and the fixing roller 580 that are rotatably located inside thereof and is heated at a predetermined temperature by the heating roller 566.

The heating roller 566 has a hollow cylinder-shaped magnetic metal member composed, for example, of iron, cobalt, nickel or an alloy thereof, is formed, for example, so as to have an external diameter of 20 mm to 40 mm and a wall thickness of 0.3 mm to 1.0 mm and is constructed so as to allow for fast temperature increase with a low heat capacity.

The fixing roller 580 has a metal core rod 581 composed of metal such as stainless steel, the surface of which is coated with an elastic layer 582 prepared by forming a silicone rubber having heat resistance into a solid or foamed state, and is rotatably located inside the fixing belt 567 while being in contact with the inner surface of the fixing belt 567. The fixing roller 580 is designed so as to have an external diameter of about 20 mm to 40 mm to be larger than that of the heating roller 566 in order to form a nip N with a predetermined width between the pressurizing roller 590 and the fixing roller 580 by the pressing forth from the pressurizing roller 590. The elastic layer 582 has a wall thickness of about 4 mm to 6 mm such that the heat capacity of the heating roller 566 is smaller than that of the fixing roller 580, allowing for shortening warm-up time of the heating roller 566.

The pressurizing roller 590 has a metal core rod 591 composed of a metal cylinder member having high thermal conductivity such as copper, and aluminum, the surface of which is coated with an elastic layer 592 having high heat resistance and high toner-releasing property, and is rotatably located outside the fixing belt 567 such that the fixing roller 580 is press-contacted to the outer surface of the fixing belt 567. Besides the above-mentioned metals, SUS may be used for the metal core rod 591.

The electromagnetic induction heating unit 560 is provided near the heating roller 566 and in the axial direction of the heating roller 566. The electromagnetic induction heating unit 560 has an exciting coil 561 serving as a magnetic field generating unit and a coil guide plate 562 around which the exciting coil 561 is wound. The coil guide plate 562 is formed in a semi-cylindrical shape and located near the outer surface of the heating roller 566, and the exciting coil 561 is formed by alternately winding a long exciting coil wire around the coil guide plate 562 in the axial direction of the heating roller 566. The exciting coil 561 is connected to a driving power source (not depicted) in which the frequency of oscillation circuit is variable. Radially outward the exciting coil 561, a semi-cylindrical exciting coil core 563 composed of a ferromagnetic material such as ferrite is provided near the exciting coil 561 with being fixed to an exciting coil core supporting member 564.

In the image-fixing device of electromagnetic induction heating type 570 illustrated in FIG. 11, once the exciting coil 561 of the electromagnetic induction heating unit 560 is electrified, an alternating magnetic field is formed around the electromagnetic-induction heating unit 560, thereby uniformly and efficiently preheating the heating roller 566, which comes adjacent to and surrounded by the exciting coil 561, by the excitation of overcurrent. A recording medium S having a toner image T to be fixed is transferred to a nip N formed between the fixing roller 580 and the pressurizing roller 590. The heating roller 566 is heated at a predetermined temperature by means of the electromagnetic induction heating unit 560. The fixing belt 567 is heated at a contact region W1 with the heating roller 566 by means of the heating roller 566. The toner image T on the recording medium S is heated to be a molten state by the fixing belt 567. In this condition, the recording medium S is inserted into the nip N formed between the fixing roller 580 and the pressurizing roller 590. The recording medium S is then contacted with the surface of the fixing belt 580 which rotates in synchronization with the rotation of the fixing roller 580 and the pressurizing roller 590, thereby the toner image T being fixed on the recording medium S.

Next, the recording medium S on which the toner image T is fixed is passed through between the fixing roller 580 and the pressurizing roller 590, separated from the fixing belt 567, and transported to a tray (not depicted). In this process, the recording medium S is ejected toward the side of the pressurizing roller 590, and thus the recording member S is prevented from wrapping around the fixing belt 567 which is to be cleaned with a cleaning roller (not depicted).

Figure 12:
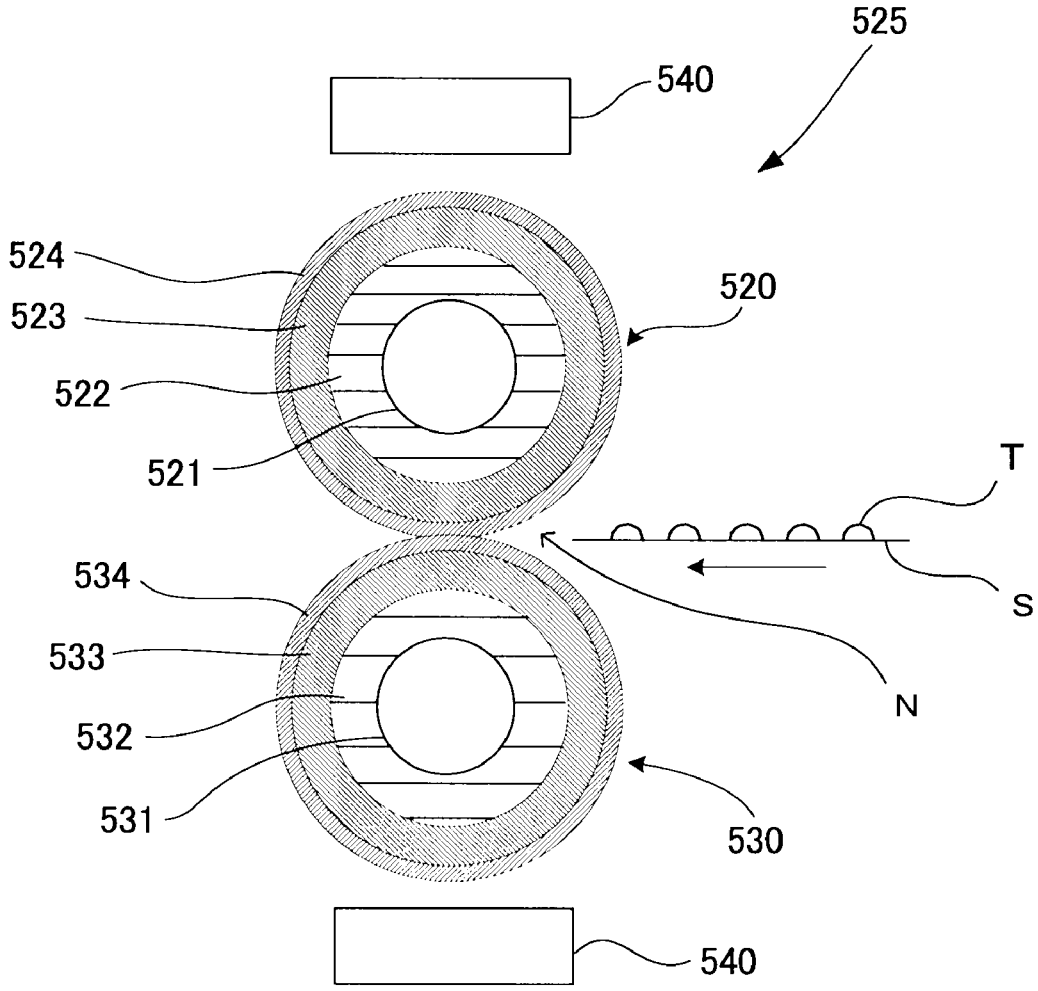
FIG. 12 is a schematic illustration showing another example of an electromagnetic induction heating type fixing unit in an image forming apparatus of the present invention.

A roll-fixing device 525 of electromagnetic type illustrated FIG. 12 is a fixing unit equipped with a fixing roller 520 as a fixing member, a pressurizing roller 530 located so as to be in contact with the fixing roller 520, and an electromagnetic induction heat source 540 for heating externally the fixing roller 520 and the pressurizing roller 530.

The fixing roller 520 has a metal core rod 521, the surface of which is coated with a heat-insulating elastic layer 522, a heat-generating layer 523, and a releasing layer 524, which are formed in this order. The pressurizing roller 530 has a metal core rod 531, the surface of which is coated with a heat-insulating elastic layer 532, a heat-generating layer 533, and a releasing layer 534 formed in this order. The releasing layers 524 and 534 are formed of tetrafluoroethylene-perfluoroalkyl vinylether (PFA).

The fixing roller 520 and the pressurizing roller 530 are biased by a spring (not depicted) so as to be rotatably provided in a state of being in contact with each other, thereby forming a nip N.

The electromagnetic induction heat sources 540 are respectively disposed near the fixing roller 520 and the pressurizing roller 530 to heat the heat generating layers 523 and 533 by electromagnetic induction.

In the fixing unit illustrated in FIG. 12, the fixing roller 520 and the pressurizing roller 530 are uniformly and efficiently preheated by the electromagnetic induction heat sources 540. Two-dimensional high pressures may be easily achieved at the nip N due to the combination of rollers.

<Cleaning Step and Cleaning Unit>

The cleaning step is a step of removing a residual toner remaining on the latent electrostatic image bearing member and is preferably carried out by a cleaning unit.

In the case where the developing unit has a developer bearing member that contacts with the surface of the photoconductor and develops a latent electrostatic image formed on the photoconductor as well as collects a residual toner remaining on the photoconductor, then the cleaning may be conducted without the cleaning unit in a cleaning-less manner.

The cleaning unit is not particularly limited and may be suitably selected from among conventional cleaners as long as being capable of removing a residual toner remaining on the latent electrostatic image bearing member. Examples thereof include magnetic brush cleaners, electrostatic brush cleaners, magnetic roller cleaners, blade cleaners, brush cleaners, and web cleaners. Of these, cleaning blades are particularly preferable in view of higher toner-removing ability, compact size, and lower cost.

Rubber material used for the cleaning rubber blade may be urethane rubber, silicone rubber, fluorinated rubber, chloroprene rubber, and butadiene rubber. Of these, urethane rubber is particularly preferable.

Figure 13:
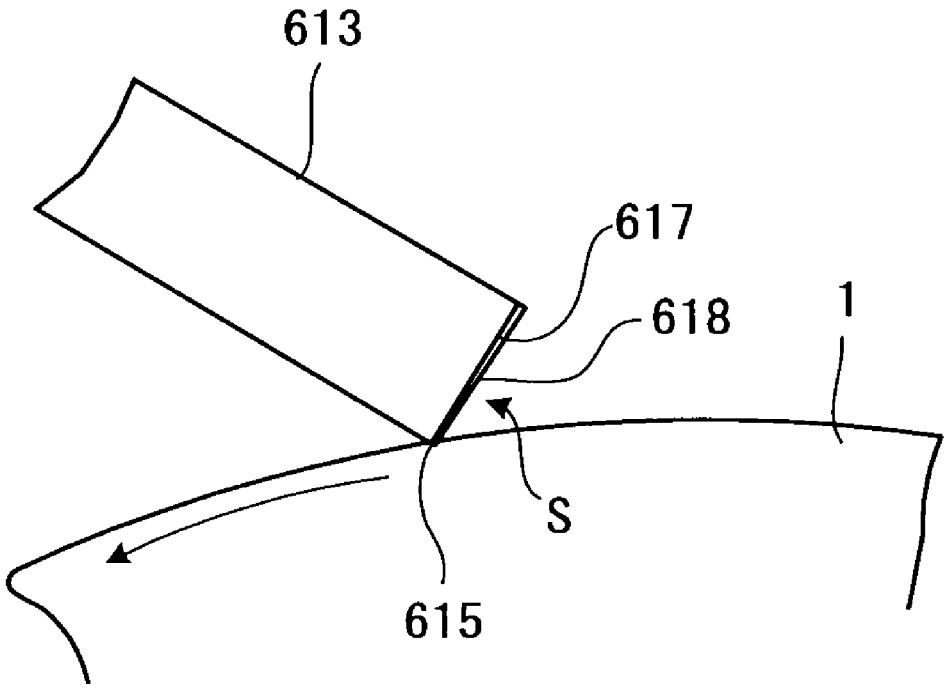
FIG. 13 is a schematic illustration showing one example of a cleaning blade in an image forming apparatus of the present invention.

FIG. 13 is an enlarged view that explains the vicinity around a contact portion 615 between a cleaning blade 613 and the photoconductor. The cleaning blade 613 has a toner-blocking surface 617 forming in relation with the surface of the photoconductor drum 1 a space S that broadens from the contact portion 615 toward the upstream of the rotational direction of the latent electrostatic image bearing member. In this embodiment, the toner-blocking surface 617 is extended from the contact portion 615 toward the upstream of the rotational direction of the photoconductor drum 1 so as to form an acute angle in the space S.

A coat portion 618 is provided at the toner-blocking surface 617, as illustrated in FIG. 13, as a higher friction portion with a higher friction coefficient than that of the cleaning blade 613. The coat portion 618 is formed of a material with a higher friction coefficient than that of the cleaning blade 613. Such a high friction material is exemplified by diamond-like carbon (DLC), but not limited thereto. The coat portion 618 is provided on the toner-blocking surface 617 so as not to contact with the surface of the photoconductor drum 1.

Note that the view of the cleaning unit is omitted, but it is equipped with a toner-collecting blade that collects the residual toner scraped by the cleaning blade and a toner-collecting coil that conveys the residual toner collected by the toner-collecting blade.

-Cleaning-less Image Forming Apparatus-

Figure 14:
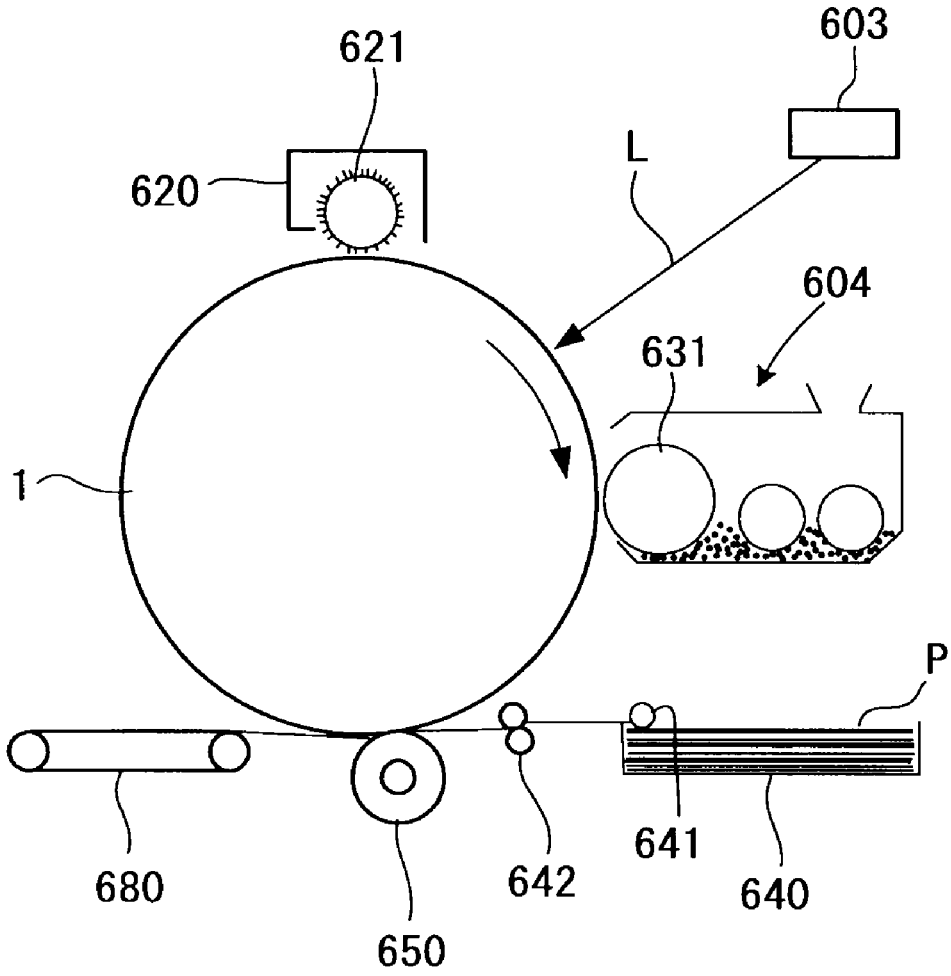
FIG. 14 is a schematic illustration showing one example of a cleaning-less image forming apparatus according to the present invention.

FIG. 14 is a schematic view exemplarily showing a cleaning-less image forming apparatus in which a developing unit also servers as a cleaning unit.

In FIG. 14, the cleaning-less image forming apparatus is equipped with a photoconductor drum 1 as a latent electrostatic image bearing member, a brush charger 620 as a contact charging unit, an exposure device 603 as an exposing unit, a developing device 604 as a developing device, a paper-feeding cassette 640, and a roller transfer unit 650. In the figure, P denotes a recording medium.

In this cleaning-less image forming apparatus, an untransferred toner remaining on the surface of the photoconductor drum 1 is moved to a position of the contact charger 620 that contacts with the photoconductor drum 1 by the continuous rotation of the photoconductor drum 1 and is temporarily collected to a magnetic brush section (not depicted) of a brush charging member 621 that contacts with the photoconductor drum 1, and the collected toner is discharged again to the surface of the photoconductor drum 1 and finally collected with a developer by a developer bearing member 631 into the developing device 604 to be reused on the surface of the photoconductor drum 1 for the next image formation.

The description "the developing unit 604 also serves as a cleaning unit" means a method in which a small amount of residual toner left on the photoconductor drum 1 that has gone through a transferring step is collected by a developing bias (an electric potential difference between a direct current voltage applied to the developer bearing member 631 and a surface electric potential of the photoconductor drum 1).

In such an image forming apparatus where the developing unit also serves as a cleaning unit, the residual toner is collected into the developing unit 604 and reused in the subsequent image formation processes, therefore, such effects may be achieved as elimination of waste toner, maintenance free, and cleaner-less system, thus leading to higher space efficiency and significant downsizing of image forming apparatuses.

<Other Steps and Other Units>

The charge eliminating step is a step of applying a discharge bias to the latent electrostatic image bearing member to discharge it and can be preferably carried out by a charge eliminating unit.

The charge eliminating unit is not particularly limited and may be suitably selected from among conventional charge eliminating devices as long as being capable of applying a discharge bias to the latent electrostatic image bearing member. Preferred examples thereof are discharge lamps.

The recycling step is a step of recycling the electrophotographic toner that has been removed in the cleaning step into the developing unit and can be preferably carried out by a recycling unit. The recycling unit is not particularly limited, and examples thereof are conventional transporting units.

The controlling step is a step of controlling each of the above-mentioned steps and can be preferably carried out by a controlling unit.

The controlling unit is not particularly limited and may be suitably selected in accordance with the intended use as long as being capable of controlling the operations of each of the units. Examples thereof include equipment such as sequencers and computers.

-Image Forming Apparatus and Image Forming Method-

Hereinafter, one embodiment of the image forming method of the present invention by means of the image forming apparatus will be described with reference to FIG. 15. An image forming apparatus 100 illustrated in FIG. 15 is equipped with a photoconductor drum 10 as a latent electrostatic image bearing member, a charge roller 20 as a charging unit, an exposure device 30 as an exposing unit, a developing device 40 as a developing unit, an intermediate transfer member 50, a cleaning blade 60 as a cleaning unit, and a charge eliminating lamp 70 as a charge eliminating unit.

The intermediate transfer member 50 is an endless belt, and is designed to be spanned over three rollers 51 disposed inside thereof and to be rotatable in the direction indicated by the arrow in the figure by means of the three rollers 51. One or more of the three rollers 51 also functions as a transfer bias roller capable of applying a certain transfer bias or a primary transfer bias to the intermediate transfer member 50. A cleaning blade 90 is provided adjacent to the intermediate transfer member 50. There is provided a transferring roller 80 as the transfer unit capable of applying a transfer bias at a position to face the intermediate transfer member 50 so as to secondarily transfer a visible image (toner image) to a recording medium 95. Further, there is provided a corona charger 58 in the periphery of the intermediate transfer member 50 for applying charges to the toner image transferred on the intermediate transferring medium 50. The corona charger 58 is placed between the contact region of the photoconductor 10 and the intermediate transferring medium 50 and the contact region of the intermediate transfer member 50 and the recording medium 95 in the rotational direction of the intermediate transfer member 50.

The developing device 40 is composed of a developing belt 41 as a developer bearing member, a black developing unit 45K, an yellow developing unit 45Y, a magenta developing unit 45M and a cyan developing unit 45C, the developing units being positioned around the developing belt 41. The black developing unit 45K is equipped with a developer container 42K, a developer supplying roller 43K, and a developing roller 44K. The yellow developing unit 45Y is equipped with a developer container 42Y, a developer supplying roller 43Y, and a developing roller 44Y. The magenta developing unit 45M is equipped with a developer container 42M, a developer supplying roller 43M, and a developing roller 44M. The cyan developing unit 45C is equipped with a developer container 42C, a developer supplying roller 43C, and a developing roller 44C. The developing belt 41 is an endless belt that is spanned over a plurality of belt rollers so as to be rotatable. A part of the developing belt 41 is in contact with the photoconductor 10.

Figure 15:
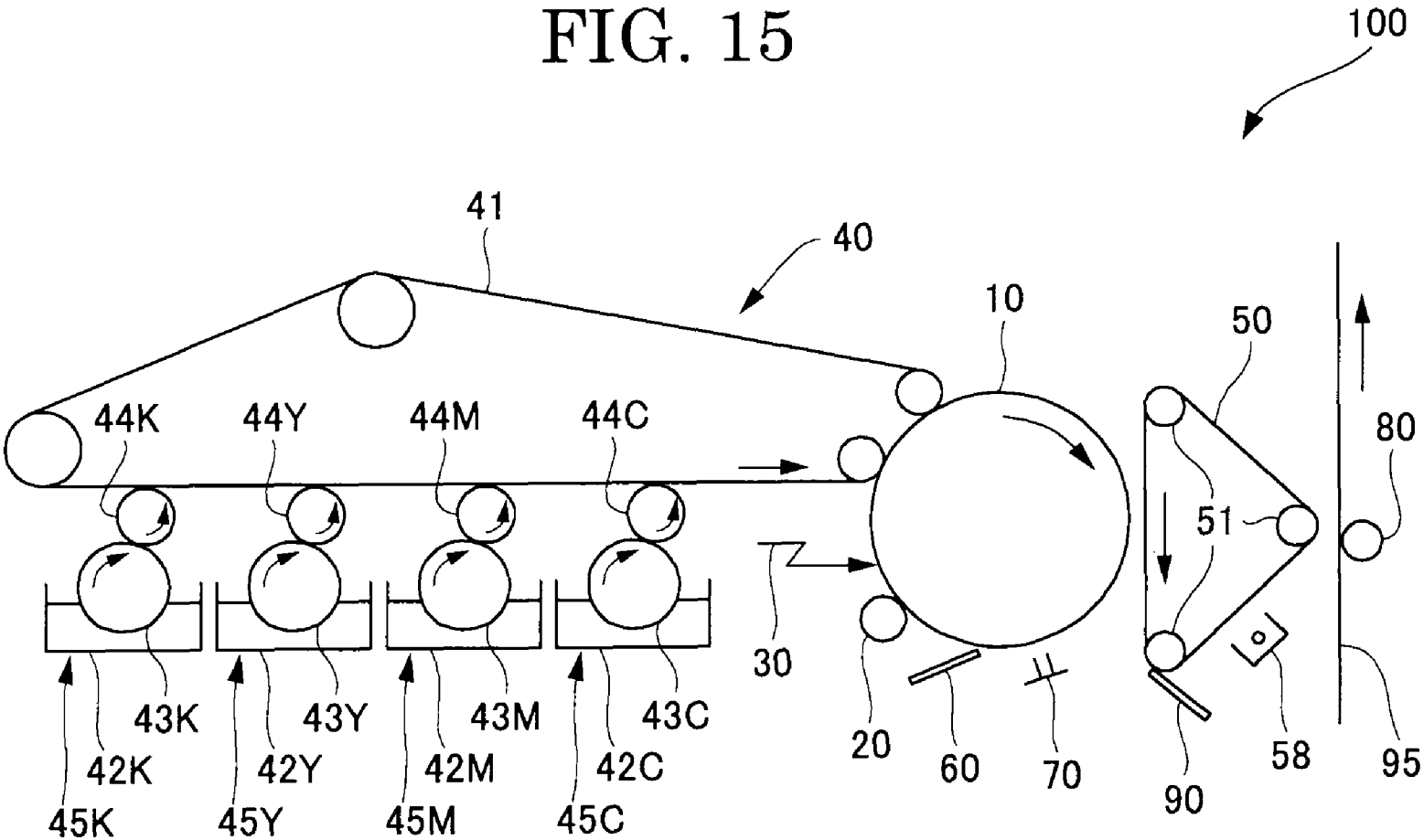
FIG. 15 is a schematic illustration showing one example of an image forming apparatus of the present invention.

In the image forming apparatus 100 illustrated in FIG. 15, the photoconductor drum 10 is uniformly charged by means of the charge roller 20. The photoconductor drum 10 is exposed to a light 30 imagewise by an exposure device (not depicted) to form a latent electrostatic image. The latent electrostatic image formed on the photoconductor drum 10 is provided with a toner from the developing device 40 to form a visible image. The visible image is primarily transferred onto the intermediate transfer member 50 by a bias voltage applied from the rollers 51 (primary transferring), and is further transferred to the recording medium 95 (secondary transferring). In this way a transferred image is formed on the recording medium 95. Subsequently, a residual toner remaining on the photoconductor drum 10 is removed by means of the cleaning blade 60, and charges remaining on the photoconductor drum 10 are eliminated by means of the charge eliminating lamp 70 on a temporary basis.

Figure 16:
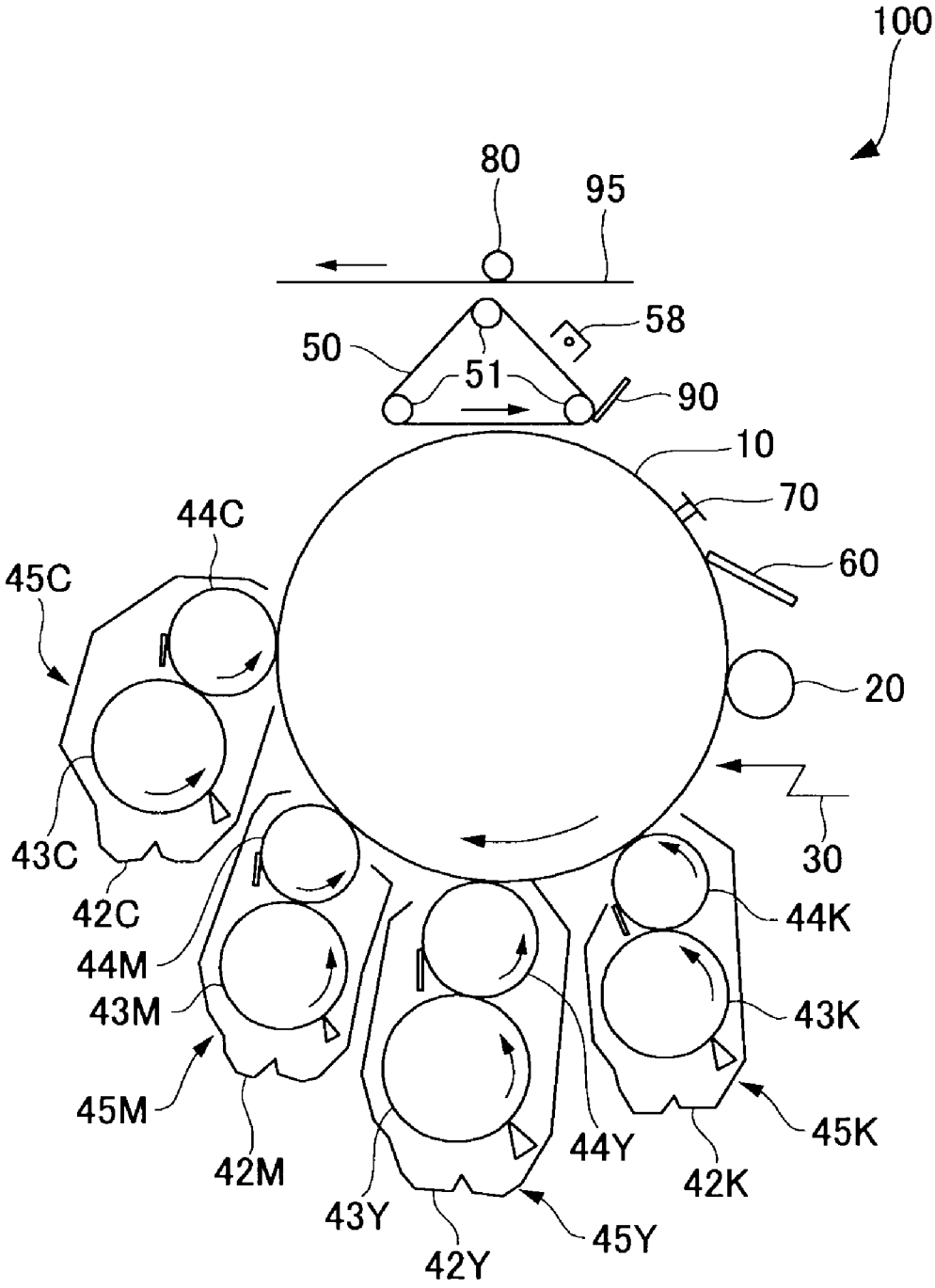
FIG. 16 is a schematic illustration of another example of an image forming apparatus of the present invention.

Next, another embodiment of the image forming method of the present invention by means of the image forming apparatus will be explained with reference to FIG. 16. An image forming apparatus 100 illustrated in FIG. 16 has an identical configuration and working effects to those of the image forming apparatus 100 illustrated in FIG. 15 except that this image forming apparatus 100 is not equipped with the developing belt 41 as a developer bearing member and that the black developing unit 45K, yellow developing unit 45Y, magenta developing unit 45M and cyan developing unit 45C are disposed around the periphery of the photoconductor drum 10. The reference numerals in FIG. 16 that are identical to those of FIG. 15 are denoted by the same reference numerals as those of FIG. 15.

-Tandem Image Forming Apparatus and Image Forming Method

Figure 17:
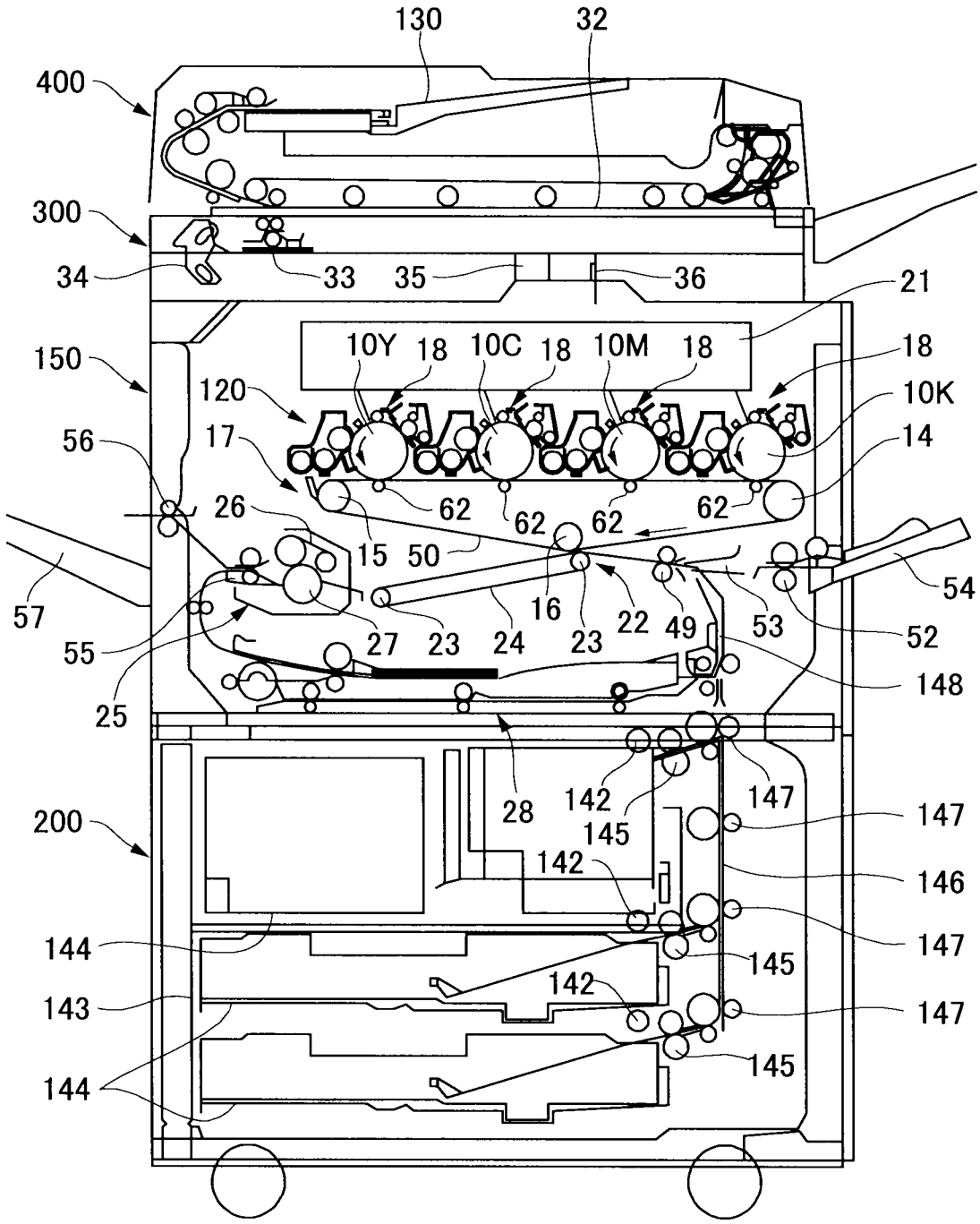
FIG. 17 is a schematic illustration of one example of a tandem image forming apparatus of the present invention.

Still another embodiment of the image forming method of the present invention by means of the image forming apparatus will be described with reference to FIG. 17. An image forming apparatus 100 illustrated in FIG. 17 is a tandem color image-forming apparatus. The tandem image forming apparatus 100 is equipped with a copier main body 150, a sheet-feeder table 200, a scanner 300, and an automatic document feeder (ADF) 400.

The copier main body 150 has an endless-belt intermediate transfer member 50 in the center. The intermediate transfer member 50 is spanned over support rollers 14, 15 and 16 so as to be rotatable in a clockwise direction in FIG. 17. An intermediate transfer member cleaning unit 17 for removing a residual toner remaining on the intermediate transfer member is provided in the vicinity of the support roller 15. On the surface of the intermediate transfer member 50 spanned over the support rollers 14 and 15, four color-image forming units 18 of yellow, cyan, magenta, and black are arranged, constituting a tandem developing unit 120. An exposing device 21 is arranged adjacent to the tandem developing unit 120. A secondary transfer unit 22 is arranged across the intermediate transfer member 50 from the tandem developing unit 120. The secondary transfer unit 22 is provided with a secondary transferring belt 24, an endless belt, which is spanned over a pair of rollers 23. A recording medium conveyed on the secondary transferring belt 24 is allowed to contact with the intermediate transfer member 50. An image fixing device 25 is placed in the vicinity of the secondary transfer unit 22.

In the vicinity of the secondary transfer unit 22 and the image fixing device 25, a sheet reverser 28 is placed. The sheet reverser 28 turns over a transferred sheet to form images on the both sides of the sheet of recording medium.

Next, full-color image formation (color copying) using the tandem developing unit 120 will be described. At first, a source document is placed on a document platen 130 of the automatic document feeder 400. Alternatively, the automatic document feeder 400 is opened, the source document is placed on a contact glass 32 of the scanner 300, and the automatic document feeder 400 is closed.

When a start switch (not depicted) is pushed, the source document placed on the automatic document feeder 400 is moved to the contact glass 32, and the scanner is then driven to operate first and second carriages 33 and 34. In the case where the source document is placed on the contact glass 32 from the beginning, the scanner 300 is immediately driven after pushing of the start switch. Light is applied from a light source to the document by means of the first carriage 33, and light reflected from the document is further reflected by the mirror of the second carriage 34. The reflected light passes through an image-forming lens 35, and a read sensor 36 receives it. In this way the color document (color image) is scanned, producing 4 types of color information of black, yellow, magenta, and cyan.

Figure 18:
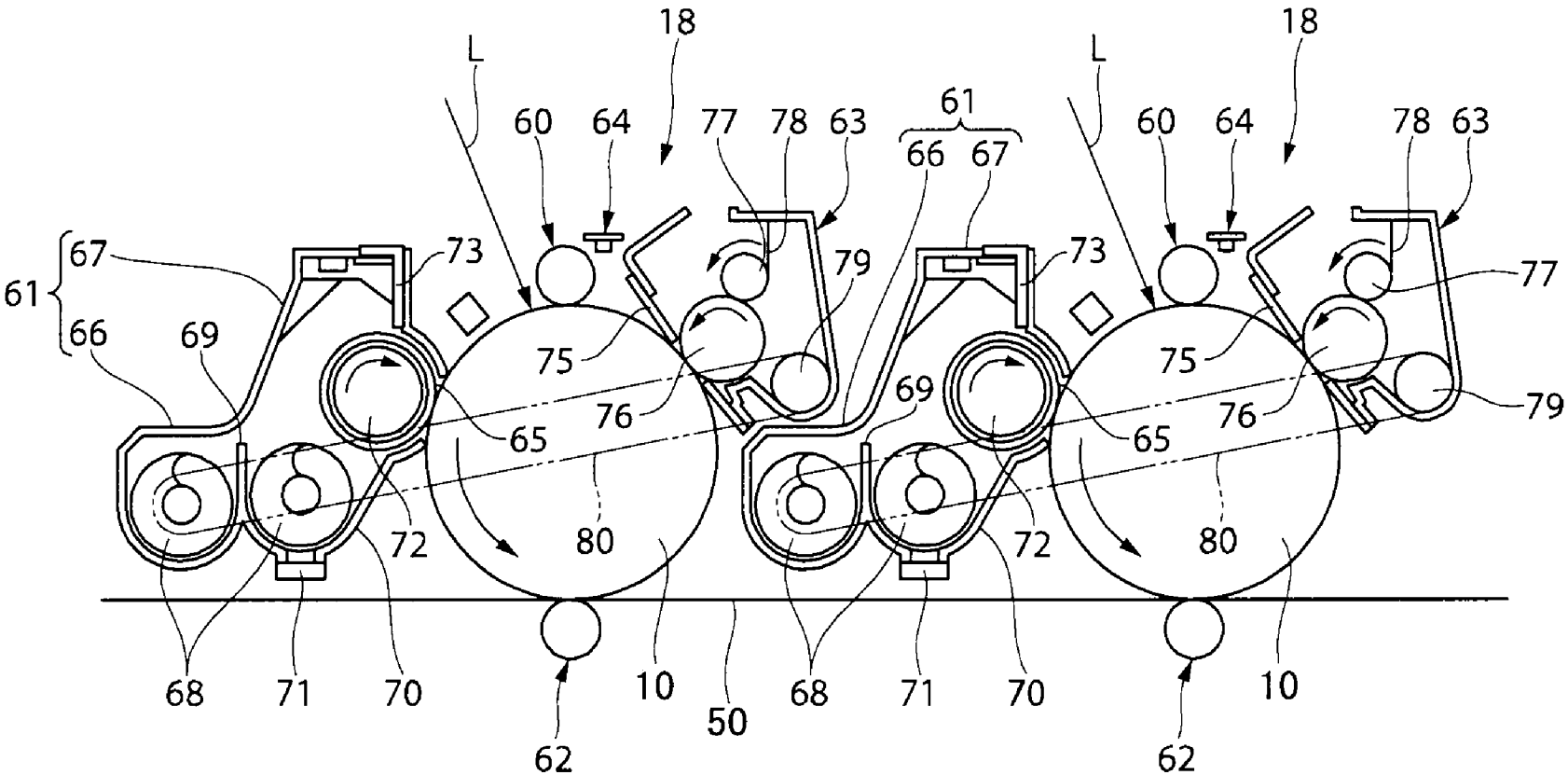
FIG. 18 is an enlarged illustration of each image forming elements illustrated in FIG. 17.

Each piece of the color information of black, yellow, magenta, and cyan is transmitted to the image forming unit 18 (black image forming unit, yellow image forming unit, magenta image forming unit, or cyan image forming unit) of the tandem developing unit 120, and toner images of each color are formed in the image-forming units 18. As illustrated in FIG. 18, each of the image-forming units 18 (black image-forming unit, yellow image forming unit, magenta image forming unit, and cyan image forming unit) of the tandem developing unit 120 is equipped with a latent electrostatic image bearing member 10 (latent electrostatic image bearing member for black 10K, latent electrostatic image bearing member for yellow 10Y, latent electrostatic image bearing member for magenta 10M, or latent electrostatic image bearing member for cyan 10C); a charger 160 for uniformly charging the surface of each of the latent electrostatic image bearing members 10; an exposure device for exposing image-wise the surface of each of the latent electrostatic image bearing members 10 to light (denoted by "L" in FIG. 18) based on the corresponding each color image information to form a latent electrostatic image corresponding to the color image on each of the latent electrostatic image bearing members 10; a developing device 61 for developing the latent electrostatic image using the corresponding color toner (black toner, yellow toner, magenta toner, or cyan toner) to form each color toner image; a transfer charger 62 for transferring the each color toner image to an intermediate transfer member 50; a cleaning device 63; and a charge eliminating device 64. Thus, images of different colors (a black image, a yellow image, a magenta image, and a cyan image) can be formed based on the each color image information. The thus formed each color images, i.e. the black toner image formed on the latent electrostatic image bearing member for black 10K, yellow toner image formed on the latent electrostatic image bearing member for yellow 10Y, magenta toner image formed on the latent electrostatic image bearing member for magenta 10M, and cyan toner image formed on the latent electrostatic image bearing member for cyan 10C are sequentially transferred onto the intermediate transfer member 50 which rotates by the rotation of support rollers 14, 15 and 16 (primary transferring). These toner images of black, yellow, magenta and cyan are superimposed on the intermediate transfer member 50, thereby forming a composite color image (color transferred image).

In the meanwhile, one of feed rollers 142 of the paper feed table 200 is selectively rotated, whereby sheets of recording medium are ejected from one of multiple paper feed cassettes 144 in a paper bank 143 and are separated one by one by a separation roller 145. Subsequently, the sheet is fed to a feed path 146, conveyed by a conveying roller 147 into a feed path 148 inside the copier main body 150 and is bumped against a resist roller 49 to stop. Alternatively, one of the feed rollers 142 is rotated to eject the recording medium placed on a manual feed tray 54. The sheets are then separated one by one by means of the separation roller 145, and the sheet is fed into a manual feed path 53, and similarly, is bumped against the resist roller 49 to stop. The resist roller 49 is generally earthed, but it may be used under application of a bias for removing paper dusts on the recording medium. The resist roller 49 is rotated synchronously with the movement of the composite color image on the intermediate transfer member 50 to send the sheet of recording medium into between the intermediate transfer member 50 and the secondary transfer unit 22, and the composite color image is transferred onto the sheet by means of the secondary transfer unit 22 (secondary transferring). Thereby a color image is formed on the sheet. After image transferring, a residual toner remaining on the intermediate transfer member 50 is removed by means of an intermediate transfer member cleaning device 17.

The sheet of recording medium with the transferred color image formed thereon is sent by the secondary transfer unit 22 into an image fixing device 25, where the composite color image (color transferred image) is fixed on the sheet (recording medium) by heat and pressure. Subsequently, the sheet changes its direction by action of a switch blade 55, ejected by an ejecting roller 56, and stacked on an output tray 57. Alternatively, the sheet changes its direction by action of the switch blade 55, is flipped over by means of a sheet reverser 28, and transferred back to the image transfer section for recording of another image on the other side thereof. The sheet that bears images on both sides is then ejected by means of an ejecting roller 56, and is stacked on an output tray 57.

<Toner Container>

The toner container to be used in the present invention houses the toner or the developer of the present invention in its container.

The container is not particularly limited and may be suitably selected from among conventional container. Preferred examples thereof are those having a toner container body and a cap.

The toner container body is not particularly limited as to the size, shape, structure, material and the like and may be suitably selected in accordance with the intended use. For example, the shape is preferably a cylinder. It is particularly preferable that a spiral ridge is formed on the inner surface, thereby the content or the toner moves toward the discharge vent when rotated, and the spiral part partly or entirely serves as a bellows.

The material of the toner container body is not particularly limited and preferably offers dimensional accuracy. For example, resins are preferably exemplified. Among them, polyester resin, polyethylene resin, polypropylene resin, polystyrene resin, polyvinyl chloride resin, polyacrylic acid, polycarbonate resin, ABS resin, polyacetal resin are preferable.

The toner container is easy to store and ship, is handy, and is used with the process cartridge and image forming apparatus of the present invention by detachably mounting thereto for supplying toner.

(Process Cartridge)

The process cartridge of the present invention has at least a latent electrostatic image bearing member that bears a latent electrostatic image on the surface thereof and a developing unit configured to develop the latent electrostatic image carried on the surface of the latent electrostatic image bearing member using a toner to form a visible image and further has suitably selected other units in accordance with the necessity such as a charging unit, an exposing unit, a transfer unit, a cleaning unit and a charge eliminating unit.

The toner contains at least a binder resin and a colorant, and the binder resin contains a polyester resin (A) and and a polyester resin (B) having a softening point of 10° C. higher than that of the polyester resin (A). At least any one of the polyester resins (A) and (B) is a resin derived from fumaric acid/maleic acid-modified rosin which has a polyester unit that is obtained by polycondensation of an alcohol component with a carboxylic acid component containing at least any one of a fumaric acid-modified rosin and a maleic acid-modified rosin.

As to the polyester resins (A) and (B), polyester resins similar to those described above in the sections of the image forming appratus and image forming method can be used.

The developing unit has at least a developer container to house the toner or the developer and a developer bearing member to bear and convey the toner or the developer which is housed in the developer container and may further have a layer thickness controlling member for controlling the thickness of a toner layer to be carried by the developer bearing member. Specifically, any of the one-component developing unit and the two-component developer unit, which have been described hereinbefore in the sections of the image forming apparatus and image forming method, can be preferably used.

The charging unit, exposing unit, transfer unit, cleaning unit, and charge eliminating unit may be suitably selected from among those similar to ones mentioned above for the image forming apparatus.

The process cartridge is detachably provided in various types of electrophotographic image forming apparatuses, facsimiles, and printers, and particularly preferably be detachably mounted to the image forming apparatus of the present invention.

Figure 19:
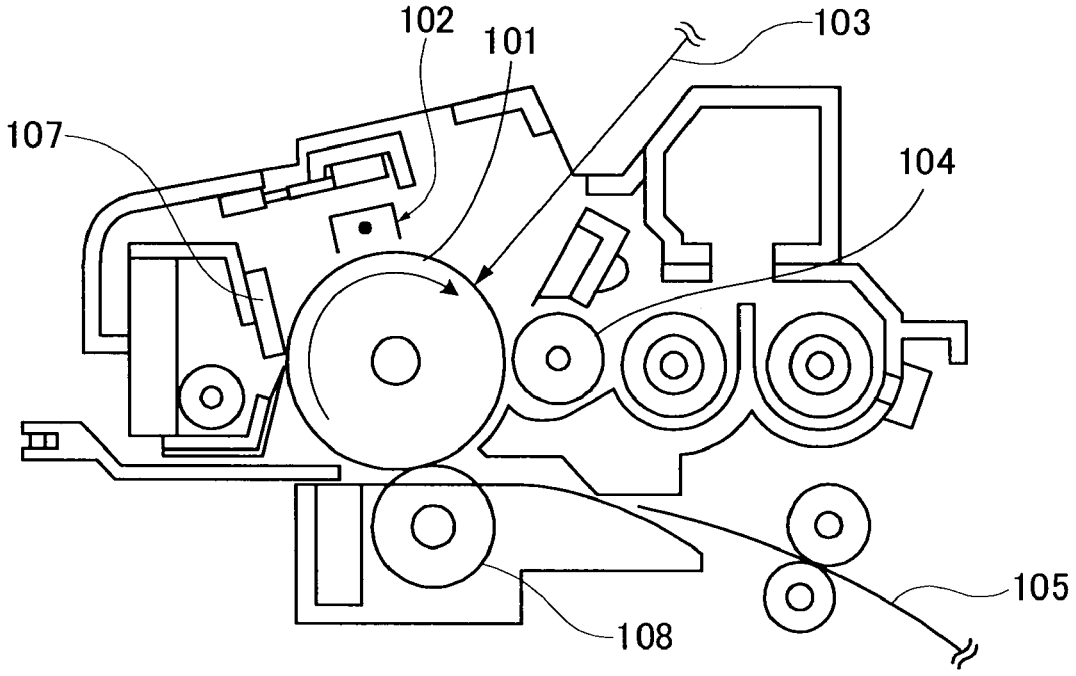
FIG. 19 is a schematic illustration showing one example of a process cartridge of the present invention.

The process cartridge incorporates, as illustrated in FIG. 19 for example, a latent electrostatic image bearing member 101, a charging unit 102, a developing unit 104, a transfer unit 108, and a cleaning unit 107 and further has other units in accordance with the necessity. In FIG. 19, reference numeral 103 denotes light irradiation from an exposing unit, and reference numeral 105 denotes a recording medium.

The image forming process by means of the process cartridge as illustrated in FIG. 19 will be explained. A latent electrostatic image corresponding to an exposed image is formed on the surface of the latent electrostatic image bearing member 101 which is being rotated in the direction indicated by an arrow by charging using the charging unit 102 and exposing using exposure 103 from the exposing unit (not depicted). The latent electrostatic image is developed by means of the developing unit 104, the obtained toner image is then transferred onto the recording medium 105 by means of the transfer unit 108 and then printed out. The surface of the photoconductor after image transfer is cleaned by means of the cleaning unit 107 and further discharged by means of a discharging unit (not depicted), and the above operations are repeated again.

In the image forming apparatus, the image forming method, and the process cartridge according to the present invention, a toner is used which contains a binder resin containing a polyester resin obtained by polycondensation of an alcohol component with a carboxylic acid component which contains at least any one of a rosin compound selected from a fumaric acid-modified rosin, a maleic acid-modified rosin and an itaconic acid-modified rosin, wherein the amount of the carboxylic acid component is 5% by mass or more based on the total mass of the alcohol component and carboxylic acid component, and the amount of an abietic acid in the toner is 1% by mass or less. Thus, the image forming apparatus, the image forming method, and the process cartridge are excellent in chargeability, anti-spent property (carrier-spent resistance), and transferability and are capable of forming high-quality images without causing a substantial degradation in its quality for a long period of time.

EXAMPLES

Hereinafter, the present invention will be described in detail referring to specific Examples, however, the present invention is not limited to the disclosed Examples. On the contrary, the present invention is intended to cover various modifications and equivalent arrangements included within the spirit and scope of the appended claims.

In the following Synthesis Examples, Production Examples, Examples and Comparative Examples, physical property values of polyester resins and rosin compounds, and the weight average particle diameter of toners were measured according to the following methods.

<Softening point of Resin>

(1) Preparation of Sample

Ten grams of resin was melted at 170° C. on a hot plate for 2 hours. Subsequently, the resin sample was naturally cooled for 1 hour in a state of being open to the atmospheric air at a temperature of 25° C. and a relative humidity of 50%. Thereafter, the resultant resin sample was pulverized by a coffee mill (National MK-61M) for 10 seconds.

(2) Measurement

While 1 g of the resin sample being heated at a temperature increase rate of 6° C./min using a flow tester (CFT-500D, manufactured by Shimadzu Corporation), a load of 1.96 MPa was applied to the resin sample by means of a plunger so as to extrude the resin sample from a nozzle having a diameter of 1 mm and a length of 1 mm. The amounts of the plunger lowering were plotted with respect to temperatures, and a temperature at which a half of the amount of the resin sample flowed out was determined as the softening point of the sample.

<Measurement of Glass Transition Temperature (Tg) of Resin>

To an aluminum pan, 0.01 g to 0.02 g of the sample was weighed using a differential scanning calorimeter (DSC210, manufactured by Seiko Electronics Industries Co., Ltd.), the sample was increased in temperature up to 200° C., subsequently cooled to 0° C. at a temperature decrease rate of 10° C./min from 200° C. and then increased at a temperature increase rate of 0° C./min. The temperature intersection point of an extended line of a base line representing temperatures that are equal to the highest endothermic peak temperature or lower with a tangent line representing a maximum temperature gradient from the initial rise of temperature to the peak top was determined as the glass transition temperature of the sample.

<Acidic Value of Resin>

The acidic value of resin was measured based on JIS K0070. Note that only a solvent for measurement was changed to a mixture solvent of acetone and toluene (acetone: toluene=1:1 (volume ratio)) from a mixture solvent of ethanol and ether, which is defined in JIS K0070.

<Weight Average Particle Diameter of Toner>

- measurement device: COULTER MULTISIZER III (manufactured by Beckman Coulter Co.)
- aperture diameter: 100 μm
- analysis software: BECKMAN COULTER MULTISIZER 3 Ver. 3.51 (manufactured by Beckman Coulter Co.)
- electrolyte: ISOTON III (manufactured by Beckman Coulter Co.)
- dispersion liquid: 10% by mass of surfactant (alkylbenzene sulfonic acid salt, NEOGEN SC-A, produced by Daiichi Kogyo Seiyaku Co., Ltd.)
- dispersion conditions: 10 mg of a measurement sample was added to 5 mL of the dispersion liquid and dispersed in a supersonic dispersing device for 1 minute. Thereafter, 25 mL of the electrolyte was added to the dispersion liquid and further dispersed in the ultrasonic dispersing device for 1 minute.
- measurement conditions: 100 mL of the electrolyte and the dispersion liquid were added to a beaker, 30,000 particles were measured at a concentration with which the particle diameters of 30,000 particles were able to be measured in 20 seconds. Based on the resulting particle size distribution, the weight average particle diameter of the measurement sample was determined.

<Amount of Rosin or Abietic Acid Contained in Toner>

A sample was dissolved in acetone so as to obtain a 0.3% by mass of solution, and methyl-esterified with diazo-methane. Subsequently, the sample was analyzed by GC gas chromatography (HP6890, produced by Agilent) under the following measurement conditions.

-GC Measurement Conditions

- analysis column: HP-5 (30 m-250 μm-0.25 μm)
- carrier: helium (He)
- flow rate condition: 1 mL/min
- column inlet temperature: 250° C.
- pressure applied to column head: 126.8 kPa
- injection mode: split
- condition of oven temperature: the temperature was maintained at 180° C. for 5 minutes, subsequently raised to 200° C. at a temperature increase rate of 2° C./min, then maintained at 200° C. for 5 minutes.

Synthesis Example A1

-Synthesis of Acrylic Acid-modified Rosin-

Into a 10 L flask equipped with a fractionating column, a reflux condenser, and a receiver, 5,630 g of an unpurified tall rosin and 610 g of acrylic acid were added, the mixture was heated to a temperature ranging from 160° C. to 210° C. in 2 hours, the mixture was reacted at 210° C. for 3 hours, and then distilled at 210° C. under a reduced pressure of 4 kPa, thereby a rosin modified with acrylic acid (acrylic acid-modified rosin) was synthesized.

The amount of an abietic acid contained in the unpurified tall rosin which had been used in production of the thus obtained acrylic acid-modified rosin, was 35.9% by mass, and the amount of the abietic acid contained in the acrylic acid-modified rosin was 14.2% by mass.

Synthesis Example A2

-Synthesis of Itaconic Acid-modified Rosin

Into a 10 L flask equipped with a fractionating column, a reflux condenser, and a receiver, 5,630 g of an unpurified tall rosin which had been used in production of the acrylic acid-modified rosin, and 1,130 g of itaconic acid were added, the mixture was heated to a temperature ranging from 160° C. to 210° C. in 2 hours, the mixture was reacted at 210° C. for 3 hours, and then distilled at 210° C. under a reduced pressure of 4 kPa, thereby a rosin modified with itaconic acid (itaconic acid-modified rosin) was synthesized.

The amount of an abietic acid contained in the thus obtained itaconic acid-modified rosin was 4.1% by mass.

Synthesis Example A3

-Synthesis of Fumaric Acid-modified Rosin

Into a 10 L flask equipped with a fractionating column, a reflux condenser, and a receiver, 5,630 g of an unpurified tall rosin which had been used in production of the acrylic acid-modified rosin, and 950 g of fumaric acid were added, the mixture was heated to a temperature ranging from 160° C. to 210° C. in 2 hours, the mixture was reacted at 210° C. for 3 hours, and then distilled at 210° C. under a reduced pressure of 4 kPa, thereby a rosin modified with fumaric acid (fumaric acid-modified rosin) was synthesized. The amount of the abietic acid contained in the thus obtained fumaric acid-modified rosin was 2.6% by mass.

Synthesis Example A4

-Synthesis of Resins 1 to 3 and Resin 10 to 12-

Into a 5 L four-necked flask equipped with a nitrogen inlet tube, a dehydration tube, a stirrer and a thermocouple, each alcohol component, each individual carboxylic acid component other than trimellitic acid anhydride, and each esterified catalyst, all of which are shown in the following Tables A1-1 and A1-2 were added, the mixture was subjected to polycondensation reaction at 235° C. under nitrogen atmosphere for 15 hours and then reacted at 235° C. under a pressure of 8.0 kPa for 1 hour. The mixture was cooled to 210° C., and each trimellitic acid anhydride shown in Tables A1-1 and A1-2 was put into the flask. The mixture was reacted at 210° C. under normal pressure (101.3 kPa) for 1 hour and further reacted at 210° C. under a pressure of 10 kPa until the temperature reached a desired softening point, thereby synthesizing each of polyester resins (Resins 1 to 3 and Resins 10 to 12).

Synthesis Example A5

-Synthesis of Resins 4 to 6-

Into a 5 L four-necked flask equipped with a nitrogen inlet tube, a dehydration tube, a rectifying column, a stirrer and a thermocouple, each alcohol component, each individual carboxylic acid component other than trimellitic acid anhydride, and each esterified catalyst, all of which are shown in the following Table A1-1, were added, the mixture was subjected to polycondensation reaction at 235° C. under nitrogen atmosphere for 15 hours and then reacted at 235° C. under a pressure of 8.0 kPa for 2 hours. The mixture was cooled to 210° C., and each trimellitic acid anhydride shown in Table A1-1 was put into the flask. The mixture was reacted at 210° C. under normal pressure (101.3 kPa) for 2 hours and further reacted at 210° C. under a pressure of 10 kPa until the temperature reached a desired softening point, thereby synthesizing each of polyester resins (Resins 4 to 6).

Synthesis Example A6

-Synthesis of Resins 7 to 9-

Into a 5 L four-necked flask equipped with a nitrogen inlet tube, a dehydration tube, a stirrer and a thermocouple, each alcohol component, each individual carboxylic acid component other than modified rosin, and each esterified catalyst, all of which are shown in the following Table A1-2, were added, the mixture was subjected to polycondensation reaction at 230° C. under nitrogen atmosphere for 15 hours and then reacted at 230° C. under a pressure of 8.0 kPa for 1 hour. The mixture was cooled to 180° C., and each modified rosin shown in Table A1-2 was put into the flask. The temperature of the mixture was raised for 3 hours until it reached 210° C. under normal pressure (101.3 kPa) and further reacted at 210° C. under a pressure of 20 kPa until the temperature reached a desired softening point, thereby synthesizing each of polyester resins (Resins 7 to 9).

TABLE A1-1

| | | Resin 1 | Resin 2 | Resin 3 | Resin 4 | Resin 5 | Resin 6 |
|---|---|---|---|---|---|---|---|
| Alcohol component | 1,3-propanediol (g) | — | — | — | — | — | 240 |
| | 1,2-propanediol (g) | 1,210 | 1,210 | 1,210 | 1,210 | 1,210 | 970 |
| | bisphenol A | — | — | — | — | — | — |
| Carboxylic acid component | terephthalic acid (g) | 1,825 | 1,825 | 1,825 | 1,825 | 1,825 | 1,825 |
| | trimellitic acid anhydride (g) | 290 | 290 | 290 | 290 | 290 | 290 |
| | acrylic acid-modified rosin (g) | 1,800 | — | — | 1,800 | — | — |
| | itaconic acid-modified rosin (g) | — | 1,800 | — | — | 1,800 | — |
| | fumaric acid-modified rosin (g) | — | — | 1,800 | — | — | 1,800 |
| Esterified catalyst | 2-ethylhexanoic acid tin (II) | 25.2 | 25.2 | 25.2 | 26.1 | 26.1 | 26.1 |
| Amount of aliphatic diol in divalent alcohol component (mole %) | | 100 | 100 | 100 | 100 | 100 | 100 |
| Amount of 1,2-PD in aliphatic diol (mole %) | | 100 | 100 | 100 | 100 | 100 | 80 |
| Amount of rosin compound (% by mass)(*1) | | 35 | 35 | 35 | 35 | 35 | 35 |
| Physical properties of Resin | Softening point (° C.) | 103.3 | 104.6 | 110.2 | 108.4 | 102.3 | 105.4 |
| | Glass transition temperature (° C.) | 58.2 | 57.3 | 59.2 | 59.1 | 57.2 | 58.2 |
| | Acid value (mgKOH/g) | 31.2 | 32.6 | 32.9 | 30.1 | 34.2 | 30.9 |

(*1)It represents the amount of a rosin compound contained in the total mass of alcohol component and carboxylic acid component.

TABLE A1-2

| | | Resin 7 | Resin 8 | Resin 9 | Resin 10 | Resin 11 | Resin 12 |
|---|---|---|---|---|---|---|---|
| Alcohol component | 1,3-propanediol (g) | 240 | — | — | — | 605 | — |
| | 1,2-propanediol (g) | 970 | 1,210 | 1,210 | 303 | 605 | 1,210 |
| | bisphenol A | — | — | — | 907 | — | — |
| Carboxylic acid component | terephthalic acid (g) | 1,825 | 1,825 | 1,825 | 1,825 | 1,825 | 1,825 |
| | trimellitic acid anhydride (g) | 290 | 290 | 290 | 290 | 290 | 290 |
| | acrylic acid-modified rosin (g) | 1,800 | — | — | 1,800 | 1,800 | 100 |
| | itaconic acid-modified rosin (g) | — | 1,800 | — | — | — | — |
| | fumaric acid-modified rosin (g) | — | — | 1,800 | — | — | — |
| Esterified catalyst | 2-ethylhexanoic acid tin (II) | 17.3 | 17.3 | 17.3 | 25.2 | 25.2 | 25.2 |
| Amount of aliphatic diol in divalent alcohol component (mole %) | | 100 | 100 | 100 | 50 | 100 | 100 |

TABLE A1-2-continued

| | | Resin 7 | Resin 8 | Resin 9 | Resin 10 | Resin 11 | Resin 12 |
|---|---|---|---|---|---|---|---|
| Amount of 1,2-PD in aliphatic diol (mole %) | | 80 | 100 | 100 | 100 | 50 | 100 |
| Amount of rosin compound (% by mass) (*1) | | 35 | 35 | 35 | 35 | 35 | 3 |
| Physical properties of Resin | Softening point (° C.) | 103.3 | 101.5 | 101.2 | 115.1 | 102.4 | 101.4 |
| | Glass transition temperature (° C.) | 56.2 | 59.3 | 58.7 | 65.1 | 55.2 | 50.2 |
| | Acid value (mgKOH/g) | 32.2 | 30.8 | 32.1 | 30.2 | 28.9 | 29.8 |

(*1): It represents the amount of a rosin compound contained in the total mass of alcohol component and carboxylic acid component.

(Production Example of Masterbatch A1)

-Preparation of Masterbatch-

A pigment having the following composition, Resin 1, and pure water were mixed at a ratio of 1:1:0.5 (mass ratio) and kneaded using a twin roll. The kneading was carried out at 70° C., and then the temperature of the twin-roll was raised to 120° C. to evaporate water in the kneaded mixture, thereby producing Masterbatch 1 composed of cyan masterbatch 1 (TB-C1), magenta masterbatch 1 (TB-M1), yellow masterbatch 1 (TB-Y1), and black masterbatch 1 (TB-K1).

| [Formulation of Cyan toner masterbatch 1: (TB-C1)] | |
|---|---|
| Resin 1 | 100 parts by mass |
| cyan pigment (C.I. Pigment blue 15:3) | 100 parts by mass |
| pure water | 50 pats by mass |

| [Formulation of Magenta toner masterbatch 1: (TB-M1) | |
|---|---|
| Resin 1 | 100 parts by mass |
| magenta pigment (C.I. Pigment red 122) | 100 parts by mass |
| pure water | 50 pats by mass |

| [Formulation of Yellow toner masterbatch 1: (TB-Y1)] | |
|---|---|
| Resin 1 | 100 parts by mass |
| yellow pigment (C.I. Pigment yellow 180) | 100 parts by mass |
| pure water | 50 pats by mass |

| [Formulation of Black toner masterbatch 1: (TB-K1)] | |
|---|---|
| Resin 1 | 100 parts by mass |
| black pigment (carbon black) | 100 parts by mass |
| pure water | 50 pats by mass |

(Production Example of Masterbatch A2)

-Preparation of Masterbatches 2 to 12-

Each of masterbatches 2 to 12 composed of each of cyan masterbatches 2 to 12 (TB-C2 to TB-C12), each of magenta masterbatches 2 to 12 (TB-M2 to TB-M12), each of yellow masterbatches 2 to 12 (TB-Y2 to TB-Y12), and each of black masterbatches 2 to 12 was produced.

(Production Example of Toner A1)

Toner A1 composed of cyan toner 1, magenta toner 1, yellow toner 1 and black toner 1 was produced as follows.

-Production of Cyan Toner 1-

A cyan toner composition having the following cyan toner formulation 1 was preliminarily mixed using a HENSHEL mixer (FM10B, manufactured by Mitsui Miike Kakoki K.K.) and then kneaded using a biaxial kneader (PCM-30, manufactured by IKEGAI LTD.). Subsequently, the kneaded workpiece was finely pulverized using an ultrasonic jet pulverizer LABO-JET (manufactured by Nippon Pneumatic Manufacturing Co., Ltd.), followed by classification by means of an airflow classifier (MDS-I, manufactured by Nippon Pneumatic Manufacturing Co., Ltd.) to thereby produce toner base particles having a weight average particle diameter of 7 μm.

Next, based on 100 parts by mass of the toner base particles, 1.0 part by mass of a colloidal silica (H-2000, produced by Clariant Japan K.K.) were mixed using a sample mill, thereby producing cyan toner 1.

| [Formulation of cyan toner 1] | |
|---|---|
| Resin 1 | 92 parts by mass |
| cyan masterbatch 1 (TB-C1) | 16 parts by mass |
| charge controlling agent (E-84, produced by Orient Chemical Industries, Ltd.) | 1 part by mass |
| ester wax (acid value = 5 mgKOH/g, mass average molecular mass = 1,600) | 5 parts by mass |

-Production of Magenta Toner 1-

Magenta toner 1 was produced in a similar manner to the production method of cyan toner 1, except that a composition having the following magenta toner formulation 1 was used instead of using the composition having the cyan toner formulation 1.

| [Formulation of magenta toner 1] | |
|---|---|
| binder resin 1 | 92 parts by mass |
| magenta masterbatch 1 (TB-M1) | 16 parts by mass |
| charge controlling agent (E-84, produced by Orient Chemical Industries, Ltd.) | 1 part by mass |
| ester wax (acid value = 5 mgKOH/g, mass average molecular mass = 1,600) | 5 parts by mass |

-Production of Yellow Toner 1-

Yellow toner 1 was produced in a similar manner to the production method of cyan toner 1, except that a composition having the following yellow toner formulation 1 was used instead of using the composition having the cyan toner formulation 1.

| [Formulation of Yellow toner 1] | |
|---|---|
| binder resin 1 | 92 parts by mass |
| yellow master batch 1 (TB-Y1) | 16 parts by mass |
| charge controlling agent (E-84, produced by Orient Chemical Industries, Ltd.) | 1 part by mass |
| ester wax (acid value = 5 mgKOH/g, mass average molecular mass = 1,600) | 5 parts by mass |

-Production of Black Toner 1-

Black toner 1 was produced in a similar manner to the production method of cyan toner 1, except that a composition having the following black toner formulation 1 was used instead of using the composition having the cyan toner formulation 1.

| [Formulation of black toner 1] | |
|---|---|
| binder resin 1 | 92 parts by mass |
| black master batch 1 (TB-K1) | 16 parts by mass |
| charge controlling agent (E-84, produced by Orient Chemical Industries, Ltd.) | 1 part by mass |
| ester wax (acid value = 5 mgKOH/g, mass average molecular mass = 1,600) | 5 parts by mass |

(Production Examples of Toners A2 to A12)

-Production of Toners A2 to A12-

Each of Toners A2 to A12 composed of each of cyan toners 2 to 12, each of yellow toners 2 to 12, each of magenta toners 2 to 12 and each of black toners 2 to 12, which had been produced in Production Examples A2 to A12, was produced in a similar manner to that of Production Example of toner A1, except that each of Resins 2 to 12 was used instead of using Resin 1.

TABLE A2-1

| Toner No. | Toner | Binder resin | Masterbatch | Charge controlling agent | Wax | Amount of abietic acid contained in toner (% by mass) |
|---|---|---|---|---|---|---|
| Toner A1 | Cyan | Resin 1 (92) | TB-C1 (16) | E-84 (1) | ester (5) | 0.21 |
| | Magenta | Resin 1 (92) | TB-M1 (16) | E-84 (1) | ester (5) | 0.08 |
| | Yellow | Resin 1 (92) | TB-Y1 (16) | E-84 (1) | ester (5) | 0.12 |
| | Black | Resin 1 (92) | TB-K1 (16) | E-84 (1) | ester (5) | 0.14 |
| Toner A2 | Cyan | Resin 2 (92) | TB-C2 (16) | E-84 (1) | ester (5) | 0.01 |
| | Magenta | Resin 2 (92) | TB-M2 (16) | E-84 (1) | ester (5) | 0 |
| | Yellow | Resin 2 (92) | TB-Y2 (16) | E-84 (1) | ester (5) | 0.03 |
| | Black | Resin 2 (92) | TB-K2 (16) | E-84 (1) | ester (5) | 0.02 |
| Toner A3 | Cyan | Resin 3 (92) | TB-C3 (16) | E-84 (1) | ester (5) | 0.18 |
| | Magenta | Resin 3 (92) | TB-M3 (16) | E-84 (1) | ester (5) | 0.32 |
| | Yellow | Resin 3 (92) | TB-Y3 (16) | E-84 (1) | ester (5) | 0.31 |
| | Black | Resin 3 (92) | TB-K3 (16) | E-84 (1) | ester (5) | 0.27 |
| Toner A4 | Cyan | Resin 4 (92) | TB-C4 (16) | E-84 (1) | ester (5) | 0.21 |
| | Magenta | Resin 4 (92) | TB-M4 (16) | E-84 (1) | ester (5) | 0.22 |
| | Yellow | Resin 4 (92) | TB-Y4 (16) | E-84 (1) | ester (5) | 0.35 |
| | Black | Resin 4 (92) | TB-K4 (16) | E-84 (1) | ester (5) | 0.31 |
| Toner A5 | Cyan | Resin 5 (92) | TB-C5 (16) | E-84 (1) | ester (5) | 0.73 |
| | Magenta | Resin 5 (92) | TB-M5 (16) | E-84 (1) | ester (5) | 0.87 |
| | Yellow | Resin 5 (92) | TB-Y5 (16) | E-84 (1) | ester (5) | 0.67 |
| | Black | Resin 5 (92) | TB-K5 (16) | E-84 (1) | ester (5) | 0.52 |
| Toner A6 | Cyan | Resin 6 (92) | TB-C6 (16) | E-84 (1) | ester (5) | 0.33 |
| | Magenta | Resin 6 (92) | TB-M6 (16) | E-84 (1) | ester (5) | 0.32 |
| | Yellow | Resin 6 (92) | TB-Y6 (16) | E-84 (1) | ester (5) | 0.43 |
| | Black | Resin 6 (92) | TB-K6 (16) | E-84 (1) | ester (5) | 0.41 |

*The numerical values in parentheses are values represented by the unit of "part by mass" or "parts by mass".

TABLE A2-2

| Toner No. | Toner | Binder resin | Masterbatch | Charge controlling agent | Wax | Amount of abietic acid contained in toner (% by mass) |
|---|---|---|---|---|---|---|
| Toner A7 | Cyan | Resin 7 (92) | TB-C7 (16) | E-84 (1) | ester (5) | 1.6 |
| | Magenta | Resin 7 (92) | TB-M7 (16) | E-84 (1) | ester (5) | 2.1 |
| | Yellow | Resin 7 (92) | TB-Y7 (16) | E-84 (1) | ester (5) | 1.23 |
| | Black | Resin 7 (92) | TB-K7 (16) | E-84 (1) | ester (5) | 1.98 |
| Toner A8 | Cyan | Resin 8 (92) | TB-C8 (16) | E-84 (1) | ester (5) | 3.02 |
| | Magenta | Resin 8 (92) | TB-M8 (16) | E-84 (1) | ester (5) | 2.01 |
| | Yellow | Resin 8 (92) | TB-Y8 (16) | E-84 (1) | ester (5) | 2.06 |
| | Black | Resin 8 (92) | TB-K8 (16) | E-84 (1) | ester (5) | 2.21 |
| Toner A9 | Cyan | Resin 9 (92) | TB-C9 (16) | E-84 (1) | ester (5) | 5.28 |
| | Magenta | Resin 9 (92) | TB-M9 (16) | E-84 (1) | ester (5) | 2.48 |

TABLE A2-2-continued

| Toner No. | Toner | Binder resin | Masterbatch | Charge controlling agent | Wax | Amount of abietic acid contained in toner (% by mass) |
|---|---|---|---|---|---|---|
| | Yellow | Resin 9 (92) | TB-Y9 (16) | E-84 (1) | ester (5) | 4.32 |
| | Black | Resin 9 (92) | TB-K9 (16) | E-84 (1) | ester (5) | 4.4 |
| Toner | Cyan | Resin 10 (92) | TB-C10 (16) | E-84 (1) | ester (5) | 0.32 |
| A10 | Magenta | Resin 10 (92) | TB-M10 (16) | E-84 (1) | ester (5) | 0.21 |
| | Yellow | Resin 10 (92) | TB-Y10 (16) | E-84 (1) | ester (5) | 0.33 |
| | Black | Resin 10 (92) | TB-K10 (16) | E-84 (1) | ester (5) | 0.21 |
| Toner | Cyan | Resin 11 (92) | TB-C11 (16) | E-84 (1) | ester (5) | 0.23 |
| A11 | Magenta | Resin 11 (92) | TB-M11 (16) | E-84 (1) | ester (5) | 0.22 |
| | Yellow | Resin 11 (92) | TB-Y11 (16) | E-84 (1) | ester (5) | 0.11 |
| | Black | Resin 11 (92) | TB-K11 (16) | E-84 (1) | ester (5) | 0.09 |
| Toner | Cyan | Resin 12 (92) | TB-C12 (16) | E-84 (1) | ester (5) | 0.12 |
| A12 | Magenta | Resin 12 (92) | TB-M12 (16) | E-84 (1) | ester (5) | 0.03 |
| | Yellow | Resin 12 (92) | TB-Y12 (16) | E-84 (1) | ester (5) | 0.11 |
| | Black | Resin 12 (92) | TB-K12 (16) | E-84 (1) | ester (5) | 0.12 |

*The numerical values in parentheses are values represented by the unit of "part by mass" or "parts by mass".

Examples A1 to A6, A13 to A14 and Comparative Examples A1 to A3 and A7

Figure 20:
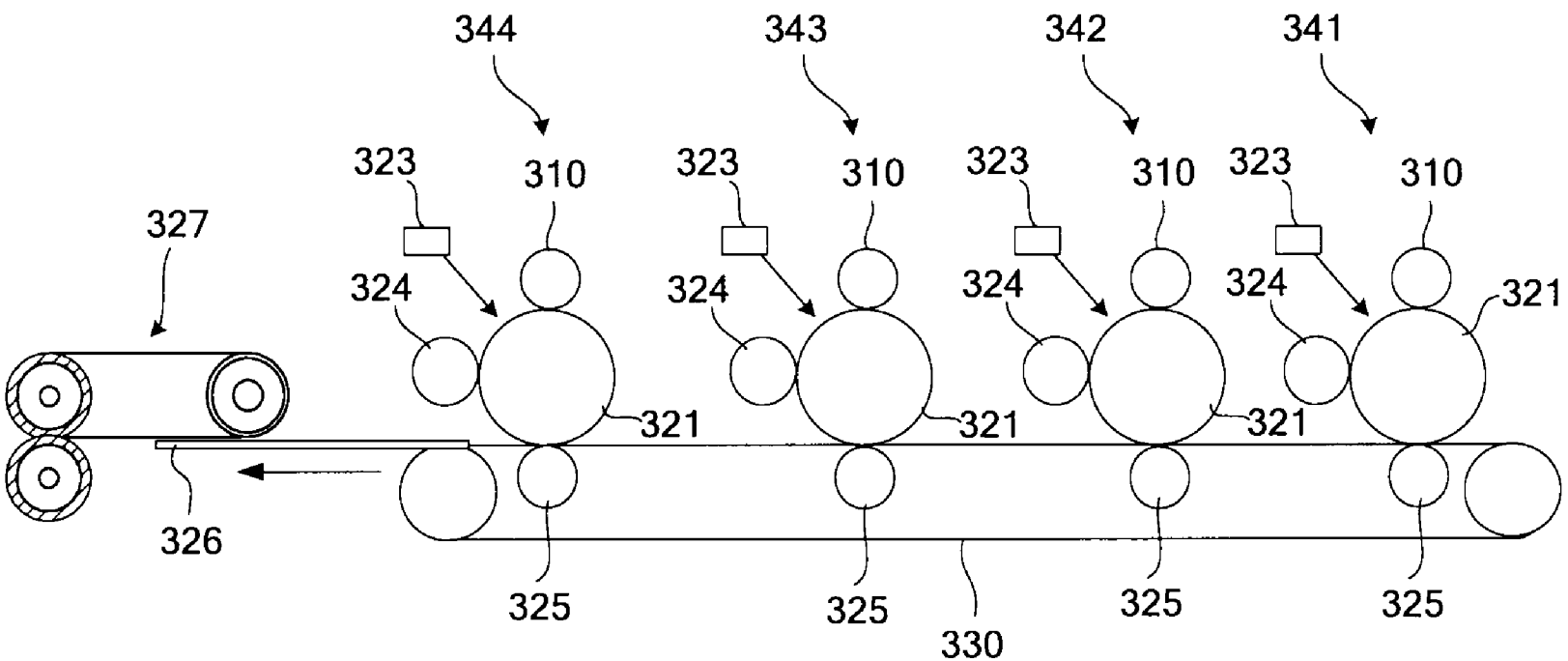
FIG. 20 is a schematic illustration showing an image forming apparatus used in after-mentioned EXAMPLES (evaluation apparatus A).

An image forming apparatus A as illustrated in FIG. 20 was charged with each of the produced toners A1 to A12 and then image formation was carried out. Thereafter, various properties of the toners were evaluated as follows. Table 3 shows the evaluation results.

<Image Forming Apparatus A>

The image forming apparatus A as illustrated in FIG. 20 is a direct transfer type tandem image forming apparatus employsing a contact charging system, a one-component developing system, a direct transfer system, a cleaner-less mode and a belt fixing system of internal heating type.

In the image forming apparatus A illustrated in FIG. 20, a charge roller of contact charging type as illustrated in FIG. 1 is employed as a charging unit 310; a one-component developing device as illustrated in FIG. 5, which employs a cleaner-less mode by which a residual toner can be collected, is employed as a developing unit 324; and as a fixing unit 327, a belt type fixing device as illustrated in FIG. 9 is employed which uses a halogen lamp as a heat source for a heat roller. Note that in FIG. 20, the numerical reference 330 denotes a conveyance belt.

An image forming element 341 in the image forming apparatus A in FIG. 20 is composed of a photoconductor drum 321, and provided with a charging unit 310, an exposing unit 323, a developing unit 324 and a transfer unit 325 around the periphery of the photoconductor drum 321. The surface of the photoconductor drum 321 in the image forming element 341 is subjected to charging process by the charging unit 310 and exposure process by the exposing unit 323 while being rotated, and a latent electrostatic image corresponding to the exposed image is developed on its surface. The latent electrostatic image is developed with a yellow toner by means of the developing unit 324 to thereby form a visible image of the yellow toner on the surface of the photoconductor drum 321. The visible image is transferred onto a recording medium 326 by means of the transfer unit 325. Then, a toner remaining on the surface of the photoconductor drum 321 is collected by the developing unit 324. Similarly to the above operation, on the recording medium 326, visible images of magenta toner, cyan toner and black toner are superimposed by each of image forming elements 324, 343 and 344, and a color image formed on the recording medium 326 is fixed on the fixing unit 327.

Examples A7 to A12, A15 to A16, and Comparative Examples A4 to A6 and A8

-Production of Carrier-

A coat material containing the following composition was dispersed using a stirrer for 10 minutes to prepare a coating solution, the coating solution and 5,000 parts by mass of a core material (Cu—Zn ferrite particles, mass average particle diameter=35 μm) were poured in a coating device, which is equipped with a rotary bottom plate disc and a stirring blade in its fluidized bed and performs coating while forming a spinning stream. Then, the coating solution was applied onto the core material to obtain a coated workpiece, and the coated workpiece was baked at 250° C. for 2 hours in an electric furnace, thereby producing a carrier.

| [Composition of coat material] | |
|---|---|
| toluene | 450 parts by mass |
| silicone resin (SR2400, produced by DOW CORNING TORAY SILICONE CO., LTD., amount of involatile fraction: 50% by mass) | 450 parts by mass |
| aminosilane (SH6020, produced by DOW CORNING TORAY SILICONE CO., LTD.) | 10 parts by mass |
| carbon black | 10 parts by mass |

-Preparation of Two-Component Developer-

Two-component developers constituted of 5% by mass of each of the produced toners A1 to A12 and 95% by mass of the produced carrier were prepared by a normal method.

-Image Formation and Evaluation-

Figure 21:
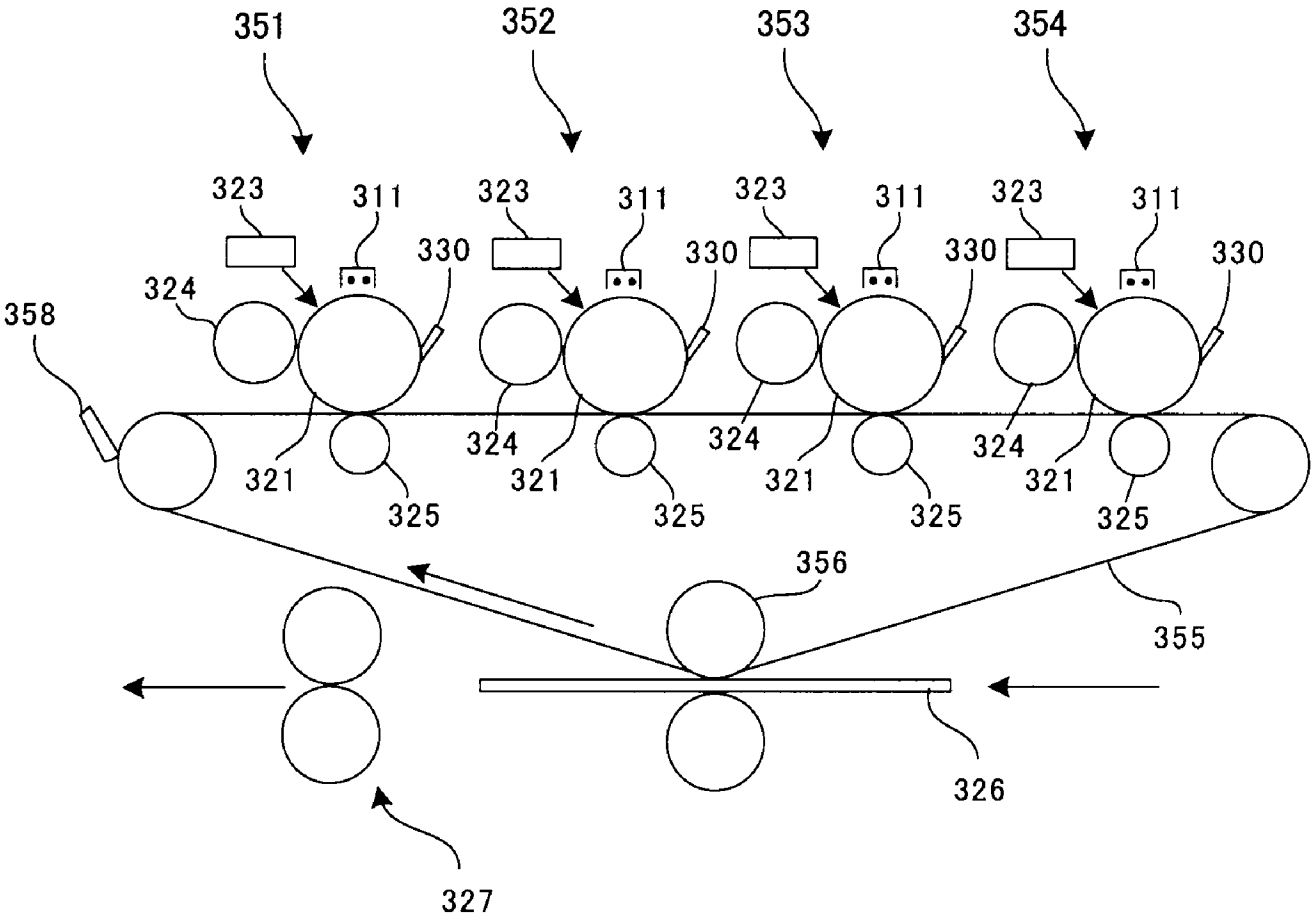
FIG. 21 is a schematic illustration showing another image forming apparatus used in after-mentioned EXAMPLES (evaluation apparatus B).

An image forming apparatus B as illustrated in FIG. 21 was charged with each of the prepared two-component developers. Thereafter, image forming was carried out. Similarly to the evaluations in Example 1 described above, printed images were evaluated with respect to carrier spent, chargeability and image quality. Table 3 shows the evaluation results.

<Image Forming Apparatus B>

The image forming apparatus B illustrated in FIG. 21 is an indirect transfer type tandem image forming apparatus employing a noncontact charging system, a two-component developing system, a secondary transfer system, a blade cleaning system, and a roller fixing system based on external heating mode.

In the image forming apparatus B in FIG. 21, a non-contact type corona charger as illustrated in FIG. 3 is employed as a charging unit 311; a two-component developing device as illustrated in FIG. 6 is employed as a developing unit 324; a cleaning blade as illustrated in FIG. 13 is employed as a cleaning unit 330; and as a fixing unit 327, a roller type fixing device based on an electromagnetic induction heating mode, as illustrated in FIG. 12, is employed.

An image forming element 351 in the image forming apparatus B illustrated in FIG. 21 is composed of a photoconductor drum 321, and provided with a charging unit 311, an exposing unit 323, a developing unit 324, a primary transfer unit 325 and a cleaning unit 330 around the periphery of the photoconductor drum 321. The surface of the photoconductor drum 321 in the image forming element 351 is subjected to charging process by the charging unit 310 and exposure process by the exposing unit 323 while being rotated, and a latent electrostatic image corresponding to the exposed image is developed on its surface. The latent electrostatic image is developed with a yellow toner by means of the developing unit 324 to thereby form a visible image of the yellow toner on the surface of the photoconductor drum 321. The visible image is transferred onto an intermediate transfer belt 355 by means of the primary transfer unit 325. Then, a yellow toner remaining on the surface of the photoconductor drum 321 is collected by the cleaning unit 330. Similarly to the above operation, visible images of magenta toner, cyan toner and black toner are formed on the intermediate transfer belt 355 by each of image forming elements 352, 353 and 354, and a color image on the intermediate transfer belt 355 is transferred onto a recording medium 326 by a transferring device 356, and toner remaining on the surface of the intermediate transfer belt 355 is removed by an intermediate transfer belt cleaning unit 358. The color image formed on the recording medium 326 is fixed by the fixing unit 327.

<Charged Amount Distribution>

A charged amount of printed images using each of the toners was determined in a 50,000-sheet output durability test. Under the environment of a temperature of 35° C. and a relative humidity of 95%, a chart having an image area ratio of 7% was continuously printed on 50,000 sheets of paper using each of the toners by a given image forming apparatus. With respect to the developer collected from a sleeve of a developing unit in the apparatus, a Q/d distribution (fC/μm) was measured by a charged amount distribution measurement device (E-SPART ANALYZER produced by Hosokawa Micron Co., Ltd.). Based on the measured value of Q/d distribution, a half width was calculated. As the measurement conditions of the E-SPART ANALYZER, the flow rate of nitrogen gas was set to 0.3 NL/min, and the gas pressure was set to an atmospheric pressure of 0.3. As to the index of the charged amount distribution, the charged amount distribution is indicated by a mode value (peak value) [q/d] and a width (half width) of a distribution at a half height position of the mode level (mode value) and evaluated based on the following criteria.

[Evaluation Criteria]

A: The mode value was 0.25 fC/μm or higher, and the half width was less than 0.2.

B: The mode value was 0.15 fC/μm or higher and less than 0.25 fC/μm, or the half width was 0.2 or higher and less than 0.3.

C: The mode value was less than 0.15 fC/μm, or the half width was 0.3 or higher.

<Carrier-spent Resistance>

The carrier-spent resistance was measured in an output durability test of 50,000 sheets using each of the toners. After a charge having an image area ratio of 7% was continuously printed on 50,000 sheets of paper using each of the toners by a given image forming apparatus, a developer used in the image formation was sampled from the image forming apparatus. An appropriate amount of the developer was placed in a gauge provided with a mesh having a sieve opening of 32 μm, followed by air-blowing treatment so as to separate toner from carrier. Into a 50 mL of glass bottle, 1.0 g of the obtained carrier was poured, and 10 mL of chloroform was added into the glass bottle. The glass bottle was shaken 50 times by hand and then left at rest for 10 minutes. Thereafter, the supernatant chloroform solution was poured into a glass cell, and the transmittance of the chloroform solution was measured using a turbidimeter, and the carrier-spent resistance was evaluated based on the following criteria.

[Evaluation Criteria]

A: The transmittance was 95% or higher.

B: The transmittance was 90% to 94%.

C: The transmittance was 80% to 89%.

D: The transmittance was 79% or lower.

<Image Quality>

To evaluate the image quality of output images, 50,000 sheets of image were output using a given image forming apparatus, and a change in color tone (tint), background smear, image density, and presence or absence of white-voids in the output images were evaluated. Presence or absence of abnormal images, and the quality of images were visually evaluated, and the results were classified into the following four grades.

[Evaluation Criteria]

A: Abnormal images were not observed at all, and the output images were excellent in quality.

B: A slight difference in color tone and image density, and occurrence of background smear were recognized when compared with the original image used, however, the output images were excellent in quality, without any problem in practical use.

C: A difference in color tone (tint) and image density, and occurrence of background smear were somewhat observed.

D: A difference in color tone (tint) and image density, and occurrence of background smear were clearly observed, causing a problem.

<Comprehensive Evaluation>

A: Excellent

B: Not practically usable

TABLE A3-1

| | Toner No. (Developer No.) | Image forming apparatus No. | Carrier-spent resistance | Chargeability | Image quality | Comprehensive evaluation |
|---|---|---|---|---|---|---|
| Ex. A1 | Toner A1 | A | — | B | A | A |
| Ex. A2 | Toner A2 | A | — | B | A | A |

TABLE A3-1-continued

| | Toner No. (Developer No.) | Image forming apparatus No. | Carrier-spent resistance | Chargeability | Image quality | Comprehensive evaluation |
|---|---|---|---|---|---|---|
| Ex. A3 | Toner A3 | A | — | B | B | A |
| Ex. A4 | Toner A4 | A | — | C | A | A |
| Ex. A5 | Toner A5 | A | — | B | B | A |
| Ex. A6 | Toner A6 | A | — | C | A | A |
| Ex. A7 | Developer A1 | B | A | B | A | A |
| Ex. A8 | Developer A2 | B | A | B | A | A |
| Ex. A9 | Developer A3 | B | B | B | B | A |
| Ex. A10 | Developer A4 | B | A | B | A | A |
| Ex. A11 | Developer A5 | B | B | B | B | A |
| Ex. A12 | Developer A6 | B | B | B | B | A |
| Ex. A13 | Toner A10 | A | — | B | B | A |
| Ex. A14 | Toner A11 | A | — | C | A | A |
| Ex. A15 | Developer A10 | B | B | B | B | A |
| Ex. A16 | Developer A11 | B | B | B | A | A |

TABLE A3-2

| | Toner No. (Developer No.) | Image forming apparatus No. | Carrier-spent resistance | Chargeability | Image quality | Comprehensive evaluation |
|---|---|---|---|---|---|---|
| Compara. Ex. A1 | Toner A7 | A | — | C | C | B |
| Compara. Ex. A2 | Toner A8 | A | — | D | B | B |
| Compara. Ex. A3 | Toner A9 | A | — | D | D | B |
| Compara. Ex. A4 | Developer A7 | B | D | C | C | B |
| Compara. Ex. A5 | Developer A8 | B | C | C | D | B |
| Compara. Ex. A6 | Developer A9 | B | D | D | D | B |
| Compara. Ex. A7 | Toner A12 | A | — | D | D | B |
| Compara. Ex. A8 | Developer A12 | B | D | D | D | B |

The evaluation results in Table 3 show that when a toner or developer with the amount of abietic acid controlled therein was used, no spent of carrier occurred, and a reduction in charged amount was not observed, and even after a long-time image formation process, the use of such a toner or developer made it possible to obtain images excellent in quality, without causing abnormal images such as transfer defect (in Examples A1 to A16). In contrast, when a toner, in which the amount of abietic acid had not been controlled, was used and a large amount of carrier remained in the toner, the carrier-spent resistance and chargeability of the toner degraded with time, and it was impossible to obtain images excellent in quality in long-time image formation (Comparative Examples A1 to A6). In the case of using a small amount of a rosin compound, the dispersibility of colorant was poor, the image quality was far from excellent even in the initial stage of image formation, and degradation with time of carrier-spent resistance was conspicuous due to the low-glass transition temperature of the resin used, resulting in a difficulty in forming images for a long time (Comparative Examples A7 and A8).

Synthesis Example B1

-Synthesis of Acrylic Acid-modified Rosin-

Into a 10 L flask equipped with a fractionating column, a reflux condenser, and a receiver, 5,312 g (16 moles) of unpurified tall rosin and 573.6 g (8 moles) of acrylic acid were added, the mixture was heated to a temperature ranging from 160° C. to 210° C. in 2 hours, the mixture was reacted at 210° C. for 3 hours and then further distilled at 210° C. under a reduced pressure of 4 kPa, thereby a rosin modified with acrylic acid (acrylic acid-modified rosin) was synthesized.

The amount of an abietic acid contained in the unpurified tall rosin which had been used in the production of the thus obtained acrylic acid-modified rosin was 34.9% by mass, and the amount of the abietic acid contained in the acrylic acid-modified rosin was 12.5% by mass.

Synthesis Example B2

-Synthesis of Itaconic Acid-modified Rosin-

Into a 10 L flask equipped with a fractionating column, a reflux condenser, and a receiver, 5,312 g (16 moles) of unpurified tall rosin which had been used in production of the acrylic acid-modified rosin, 5 and 104.8 g (8 moles) of itaconic acid were added, the mixture was heated to a temperature ranging from 160° C. to 210° C. in 2 hours, the mixture was reacted at 210° C. for 3 hours and then further distilled at 210° C. under a reduced pressure of 4 kPa, thereby a rosin modified with itaconic acid (itaconic acid-modified rosin) was synthesized.

The amount of an abietic acid contained in the thus obtained itaconic acid-modified rosin was 3.6% by mass.

Synthesis Example B3

-Synthesis of Fumaric Acid-modified Rosin-

Into a 10 L flask equipped with a fractionating column, a reflux condenser, and a receiver, 5,312 g (16 moles) of unpurified tall rosin which had been used in production of the acrylic acid-modified rosin, and 928 g (8 moles) of fumaric acid were added, the mixture was heated to a temperature ranging from 160° C. to 210° C. in 2 hours, the mixture was reacted at 210° C. for 3 hours, and then further distilled at 210° C. under a reduced pressure of 4 kPa, thereby a rosin modified with fumaric acid (fumaric acid-modified rosin) was synthesized.

The amount of an abietic acid contained in the thus obtained fumaric acid-modified rosin was 2.8% by mass.

Synthesis Example B4

-Synthesis of Resins A to C-

Into a 5 L four-necked flask equipped with a nitrogen inlet tube, a dehydration tube, a stirrer and a thermocouple, each alcohol component, each individual carboxylic acid component other than trimellitic acid anhydride, and each esterified catalyst, all of which are shown in the following Table B1-1 were added, the mixture was subjected to polycondensation reaction at 235° C. under nitrogen atmosphere for 15 hours and then reacted at 235° C. under a pressure of 8.0 kPa for 1 hour. The mixture was cooled to 210° C., and each trimellitic acid anhydride shown in Table B1-1 was put into the flask. The mixture was reacted at 210° C. under normal pressure (101.3 kPa) for 1 hour and further reacted at 210° C. under a pressure of 10 kPa until the temperature reached a desired softening point, thereby synthesizing each of polyester resins (Resins A to C).

Synthesis Example B5

-Synthesis of Resins D to F and Resins J to L-

Into a 5 L four-necked flask equipped with a nitrogen inlet tube, a dehydration tube, a fractionating column, a stirrer and a thermocouple, each alcohol component, each individual carboxylic acid component other than trimellitic acid anhydride (as to unpurified tall rosin, an unpurified tall rosin that had been used for production of the acrylic acid-modified rosin was used), and each esterified catalyst, all of which are shown in the following Tables B1-1 and B1-2 were added, the mixture was subjected to polycondensation reaction at 235° C. under nitrogen atmosphere for 10 hours and then reacted at 235° C. under a pressure of 8.0 kPa for 2 hours. The mixture was cooled to 210° C., and each trimellitic acid anhydride shown in Tables B1-1 and B1-2 was put into the flask. The mixture was reacted at 210° C. under normal pressure (101.3 kPa) for 2 hours and further reacted at 210° C. under a pressure of 20 kPa until the temperature reached a desired softening point, thereby synthesizing each of polyester resins (Resins D to F and Resins J to L).

Synthesis Example B6

-Synthesis of Resins G and H-

Into a 5 L four-necked flask equipped with a nitrogen inlet tube, a dehydration tube, a fractionating column, a stirrer and a thermocouple, each alcohol component, each individual carboxylic acid component other than trimellitic acid anhydride (as to unpurified tall rosin, an unpurified tall rosin that had been used for production of the acrylic acid-modified rosin was used), and each esterified catalyst, all of which are shown in the following Table B1-2 were added, the mixture was subjected to polycondensation reaction at 235° C. under nitrogen atmosphere for 10 hours and then reacted at 235° C. under a pressure of 8.0 kPa for 2 hours. The mixture was cooled to 210° C., and each trimellitic acid anhydride shown in Table B1-2 was put into the flask. The mixture was reacted at 210° C. under normal pressure (101.3 kPa) for 2 hours and further reacted at 210° C. under a pressure of 20 kPa while dropping water vapor (140° C.) at a dripping rate of 5 g/min until the temperature reached a desired softening point, thereby synthesizing each of polyester resins (Resins G and H). Note that the addition rate of water (5 g/min) corresponds to 0.11 parts by mass/min to 100 parts by mass of the obtained polyester resin, and the total amount of water dropped was 896 g i.e. 20 parts by mass to 100 parts by mass of the binder resin used.

Synthesis Example B7

-Synthesis of Resin I-

Into a 5 L four-necked flask equipped with a nitrogen inlet tube, a dehydration tube, a fractionating column, a stirrer and a thermocouple, each alcohol component, each individual carboxylic acid component other than unpurified tall rosin (as to unpurified tall rosin, an unpurified tall rosin that had been used for production of the acrylic acid-modified rosin was used), and each esterified catalyst, all of which are shown in the following Table B1-2 were added, the mixture was subjected to polycondensation reaction at 230° C. under nitrogen atmosphere for 15 hours and then reacted at 230° C. under a pressure of 8.0 kPa for 1 hour. The mixture was cooled to 180° C., and the unpurified tall rosin shown in Table B1-2 was put into the flask. The temperature of the mixture was raised to 210° C. in 3 hours, and the mixture was reacted under normal pressure (101.3 kPa) for 10 hours and further reacted at 210° C. under a pressure of 20 kPa until the temperature reached a desired softening point, thereby synthesizing a polyester resin (Resin I).

TABLE B1-1

| | | Resin A | Resin B | Resin C | Resin D | Resin E |
|---|---|---|---|---|---|---|
| Alcohol component | 1,2-propanediol | 1,142 g | 1,142 g | 1,142 g | 1,142 g | 914 g |
| | 1,3-propanediol | — | — | — | — | 228 g |

TABLE B1-1-continued

| | | Resin A | Resin B | Resin C | Resin D | Resin E |
|---|---|---|---|---|---|---|
| Carboxylic acid component | terephthalic acid | 1,743 g | 1,743 g | 1,743 g | 1,743 g | 1,743 g |
| | trimellitic acid anhydride | 288 g | 288 g | 288 g | 288 g | 288 g |
| | unpurified tall rosin | — | — | — | 1,743 g | 1,743 g |
| | acrylic acid-modified rosin | — | — | 1,743 g | — | — |
| | itaconic acid-modified rosin | — | 1,743 g | — | — | — |
| | fumaric acid-modified rosin | 1,743 g | — | — | — | — |
| Esterified catalyst | 2-ethylhexanoic acid tin (II) | 24.6 g (0.5) | 24.6 g (0.5) | 24.6 g (0.5) | 24.6 g (0.5) | 24.6 g (0.5) |
| Amount of aliphatic diol in divalent alcohol component (mole %) | | 100 | 100 | 100 | 100 | 100 |
| Amount of 1,2-PD in aliphatic diol (mole %) | | 100 | 100 | 100 | 100 | 80 |
| Amount of rosin compound (% by mass) (*2) | | 35 | 35 | 35 | 35 | 35 |
| Physical properties of Resin | Acid value (mgKOH/g) | 32.7 | 33.9 | 31.1 | 30.9 | 30.9 |
| | Softening point (° C.) | 105.8 | 105.4 | 103.7 | 105.0 | 105.0 |
| | Glass transition temperature (° C.) | 57.3 | 58.3 | 57.9 | 58.5 | 58.5 |

(*1): The numerical value in parentheses represents the mass ratio of the esterified catalyst used to 100 parts by mass of the total mass of the alcohol component and carboxylic acid component.
(*2): It represents the amount of the rosin compound contained in the total mass of alcohol component and carboxylic acid component.

TABLE B1-2

| | | Resin F | Resin G | Resin H | Resin I | Resin J | Resin K | Resin L |
|---|---|---|---|---|---|---|---|---|
| Alcohol component | 1,2-propanediol | 1,142 g | 1,142 g | 1,142 g | 1,142 g | 685 g | 685 g | 1,142 g |
| | 1,3-propanediol | — | — | — | — | — | 457 g | — |
| | BPA-PO* | — | — | — | — | 2,067 g | — | — |
| Carboxylic acid component | terephthalic acid | 1,992 g | 1,743 g | 2,132 g | 1,743 g | 1,379 g | 1,743 g | |
| | trimellitic acid anhydride | 288 g | 288 g | 288 g | 288 g | 288 g | 288 g | 1,595 g |
| | unpurified tall rosin | 250 g | 1,743 g | 110 g | 1,743 g | 2,420 g | 1,743 g | 1,482 g |
| | acrylic acid-modified rosin | — | — | — | — | — | — | — |
| | itaconic acid-modified rosin | — | — | — | — | — | — | — |
| | fumaric acid-modified rosin | — | — | — | — | — | — | — |
| Esterified catalyst | 2-ethylhexanoic acid tin (II) | 18.4 g (0.5) | 24.6 g (0.5) | 18.4 g (0.5) | 24.6 g (0.5) | 34.2 g (0.5) | 24.6 g (0.5) | 21.1 g (0.5) |
| Amount of aliphatic diol in divalent alcohol component (mole %) | | 100 | 100 | 100 | 100 | 100 | 100 | 100 |
| Amount of 1,2-PD in aliphatic diol (mole %) | | 100 | 100 | 100 | 100 | 100 | 60 | 100 |
| Amount of rosin compound (% by mass) (*2) | | 6.8 | 35 | 3 | 35 | 35 | 35 | 35 |
| Physical properties of Resin | Acid value (mgKOH/g) | 32.1 | 28.9 | 31.8 | 30.1 | 18.9 | 32.3 | 28.6 |
| | Softening point (° C.) | 102.8 | 104.1 | 103.0 | 103.2 | 110.6 | 105.2 | 112.5 |
| | Glass transition temperature (° C.) | 57.8 | 58.9 | 57.3 | 58.0 | 61.0 | 57.8 | 57.9 |

*BPA-PO: polyoxypropylene(2,2)-2,2-bis(4-hydroxyphenyl)propane
(*1): The numerical value in parentheses represents the mass ratio of the esterified catalyst used to 100 parts by mass of the total mass of the alcohol component and carboxylic acid component.
(*2): It represents the amount of the rosin compound contained in the total mass of alcohol component and carboxylic acid component.

Synthesis Example B8

-Synthesis of Resin M-

Into a 5 L four-necked flask equipped with a nitrogen inlet tube, a dehydration tube, a stirrer, a dropping funnel and a thermocouple, 748 g of terephthalic acid, 144 g of trimellitic acid anhydride, 1,808 g of bisphenol A (2,2) propyleneoxide, 712 g of bisphenol A (2,2) ethyleneoxide and 17 g of dibutyltin oxide as an esterified catalyst were added, and the mixture was reacted at 210° C. under nitrogen atmosphere and at a pressure of 10 kPa until the temperature of the mixture reached a desired softening point, thereby synthesizing a polyester resin (Resin M).

The Resin M had a softening point of 145.0° C., a glass transition temperature of 63.1° C., and an acid value of 12.2 mgKOH/g.

(Production Example of Charge Controlling Agent B1)

Three moles of 3,5-di-t-butylsalicylic acid and caustic soda were dissolved in water, and while the solution being stirred at 60° C., an aqueous solution containing 1.5 moles of ferric chloride ($FeCl_2$) was delivered by drops into the solution to thereby yield a crystal. The crystal was filtered, washed, dried and then pulverized to yield an aromatic oxycarboxylic acid metal compound 1 (CCA1) which was a powder of light black color. The structural formula of the aromatic oxycarboxylic acid metal compound 1 is described below.

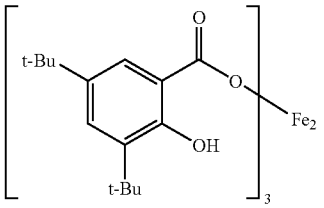

Structural Formula of aromatic oxycarboxylic acid metal compound 1

In the structural formula, the term "t-Bu" represents a tertiary butyl group.

(Production Example of Charge Controlling Agent B2)

Four moles of 3,5-di-t-butylsalicylic acid and caustic soda were dissolved in water, and while the solution being stirred at 50° C., an aqueous solution containing 1 mole of zirconium chloride ($ZrCl_2$) was delivered by drops into the solution to thereby yield a crystal. The crystal was filtered, washed, dried and then pulverized to yield an aromatic oxycarboxylic acid metal compound 2 (CCA2) which was a powder of white color. The structural formula of the aromatic oxycarboxylic acid metal compound 2 is described below.

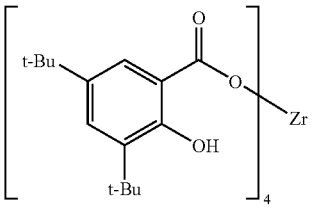

Structural Formula of aromatic oxycarboxylic acid metal compound 2

In the structural formula, the term "t-Bu" represents a tertiary butyl group.

(Production Example of Charge Controlling Agent B3)

Five moles of 3,5-di-t-butylsalicylic acid and caustic soda were dissolved in water, and while the solution being stirred at 50° C., an aqueous solution containing 4 moles of oxyzirconium chloride ($ZrOCl_2.8H_2O$) was delivered by drops into the solution to thereby yield a crystal. The crystal was filtered, washed, dried and then pulverized to yield an aromatic oxycarboxylic acid metal compound 3 (CCA3) which was a powder of white color. The structural formula of the aromatic oxycarboxylic acid metal compound 3 is described below.

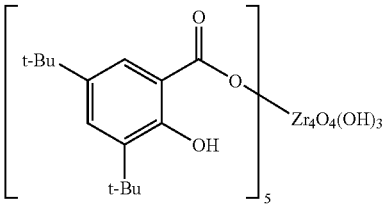

Structural Formula of aromatic oxycarboxylic acid metal compound 3

In the structural formula, the term "t-Bu" represents a tertiary butyl group.

(Production Example of Masterbatch B1)

A pigment, Resin A and pure water having the following formulation were mixed at a mixture ratio (mass ratio) of 1:1:0.5, and the mixture was kneaded using a twin-roll. The kneading was carried out at 70° C., and then the temperature of the twin-roll was raised to 120° C. to evaporate water in the kneaded mixture, thereby producing Black Masterbatch A (MK-A).

| [Formulation of Black Masterbatch A (MK-A)] | |
|---|---|
| Resin A | 100 parts by mass |
| black pigment (carbon black) | 100 parts by mass |
| pure water | 50 parts by mass |

(Production Example of Masterbatch B2)

Each of Black Masterbatches B to L (MK-B to MK-L) was produced in a similar manner to that of Production Example of Masterbatch B1, except that Resin A was replaced by each of Resins B to L (MK-B to MK-L).

(Production Example of Masterbatch B3)

Each of Cyan Masterbatch G (MC-G), Magenta Masterbatch G (MM-G), and Yellow Masterbatch G (MY-G) was produced in a similar manner to that of Production Example of Masterbatch B1, except that the masterbatch formulation was changed to each of the following formulations.

| [Formulation of Cyan Toner Masterbatch G (MC-G)] | |
|---|---|
| Resin G | 100 parts by mass |
| cyan pigment (C.I. Pigment blue 15:3) | 100 parts by mass |
| pure water | 50 parts by mass |

| [Formulation of Magenta Toner Masterbatch G (MM-G)] | |
|---|---|
| Resin G | 100 parts by mass |
| magenta pigment (C.I. Pigment red 122) | 100 parts by mass |
| pure water | 50 parts by mass |

| [Formulation of Yellow Toner Masterbatch G (MY-G)] | |
|---|---|
| Resin G | 100 parts by mass |
| yellow pigment (C.I. Pigment yellow 180) | 100 parts by mass |
| pure water | 50 parts by mass |

(Production Example of Carrier)

A carrier to be used in a two-component developer was produced in accordance with the following manner.

A coat material containing the following composition was dispersed using a stirrer for 10 minutes to prepare a coating solution, the coating solution and 5,000 parts by mass of a core material (Mn ferrite particles, mass average particle diameter=35 μm) were poured in a coating device, which is equipped with a rotary bottom plate disc and a stirring blade in its fluidized bed and performs coating while forming a spinning stream. Then, the coating solution was applied onto the core material to obtain a coated workpiece, and the coated workpiece was baked at 250° C. for 2 hours in an electric furnace, thereby producing a carrier A.

| [Composition of coat material] | |
|---|---|
| toluene | 450 parts by mass |
| silicone resin (SR2400, produced by DOW CORNING TORAY SILICONE CO., LTD., amount of involatile fraction: 50% by mass) | 450 parts by mass |
| aminosilane (SH6020, produced by DOW CORNING TORAY SILICONE CO., LTD.) | 10 parts by mass |
| carbon black | 10 parts by mass |

(Production Example of Toner B1)

A binder resin, a charge controlling agent, a wax and a masterbatch of materials of Toner B1 shown in the following Table B2, each in a formulate amount shown in Table B2, were preliminarily mixed using a HENSHEL mixer (FM10B, manufactured by Mitsui Miike Kakoki K.K.), then melted at a temperature of 100° C. to 130° C. and kneaded using a biaxial kneader (PCM-30, manufactured by IKEGAI LTD.). The kneaded workpiece was cooled to room temperature and then coarsely crushed using a hammer mill so as to have particle diameters of 200 μm to 300 μm. Subsequently, the workpiece was finely pulverized using a ultrasonic jet pulverizer LABO-JET (manufactured by Nippon Pneumatic Manufacturing Co., Ltd.) while appropriately adjusting the pulverization air pressure so as to have a weight average particle diameter of 6.2 μm±0.3 μm, and then classified by means of an airflow classifier (MDS-I, manufactured by Nippon Pneumatic Manufacturing Co., Ltd.) while appropriately adjusting the louver opening so that the amount of fine particles having a weight average particle diameter of 7.0 μm±0.2 μm and particle diameters of 4 μm or smaller was 10% by number or less to thereby produce toner base particles. Next, based on 100 parts by mass of the toner base particles, 1.0 part by mass of an additive (HDK-2000, produced by Clariant Japan K.K.) were mixed with stirring using a HENSHEL mixer, thereby producing Toner B1.

Note that "CCA4" described in Table B2 is a charge controlling agent (BONTRON E-84, produced by Orient Chemical Industries, Ltd.), which is a metal compound whose center metal is a divalent aromatic oxycarboxylic acid metal; "CCA5" is a charge controlling agent (BONTRON S-34, produced by Orient Chemical Industries, Ltd.), which is a metal compound whose center metal is a trivalent aromatic oxy-diazo metal; and "wax" is a carnauba wax having a melting point of 81° C. (produced by TOAGOSEI CO., LTD.).

(Production Examples of Toners B2 to B20)

Each of Toners B2 to B20 was produced in a similar manner to that of Production Example of Toner B1, except that the combination of the materials and the formulate amounts were changed to those shown in Table B2.

Thereafter, the obtained Toners B1 to B20 were evaluated with respect to charge build-up property and charge stability. Table B2 shows the evaluation results.

<Charge Build-Up Property>

Into a 20 mL polyvinyl container, 0.6 g of each of the produced toners and 9.4 g of the prepared carrier A were added, and the toner and carrier were stirred using a tubular mixer (Model T2F manufactured by Willy A. Bachofen (WAB)) at a stirring rate of 100 rpm for 15 seconds to thereby prepare a two-component developer. The charged amount (μC/g) of the obtained two-component developer was measured by a Q/M meter (EPPING GmbH). As to conditions of the Q/M meter, a 400-mesh in size (stainless steal) was employed, the soft blow pressure was set to 1,050 V, and the suction time was set to 90 seconds. The charged amount of the developer was determined based on the following Equation 1. Under the above-mentioned conditions, the higher the charged amount, the more excellent the charge build-up property becomes.

$$\text{Charged amount } (\mu C/g) = \text{total electrical quantity } (\mu C) \text{ measured after 90 seconds/amount of toner sucked } (g) \quad \text{[Equation 1]}$$

[Evaluation Criteria]

A: The charged amount was 33 μC/g or more.

B: The charged amount was 25 μC/g or more and less than 33 μC/g.

C: The charged amount was 20 μC/g or more and less than 25 μC/g.

D: The charged amount was 15 μC/g or more and less than 20 μC/g.

E: The charged amount was less than 15 μC/g.

<Charge Stability>

Into a 20 mL polyvinyl container, 0.6 g of each of the produced toners and 9.4 g of the prepared carrier A were added, and the toner and carrier were stirred using a tubular mixer (Model T2F manufactured by Willy A. Bachofen (WAB)) at a stirring rate of 100 rpm for 120 minutes to thereby prepare a two-component developer. The charged amount (μC/g) of the obtained two-component developer was measured by a Q/M meter (EPPING GmbH). As to conditions of the Q/M meter, a 400-mesh in size (stainless steal) was employed, the soft blow pressure was set to 1,050V, and the suction time was set to 90 seconds. The charged amount of the developer was determined based on the Equation 1 described above. Further, the charged amount of the developer was measured in a similar manner to the procedures described above, except that the toner and carrier were stirred by a tubular mixer at a stirring rate of 100 rpm for 10 minutes. This charged amount is defined as $Q_{10}$. As an index of the charged amount of toner measured when degraded, the charge decrease rate of toner when degraded was determined based on the following Equation 2. The lower the charge decrease rate, the higher the charge stability can be obtained even when the toner is degraded by mechanical stress.

$$\text{Charge decrease rate } (\%) = (Q_{120}(\mu C/g)/Q_{10}(\mu C/g)) \times 100$$

[Evaluation Criteria]

A: The charge decrease rate was less than 10%.

B: The charge decrease rate was 10% or more and less than 20%.

C: The charge decrease rate was 20% or more and less than 35%.

D: The charge decrease rate was 35% or more and less than 55%.

E: The charge decrease rate was 55% or more.

TABLE B2

| | Toner Material and Formulation | | | | | Physical Properties of Toner | | | |
|---|---|---|---|---|---|---|---|---|---|
| | Binder Resin 1 | Binder Resin 2 | Charge controlling agent | Wax | Masterbatch | Weight average particle diameter (μm) | Amount of abietic acid contained in toner (% by mass) | Charge build-up property | Charge stability |
| Toner B1 | Resin A (80) | Resin M (10) | CCA1 (1) | wax (5) | MK-A (20) | 6.8 | 0.2 | B | A |
| Toner B2 | Resin B (80) | Resin M (10) | CCA1 (1) | wax (5) | MK-B (20) | 7.1 | 0.2 | B | A |
| Toner B3 | Resin C (80) | Resin M (10) | CCA1 (1) | wax (5) | MK-C (20) | 7.1 | 0.3 | B | A |
| Toner B4 | Resin D (80) | Resin M (10) | CCA1 (1) | wax (5) | MK-D (20) | 7.1 | 0.9 | B | B |
| Toner B5 | Resin E (80) | Resin M (10) | CCA1 (1) | wax (5) | MK-E (20) | 6.9 | 0.5 | B | A |
| Toner B6 | Resin F (80) | Resin M (10) | CCA1 (1) | wax (5) | MK-F (20) | 7.0 | 0.1 | B | A |

TABLE B2-continued

| | Toner Material and Formulation | | | | | Physical Properties of Toner | | | |
|---|---|---|---|---|---|---|---|---|---|
| | Binder Resin 1 | Binder Resin 2 | Charge controlling agent | Wax | Masterbatch | Weight average particle diameter (μm) | Amount of abietic acid contained in toner (% by mass) | Charge build-up property | Charge stability |
| Toner B7 | Resin G (80) | Resin M (10) | CCA1 (1) | wax (5) | MK-G (20) | 7.0 | 0.1 | B | A |
| Toner B8 | Resin G (80) | Resin M (10) | CCA2 (1) | wax (5) | MK-G (20) | 7.0 | 0.1 | A | A |
| Toner B9 | Resin G (80) | Resin M (10) | CCA3 (1) | wax (5) | MK-G (20) | 6.9 | 0.1 | A | A |
| Toner B10 | Resin G (80) | Resin M (10) | CCA3 (1) | wax (5) | MC-G (20) | 7.1 | 0.2 | A | A |
| Toner B11 | Resin G (80) | Resin M (10) | CCA3 (1) | wax (5) | MM-G (20) | 6.9 | 0.1 | A | A |
| Toner B12 | Resin G (80) | Resin M (10) | CCA3 (1) | wax (5) | MY-G (20) | 7.0 | 0.1 | A | A |
| Toner B13 | Resin G (80) | Resin M (10) | — | wax (5) | MK-G (20) | 7.0 | 0.1 | D | B |
| Toner B14 | Resin G (80) | Resin M (10) | CCA4 (1) | wax (5) | MK-G (20) | 6.9 | 0.1 | B | C |
| Toner B15 | Resin G (80) | Resin M (10) | CCA5 (1) | wax (5) | MK-G (20) | 7.0 | 0.1 | B | C |
| Toner B16 | Resin H (80) | Resin M (10) | CCA1 (1) | wax (5) | MK-H (20) | 7.0 | 0 | B | A |
| Toner B17 | Resin I (80) | Resin M (10) | CCA1 (1) | wax (5) | MK-I (20) | 7.0 | 5.7 | C | E |
| Toner B18 | Resin J (80) | Resin M (10) | CCA1 (1) | wax (5) | MK-J (20) | 7.0 | 0.8 | B | B |
| Toner B19 | Resin K (80) | Resin M (10) | CCA1 (1) | wax (5) | MK-K (20) | 7.0 | 0.9 | B | B |
| Toner B20 | Resin L (80) | Resin M (10) | CCA1 (1) | wax (5) | MK-L (20) | 7.0 | 0.8 | B | B |

*In Table B2, a value in parentheses represents the formulate amount (part(s) by mass).

Examples B1 to B15 and Comparative Examples B1 to B5

Two-component developers were produced using each of the toners shown in Table B3 in accordance with the following manner. Subsequently, an after-mentioned image forming apparatus (evaluation apparatus A) was charged with each of the two-component developers, and then image formation was carried out. Various physical properties were evaluated as follows. Table B3 shows the evaluation results.

-Preparation of Two-Component Developer-

Based on 100 parts by mass of the produced carrier A (ferrite carrier having an average particle diameter of 35 μm, which was coated with a silicone resin in an average thickness of 0.5 μm), 7 parts by mass of each of the toners were used, and the carrier A and the toner were uniformly mixed using a tubular mixer (manufactured by Willy A. Bachofen (WAB)), in which a container itself is tumbled so that contents therein are stirred, at 48 rpm for 3 minutes so as to charge the toner.

-Evaluation Apparatus A-

For the image forming apparatus A, a digital complex apparatus, IMAGIO MP 7500 (manufactured by Ricoh Company Ltd.; copying speed 75 sheets/A4 size lateral width) was used, which is an image forming apparatus employing a contact charging system, a one-component developing system, a blade cleaning system and a roller fixing system of internal heating type.

<Initial Transfer Rate>

A solid image (30 mm×80 mm) was transferred on a paper sheet, Type 6200 Paper produced by Ricoh Company Ltd., with a toner adhesion amount (amount of each toner before transfer) of 0.80 mg/cm$^2$±0.1 mg/cm$^2$, then the operation of the apparatus was stopped immediately after the transfer process, and an untransferred toner remaining on the photoconductor surface was transferred to a tape whose weight had been weighed beforehand to thereby measure the amount of the untransferred toner. The transfer rate was calculated based on the following Equation 3, and the calculated value was determined as an initial transfer rate.

$$\text{Transfer rate (\%)}=((\text{amount of toner before transfer}-\text{amount of untransferred toner})/(\text{amount of toner before transfer}))\times 100 \quad \text{Equation 3}$$

[Evaluation Criteria]

A: The transfer rate was 95% or more.

B: The transfer rate was 88% or more and less than 95%.

C: The transfer rate was 80% or more and less than 88%.

D: The transfer rate was 65% or more and less than 80%.

E: The transfer rate was less than 65%.

<Temporal Transfer Rate>

After continuously outputting 50,000 sheets of an image chart with an image area ratio of 20% using the evaluation apparatus A, the transfer rate of each of the toners was measured in a similar manner to that used in the initial transfer rate, and the measured transfer rate was determined as a temporal transfer rate.

[Evaluation Criteria]

A: The transfer rate was 90% or more.

B: The transfer rate was 85% or more and less than 90%.

C: The transfer rate was 78% or more and less than 85%.

D: The transfer rate was 60% or more and less than 78%.

E: The transfer rate was less than 60%.

<Internal Voids in Characters>

After continuously outputting 50,000 sheets of an image chart with an image area ratio of 20% using the evaluation apparatus A, an image having character portions was output on an OHP sheet of Type DX manufactured by Ricoh Company Ltd. Then, the output image was compared with grade samples on a frequency of untransferred toner which invites line images of characters with hollow defects (internal voids) and evaluated.

[Evaluation Criteria]

A: No internal void was observed in the characters.

B: Internal voids were slightly observed in the characters.

C: Internal voids occurred as frequently as found in electrophotographic images printed by conventional electrophotography.

D: Internal voids were observed in large part of the characters.

E: Internal voids were frequently observed in significant part of the characters.

<Image Density Decrease Rate>

A solid image was output on a paper sheet of Type 6200 Paper using the evaluation apparatus A, and the initial image density of the output image was measured by an image densitometer, X-RITE 938 (manufactured by X-Rite Inc.). Subsequently, after continuously outputting 50,000 sheets of an image chart with an image area ratio of 20%, the solid image was output and the image density was measured similarly to the method described above, and the temporal image density was measured. The decrease rate was calculated based on the following Equation 4, and the value was determined as an image density decrease rate.

$$\text{Image density decrease rate (\%)}=((\text{initial image density}-\text{temporal image density})/(\text{initial image density}))\times 100 \quad \text{Equation 4}$$

[Evaluation Criteria]

A: The image density decrease rate was less than 5%.

B: The image density decrease rate was 5% or more and less than 10%.

C: The image density decrease rate was 10% or more and less than 15%.

D: The image density decrease rate was 15% or more and less than 25%.

E: The image density decrease rate was 25% or more.

<Fogging>

After continuously outputting 10,000 sheets of an image chart with an image area ratio of 5% using the evaluation apparatus A under the environment of 10° C. and a relative humidity of 15%, a thin-line image with 600 dpi at photoconductor image surface was output on a paper sheet of Type 6000 Paper manufactured by Ricoh Company Ltd., and the image densities of non-image portions were measured by a colorimeter, X-RITE 938 (manufactured by X-Rite Inc.).

[Evaluation Criteria]

A: The image density was less than 0.003.

B: The image density was 0.003 to 0.01.

C: The image density was 0.011 to 0.015.

D: The image density was 0.015 to 0.030.

E: The image density was 0.031 or more.

<Contamination of Carrier>

A developer after continuously outputting 100 sheets of an image chart with an image area ratio of 20% using the evaluation apparatus A and a developer after continuously outputting 70,000 sheets of the image chart using the evaluation apparatus A were sampled. An appropriate amount of each of the developers was poured in a gauge provided with a mesh having a sieve opening of 32 μm, followed by air-blowing treatment so as to separate toner from carrier. Into a 50 mL of glass bottle, 1.0 g of the carrier obtained from the developer that had been sampled in the initial stage of image formation was poured, and 10 mL of chloroform was added into the glass bottle. The glass bottle was shaken 50 times by hand and then left at rest for 10 minutes. Thereafter, the supernatant chloroform solution was poured into a glass cell, and the transmittance of the chloroform solution was measured using a turbidimeter.

Subsequently, the carrier obtained from the developer that had been sampled in the later stage was also used and treated similarly to the manner of the developer sampled in the initial stage of image formation to obtain a supernatant chloroform solution. The supernatant chloroform solution was poured in a glass cell, and the transmittance of the chloroform solution was measured using the turbidimeter, and the transmittance was employed as an index of contamination caused by carrier. The higher the transmittance, the lesser the carrier contamination becomes.

[Evaluation Criteria]

A: The transmittance was 95% or higher.

B: The transmittance was 90% or higher and less than 95%.

C: The transmittance was 80% or higher and less than 90%.

D: The transmittance was 70% or higher and less than 80%.

E: The transmittance was less than 70%.

Example B16 and Comparative Examples B6 to B7

In place of the evaluation apparatus A, an after-mentioned image forming apparatus B (evaluation apparatus B) was used and charged with each of the toners shown in Table B3, and evaluations of various properties other than carrier contamination on each of the toners were carried out in similar manners to those of Example B1. Besides the evaluations, evaluation of charge roller contamination was additionally carried out. Table B3 shows the evaluation results.

<Evaluation Apparatus B>

For the image forming apparatus B, a digital complex apparatus, IMAGIO NEO C 200 (manufactured by Ricoh Company Ltd.; copying speed 20 sheets/A4 size lateral width) was used, which is an image forming apparatus employing a contact charging system, a one-component developing system, an intermediate transfer system, a blade cleaning system and a belt fixing system of internal heating type.

<Contaminationo of Charge Roller>

After continuously outputting 50,000 sheets of an image chart with an image area ratio of 20% in monochrome mode using the evaluation apparatus B, the state of contamination with toner on the surface of the charge roller in the developing device was evaluated based on grade samples. In view of presence or absence of abnormal output images, the results were classified into the following 5 grades.

[Evaluation Criteria]

A: Abnormal images were not observed at all, and no toner contamination was found on the charge roller.

B: Abnormal images were not observed at all, however, the charge roller surface was lightly coated with toner.

C: Very slight occurrence of abnormal images was observed, and toner contamination on the charge roller was clearly evident.

D: Occurrence of abnormal images was clearly observed, and toner contamination on the charge roller was conspicuous, resulting in a problematic level.

E: Occurrence of abnormal images was clearly observed, toner contamination on the charge roller was conspicuous, and it was impossible to obtain normal images.

TABLE B3

| | | | | Evaluation in later stage | | | | | |
|---|---|---|---|---|---|---|---|---|---|
| | Toner | Evaluation apparatus | Evaluation in initial stage Transfer rate | Transfer rate | Internal voids in characters | Reduction in image density | Fogging | Carrier contamination | Contamination of charge roller |
| Ex. B1 | Toner B1 | A | B | B | B | A | A | A | — |
| Ex. B2 | Toner B2 | A | B | B | B | A | A | A | — |
| Ex. B3 | Toner B3 | A | A | B | B | A | A | A | — |
| Ex. B4 | Toner B4 | A | B | B | B | B | B | B | — |

TABLE B3-continued

| | Toner | Evaluation apparatus | Evaluation in initial stage Transfer rate | Evaluation in later stage: Transfer rate | Internal voids in characters | Reduction in image density | Fogging | Carrier contamination | Contamination of charge roller |
|---|---|---|---|---|---|---|---|---|---|
| Ex. B5 | Toner B5 | A | B | B | B | A | B | B | — |
| Ex. B6 | Toner B6 | A | B | B | B | B | C | A | — |
| Ex. B7 | Toner B7 | A | B | B | B | A | A | A | — |
| Ex. B8 | Toner B8 | A | B | B | B | A | A | A | — |
| Ex. B9 | Toner B9 | A | A | A | A | B | A | A | — |
| Ex. B10 | Toner B10 | A | A | A | A | B | A | A | — |
| Ex. B11 | Toner B11 | A | A | A | A | B | A | A | — |
| Ex. B12 | Toner B12 | A | A | A | A | B | A | A | — |
| Ex. B13 | Toner B18 | A | B | B | B | B | C | A | — |
| Ex. B14 | Toner B19 | A | B | B | B | B | B | C | — |
| Ex. B15 | Toner B20 | A | B | B | B | B | C | A | — |
| Ex. B16 | Toner B7 | B | B | B | B | B | A | — | B |
| Comp. Ex. B1 | Toner B13 | A | B | B | B | C | D | A | — |
| Comp. Ex. B2 | Toner B14 | A | B | C | C | C | D | A | — |
| Comp. Ex. B3 | Toner B15 | A | B | C | C | D | C | B | — |
| Comp. Ex. B4 | Toner B16 | A | C | C | C | C | D | A | — |
| Comp. Ex. B5 | Toner B17 | A | C | D | D | D | E | D | — |
| Comp. Ex. B6 | Toner B17 | B | C | E | E | D | E | — | D |
| Comp. Ex. B7 | Toner B13 | B | B | C | C | D | E | — | B |

Synthesis Example C1

-Purification of Rosin-

Into a 2,000 mL-distillation flask equipped with a fractionating column, a reflux condenser and a receiver, 1,000 g of tall rosin was added, the rosin was subjected to distillation under a reduced pressure of 1 kPa, and the distillate obtained at 195° C. to 250° C. was sampled as a main fraction. Hereinafter, the tall rosin used in the purification process is referred to as "unpurified rosin", and the rosin sampled as a main fraction is referred to as "purified rosin A".

Twenty grams of each rosin was pulverized by a coffee mill (National MK-61M) for 5 seconds, then sieved through a sieve with openings of 1 mm, and 0.5 g of the sieved powder was weighed in a head space vial (20 mL) so as to sample a head space gas. Using the head space gas, impurities in the unpurified rosin and impurities in the purified rosin A were analyzed by the head space GC-MS method under the following conditions. Table C1 shows the analysis results.

<Measurement Conditions of Head Space GC-MS Method>

A. Head Space Sampler (HP7694, Manufactured by Agilent Technologies)

temperature of sample: 200° C.
loop temperature: 200° C.
transfer line temperature: 200° C.
equilibration time for heating sample: 30 minutes
gas used for pressurizing vial: helium (He)
time spent for pressurizing vial: 0.3 minutes
time spent for loop loading: 0.03 minutes
time spent for loop equilibration: 0.3 minutes
injection time: 1 minute B. GC (Gas Chromatography) (HP6890, Manufactured by Agilent Technologies)

column used in analysis: DB-1 (60 mm-320 μm-5 μm)
carrier: helium (He)
flow rate: 1 mL/min
inlet temperature: 210° C.
pressure applied to column head: 34.2 kPa
injection mode: split
split ratio: 10:1
temperature condition of oven: 45° C. (3 min)-10° C./min-280° C. (15 min)

C. MS (Mass Spectrography) (Mass Spectrometer, HP5973, Manufactured by Agilent Technologies)

ionization method: EI (electron impact) method
temperature at interface: 280° C.
temperature of ion source: 230° C.
quadrupole temperature: 150° C.
detection mode: Scan 29 m/s to 350 m/s

TABLE C1

| | hexanoic acid | pentanoic acid | benzaldehyde | n-hexanal | 2-pentylfuran | SP value (° C.) softening point (° C.) | Acid value (mgKOH/g) | molecular mass/mole |
|---|---|---|---|---|---|---|---|---|
| Unpurified rosin | $0.9 \times 10^7$ | $0.6 \times 10^7$ | $0.6 \times 10^7$ | $1.8 \times 10^7$ | $1.1 \times 10^7$ | 77.0<br>74.3 | 169 | 332 |
| Purified rosin A | $0.4 \times 10^7$ | $0.2 \times 10^7$ | $0.2 \times 10^7$ | $1.4 \times 10^7$ | $0.7 \times 10^7$ | 76.8<br>75.1 | 166 | 338 |

Synthesis Example C2

-Synthesis of Acrylic Acid-modified Rosin-

Into a 10 L flask equipped with a fractionating column, a reflux condenser, and a receiver, 5,312 g (16 moles) of an unpurified tall rosin and 573.6 g (8 moles) of acrylic acid were added, the mixture was heated to a temperature ranging from 160° C. to 210° C. in 2 hours, the mixture was reacted at 210° C. for 3 hours, and then distilled at 210° C. under a reduced pressure of 4 kPa, thereby a rosin modified with acrylic acid (acrylic acid-modified rosin) was synthesized.

The amount of an abietic acid contained in the unpurified tall rosin which had been used in the production of the thus obtained acrylic acid-modified rosin was 34.9% by mass, and the amount of the abietic acid contained in the acrylic acid-modified rosin was 12.5% by mass.

Synthesis Example C3

-Synthesis of Itaconic Acid-Modified Rosin-

Into a 10 L flask equipped with a fractionating column, a reflux condenser, and a receiver, 5,312 g (16 moles) of an unpurified tall rosin which had been used in production of the acrylic acid-modified rosin, and 1,040.8 g (8 moles) of itaconic acid were added, the mixture was heated to a temperature ranging from 160° C. to 210° C. in 2 hours, the mixture was reacted at 210° C. for 3 hours, and then distilled at 210° C. under a reduced pressure of 4 kPa, thereby a rosin modified with itaconic acid (itaconic acid-modified rosin) was synthesized.

The amount of an abietic acid contained in the thus obtained itaconic acid-modified rosin was 3.6% by mass.

Synthesis Example C4

-Synthesis of Fumaric Acid-Modified Rosin-

Into a 10 L flask equipped with a fractionating column, a reflux condenser, and a receiver, 5,312 g (16 moles) of an unpurified tall rosin which had been used in production of the acrylic acid-modified rosin, and 928 g (8 moles) of fumaric acid were added, the mixture was heated to a temperature ranging from 160° C. to 210° C. in 2 hours, the mixture was reacted at 210° C. for 3 hours, and then distilled at 210° C. under a reduced pressure of 4 kPa, thereby a rosin modified with fumaric acid (fumaric acid-modified rosin) was synthesized. The amount of the abietic acid contained in the thus obtained fumaric acid-modified rosin was 2.8% by mass.

Synthesis Example C5

-Synthesis of Resins A to C-

Into a 5 L four-necked flask equipped with a nitrogen inlet tube, a dehydration tube, a stirrer and a thermocouple, each alcohol component, each individual carboxylic acid component other than trimellitic acid anhydride, and each esterified catalyst, all of which are shown in the following Table C2-1 were added, the mixture was subjected to polycondensation reaction at 235° C. under nitrogen atmosphere for 15 hours and then reacted at 235° C. under a pressure of 8.0 kPa for 1 hour. The mixture was cooled to 210° C., and each trimellitic acid anhydride shown in Table C2-1 was put into the flask. The mixture was reacted at 210° C. under normal pressure (101.3 kPa) for 1 hour and further reacted at 210° C. under a pressure of 10 kPa until the temperature reached a desired softening point, thereby synthesizing each of polyester resins (Resins A to C).

Synthesis Example C6

-Synthesis of Resins D to I-

Into a 5 L four-necked flask equipped with a nitrogen inlet tube, a dehydration tube, a fractionating column, a stirrer and a thermocouple, each alcohol component, each individual carboxylic acid component other than trimellitic acid anhydride (as to unpurified tall rosin, an unpurified tall rosin which had been used in production of the acrylic acid-modified rosin was used), and each esterified catalyst, all of which are shown in the following Tables C2-1 and C2-2 were added, the mixture was subjected to polycondensation reaction at 235° C. under nitrogen atmosphere for 10 hours and then reacted at 235° C. under a pressure of 8.0 kPa for 2 hours. The mixture was cooled to 210° C., and each trimellitic acid anhydride shown in Tables C2-1 and C2-2 was put into the flask. The mixture was reacted at 210° C. under normal pressure (101.3 kPa) for 2 hours and further reacted at 210° C. under a pressure of 20 kPa until the temperature reached a desired softening point, thereby synthesizing each of polyester resins (Resins D to I).

Synthesis Example C7

-Synthesis of Resins J and K-

Into a 5 L four-necked flask equipped with a nitrogen inlet tube, a dehydration tube, a fractionating column, a stirrer and a thermocouple, each alcohol component, a carboxylic acid component other than trimellitic acid anhydride (as to unpurified tall rosin, an unpurified tall rosin which had been used in production of the acrylic acid-modified rosin was used), and each esterified catalyst, all of which are shown in the following Table C2-2 were added, the mixture was subjected to polycondensation reaction at 235° C. under nitrogen atmosphere for 10 hours and then reacted at 235° C. under a pressure of 8.0 kPa for 2 hours. The mixture was cooled to 210° C., and each trimellitic acid anhydride shown in Table C2-2 was put into the flask. The mixture was reacted at 210° C. under normal pressure (101.3 kPa) for 2 hours and further reacted at 210° C. under a pressure of 20 kPa while dropping water vapor (140° C.) at a dripping rate of 5 g/min (water vapor distillation) until the temperature reached a desired softening point, thereby synthesizing each of polyester resins (Resins J and K). Note that the addition rate of water (5 g/min) corresponds to 0.11 parts by mass/min per 100 parts by mass of the obtained polyester resin, and the total amount of water dropped was 896 g i.e. 20 parts by mass per 100 parts by mass of the binder resin used.

Synthesis Example C8

-Synthesis of Resin L-

Into a 5 L four-necked flask equipped with a nitrogen inlet tube, a dehydration tube, a fractionating column, a stirrer and a thermocouple, the alcohol component, the carboxylic acid component other than unpurified tall rosin (as to the unpurified tall rosin, an unpurified tall rosin which had been used in production of the acrylic acid-modified rosin was used), and the esterified catalyst, all of which are shown in the following Table C2-2 were added, the mixture was subjected to polycondensation reaction at 230° C. under nitrogen atmosphere for 15 hours and then reacted at 230° C. under a pressure of 8.0 kPa for 1 hour. The mixture was cooled to 180° C., and the unpurified tall rosin shown in Table C2-2 was put into the flask. The temperature of the mixture was raised to 210° C. in 3 hours, reacted under normal pressure (101.3 kPa) for 10 hours and further reacted at 210° C. under a pressure of 20 kPa until the temperature reached a desired softening point, thereby synthesizing a polyester resins (Resin L).

TABLE C2-1

| | | Resin A | Resin B | Resin C | Resin D | Resin E | Resin F |
|---|---|---|---|---|---|---|---|
| Alcohol component | 2,2-bis(p-hydroxyphenyl)propane | — | — | — | — | — | — |
| | 1,2-propanediol | 1,142 g | 1,142 g | 1,142 g | 1,142 g | 914 g | 514 g |
| | 1,3-propanediol | — | — | — | — | 228 g | 628 g |
| Carboxylic acid component | terephthalic acid | 1,743 g | 1,743 g | 1,743 g | 1,743 g | 1,743 g | 1,743 g |
| | trimellitic acid anhydride | 288 g | 288 g | 288 g | 288 g | 288 g | 288 g |
| | unpurified tall rosin | — | — | — | 1,743 g | 1,743 g | 1,743 g |
| | acrylic acid-modified rosin | — | — | 1,743 g | — | — | — |
| | itaconic acid-modified rosin | — | 1,743 g | — | — | — | — |
| | fumaric acid-modified rosin | 1,743 g | — | — | — | — | — |
| | purified rosin A | — | — | — | — | — | — |
| Esterified catalyst | 2-ethylhexanoic acid tin (II) (*1) | 24.6 g (0.5) | 24.6 g (0.5) | 24.6 g (0.5) | 24.6 g (0.5) | 24.6 g (0.5) | 24.6 g (0.5) |
| Amount of aliphatic diol in divalent alcohol component (mole %) | | 100 | 100 | 100 | 100 | 100 | 100 |
| Amount of 1,2-PD in aliphatic diol (mole %) | | | 100 | 100 | 100 | 80 | 55 |
| Amount of rosin compound (% by mass) (*2) | | 35 | 35 | 35 | 35 | 35 | 29 |
| Physical properties of Resin | Acid value (mgKOH/g) | 32.7 | 33.9 | 31.1 | 30.9 | 30.9 | 30.2 |
| | Softening point (° C.) | 105.8 | 105.4 | 103.7 | 105.0 | 105.0 | 101.4 |
| | Glass transition temperature (° C.) | 57.3 | 58.3 | 57.9 | 58.5 | 58.5 | 53.2 |

(*1): The numerical value in parentheses represents the mass ratio of the esterified catalyst used to 100 parts by mass of the total mass of the alcohol component and carboxylic acid component.
(*2): It represents the amount of the rosin compound contained in the total mass of alcohol component and carboxylic acid component.

TABLE C2-2

| | | Resin G | Resin H | Resin I | Resin J | Resin K | Resin L |
|---|---|---|---|---|---|---|---|
| Alcohol component | 2,2-bis(p-hydroxyphenyl)propane | 1,696 g | — | — | — | — | — |
| | 1,2-propanediol | 571 g | 1,142 g | 1,142 g | 1,142 g | 1,142 g | 1,142 g |
| | 1,3-propanediol | — | — | — | — | — | — |
| Carboxylic acid component | terephthalic acid | 1,743 g | 1,992 g | 1,743 g | 1,743 g | 2,132 g | 1,743 g |
| | trimellitic acid anhydride | 288 g | 288 g | 288 g | 288 g | 288 g | 288 g |
| | unpurified tall rosin | 1,743 g | 250 g | — | 1,743 g | 110 g | 1,743 g |
| | acrylic acid-modified rosin | — | — | — | — | — | — |
| | itaconic acid-modified rosin | — | — | — | — | — | — |
| | fumaric acid-modified rosin | — | — | — | — | — | — |
| | purified rosin A | — | — | 1,743 g | — | — | — |
| Esterified catalyst | 2-ethylhexanoic acid tin (II) (*1) | 24.6 g (0.5) | 18.4 g (0.5) | 24.6 g (0.5) | 24.6 g (0.5) | 18.4 g (0.5) | 24.6 g (0.5) |
| Amount of aliphatic diol in divalent alcohol component (mole %) | | 50 | 100 | 100 | 100 | 100 | 100 |
| Amount of 1,2-PD in aliphatic diol (mole %) | | 100 | 100 | 100 | 100 | 100 | 100 |
| Amount of rosin compound (% by mass) (*2) | | 29 | 6.8 | 35 | 35 | 3 | 35 |
| Physical properties of Resin | Acid value (mgKOH/g) | 27.1 | 32.1 | 29.8 | 28.9 | 31.8 | 30.1 |
| | Softening point (° C.) | 107.1 | 102.8 | 150.0 | 104.1 | 103.0 | 103.2 |
| | Glass transition temperature (° C.) | 63.0 | 57.8 | 59.1 | 58.9 | 57.3 | 58.0 |

(*1): The numerical value in parentheses represents the mass ratio of the esterified catalyst used to 100 parts by mass of the total mass of the alcohol component and carboxylic acid component.
(*2): It represents the amount of the rosin compound contained in the total mass of alcohol component and carboxylic acid component.

Synthesis Example C9

-Synthesis of Resin M-

Into a 5 L four-necked flask equipped with a nitrogen inlet tube, a dehydration tube, a stirrer, a dropping funnel and a thermocouple, 748 g of terephthalic acid, 144 g of trimellitic acid anhydride, 1,808 g of bisphenol A (2,2) propyleneoxide, 712 g of bisphenol A (2,2) ethyleneoxide and 17 g of dibutyltin oxide as an esterified catalyst were added, and the mixture was reacted at 210° C. under nitrogen atmosphere and at a pressure of 10 kPa until the temperature of the mixture reached a desired softening point, thereby synthesizing a polyester resin (Resin M).

The Resin M had a softening point of 145.0° C., a glass transition temperature of 63.1° C., and an acid value of 12.2 mgKOH/g.

(Production Example of Toner C1)

A toner composition having the following formulation of Toner C1 shown in the following Table C3 was preliminarily mixed using a HENSHEL mixer (FM10B, manufactured by Mitsui Miike Kakoki K.K.) and then melted and kneaded by a biaxial kneader (PCM-30, manufactured by IKEGAI LTD.) at a temperature of 100° C. to 130° C. Subsequently, the kneaded workpiece was cooled to room temperature and then coarsely crushed using a hammer mill so as to have particle diameters of 200 μm to 400 μm. Subsequently, the workpiece was finely pulverized using a ultrasonic jet pulverizer LABO-JET (manufactured by Nippon Pneumatic Manufacturing Co., Ltd.), followed by classification by means of an airflow classifier (MDS-I, manufactured by Nippon Pneumatic Manufacturing Co., Ltd.), to thereby produce toner base particles.

Next, based on 100 parts by mass of the toner base particles, 1.0 part by mass of an additive (HDK-2000, produced by Clariant Japan K.K.) were mixed with stirring using a HENSHEL mixer, thereby producing Toner C1.

(Production Examples of Toner C2 to C16)

Each of Toners C2 to C16 was produced in a similar manner to that of Production Example of Toner Cl described above, except that the combination of the materials and the formulate amounts were changed to those shown in the following Table C3.

Any of the thus obtained Toners C1 to C16 had a weight average particle diameter $D_4$ of 6.5 μm±0.5 μm, contained 20% by number or less of particles having a size of 5 μm or smaller and a particle size distribution ($D_4$/Dn) within the range of 1.3 to 1.6.

TABLE C3

| | Polyester resin | | | | Styrene-acrylic resin | | Colorant | | Wax | | Charge controlling agent | |
|---|---|---|---|---|---|---|---|---|---|---|---|---|
| Toner | Type | parts | Type | parts | Type | parts | Type | parts | Type | parts | Type | parts |
| Toner C1 | Resin A | 70 | Resin M | 20 | SA-1 | 10 | carbon black | 6 | carnauba wax | 7 | CCA1 | 2 |
| Toner C2 | Resin B | 70 | Resin M | 20 | SA-1 | 10 | carbon black | 6 | carnauba wax | 7 | CCA1 | 2 |
| Toner C3 | Resin C | 70 | Resin M | 20 | SA-1 | 10 | carbon black | 6 | carnauba wax | 7 | CCA1 | 2 |
| Toner C4 | Resin D | 70 | Resin M | 20 | SA-1 | 10 | carbon black | 6 | carnauba wax | 7 | CCA1 | 2 |
| Toner C5 | Resin D | 70 | Resin M | 20 | SA-2 | 10 | carbon black | 6 | carnauba wax | 7 | CCA1 | 2 |
| Toner C6 | Resin E | 70 | Resin M | 20 | SA-2 | 10 | carbon black | 6 | carnauba wax | 7 | CCA1 | 2 |
| Toner C7 | Resin F | 70 | Resin M | 20 | SA-2 | 10 | carbon black | 6 | carnauba wax | 7 | CCA1 | 2 |
| Toner C8 | Resin G | 70 | Resin M | 20 | SA-2 | 10 | carbon black | 6 | carnauba wax | 7 | CCA1 | 2 |
| Toner C9 | Resin H | 70 | Resin M | 20 | SA-2 | 10 | carbon black | 6 | carnauba wax | 7 | CCA1 | 2 |
| Toner C10 | Resin I | 70 | Resin M | 20 | SA-2 | 10 | carbon black | 6 | carnauba wax | 7 | CCA1 | 2 |
| Toner C11 | Resin J | 70 | Resin M | 20 | SA-2 | 10 | carbon black | 6 | carnauba wax | 7 | CCA1 | 2 |
| Toner C12 | Resin J | 60 | Resin M | 20 | SA-3 | 40 | carbon black | 6 | carnauba wax | 7 | CCA1 | 2 |
| Toner C13 | Resin J | 75 | Resin M | 20 | SA-2 | 5 | carbon black | 6 | carnauba wax | 7 | CCA1 | 2 |
| Toner C14 | Resin J | 70 | Resin M | 20 | SA-2 | 10 | carbon black | 6 | rice wax | 7 | CCA1 | 2 |
| Toner C15 | Resin K | 70 | Resin M | 20 | SA-2 | 10 | carbon black | 6 | carnauba wax | 7 | CCA1 | 2 |
| Toner C16 | Resin L | 70 | Resin M | 20 | SA-1 | 10 | carbon black | 6 | carnauba wax | 7 | CCA1 | 2 |

SA-1: styrene-methylacrylate copolymer (glass transition temperature (Tg) = 61° C., softening point = 115° C., HHF-insoluble fraction = 0%)

SA-2: styrene-butylacrylate copolymer (glass transition temperature (Tg) = 62° C., softening point = 122° C., HHF-insoluble fraction = 0%)

SA-3: styrene-butylacrylate copolymer (glass transition temperature (Tg) = 61° C., softening point = 118° C., HHF-insoluble fraction = 28% (crosslinked fraction)

The term "parts" represents "parts by mass"

Charge controlling agent: CCA1

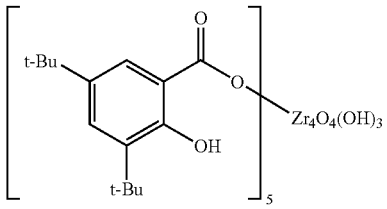

Aromatic oxycarboxylic acid compound where t-Bu represents a tertiary butyl group.

-Preparation of Carrier-

As a core material, 5,000 parts by mass of Mn ferrite particles (weight average particle diameter=35 μm), and as coating materials, toluene of tetrabutoxy-methylated benzoguanamine, 5 parts by mass of solid equivalence of a butanol-mixed solution (solid content concentration: 70% by mass), 5 parts by mass of solid equivalence of an acrylic resin solution (solid content concentration: 50% by mass), and as a methyl silicone resin having a silanol group, 15 parts by mass of solid equivalence of a methyl phenyl silicone resin solution (solid content concentration: 23% by mass) were mixed at room temperature.

Then, to the solid content of the solution prepared, 5 parts by mass of carbon black (MITSUBISHI CARBON BLACK#44, produced by Mitsubishi Chemical Corporation) was added, and the mixture liquid was diluted with 80 parts by mass of toluene, and the liquid was stirred to disperse the constituents in a homogenizer, thereby a coating solution was prepared. Further, 10 parts by mass of aminosilane (SH6020, produced by DOW CORNING TORAY SILICONE CO., LTD.) was added to the dispersion liquid, and dispersed for 10 minutes to prepare a coating solution. The core material and the coating solution were poured in a coating device, which is equipped with a rotary bottom plate disc and a stirring blade in its fluidized bed and performs coating while forming a spinning stream, so as to coat the core material with the coating solution. The resultant coated product was baked in an electric furnace at 250° C. for 2 hours, thereby producing carrier A.

-Production of Two-Component Developer-

Based on 100 parts by mass of the produced carrier A, 7 parts by mass of each of the toners produced was used, and the carrier A and the toner were uniformly mixed using a tubular mixer (manufactured by Willy A. Bachofen (WAB)), in which a container itself is tumbled so that contents therein are stirred, at 48 rpm for 3 minutes so as to charge the toner. In this embodiment, 200 g of the carrier A and 14 g of each of the toners were put in an ointment bottle having an inner volume of 500 mL and mixed, thereby producing a two-component developer.

Examples C1 to C14 and Comparative Examples C1 to C2

A two-component developer containing each of the toners produced in Examples C1 to C14 and Comparative Examples C1 to C2 was charged into a black (Bk) unit of an image forming apparatus (IMAGIO NEO C285, manufactured by Ricoh Company Ltd.), and then image formation was carried out. The two-component developers were evaluated with respect to various properties as follows. Note that all the evaluations were carried out based on black (Bk) images. Tables C4-1 and C4-2 show the evaluation results.

<Low-Temperature Fixing Property>

A solid image was formed on a transfer sheet of heavy paper (printing paper <135>, manufactured by NBS Ricoh Co., Ltd.) with a toner adhesion amount of 0.85 mg/cm$^2$±0.1 mg/cm$^2$, and the toner image was fixed with varying the temperature of the fixing belt. The surface of the fixed image was drawn at a load of 50 g by a ruby needle (tip radius: 260 μm to 320 μm, tip angle: 60 degrees) using an image analysis tester (AD-401, manufactured by Ueshima Seisakusho Co., Ltd.), the image surface was strongly rubbed 5 times with a fiber (HONEYCOT #440, manufactured by Hanylon Co., Ltd.), and the temperature of the fixing belt at which almost no peel-off wear of image occurred was determined as a lower limit fixing temperature. Note that the solid image was formed on the transfer sheet at a position 3.0 cm away from the edge of the transfer sheet, with respect to the paper-feeding direction.

[Evaluation Criteria]

On the low-temperature fixing property of each of the toners, the results were graded as follows:

A: The lower limit fixing temperature was 125° C. or lower.

B: The lower limit fixing temperature was 126° C. to 135° C.

C: The lower limit fixing temperature was 136° C. to 145° C.

D: The lower limit fixing temperature was 146° C. to 155° C.

E: The lower limit fixing temperature was 156° C. or higher.

<Hot-Offset Resistance>

A solid image was formed on a transfer sheet of regular paper (Type 6200, manufactured by Ricoh Company Ltd.) with a toner adhesion amount of 0.85 mg/cm$^2$±0.1 mg/cm$^2$, and a fixing test was carried out with varying the temperature of the fixing belt. Presence or absence of hot-offset was visually observed, and the upper limit temperature at which no hot-offset occurred was determined as an upper limit fixing temperature. Note that the solid image was formed on the transfer sheet at a position 3.0 cm away from the edge of the transfer sheet, with respect to the paper-feeding direction.

[Evaluation Criteria]

On the hot-offset resistance of each of the toners, the results were graded as follows:

A: The upper limit fixing temperature was 230° C. or higher.

B: The upper limit fixing temperature was 210° C. or higher and lower than 230° C.

C: The upper limit fixing temperature was 190° C. or higher and lower than 210° C.

D: The upper limit fixing temperature was 180° C. or higher and lower than 190° C.

E: The upper limit fixing temperature was 180° C. or lower.

<Initial Image Quality>

An image chart for evaluation was output, and the output images were evaluated with respect to background smear, image density, and presence or absence of white-voids. Presence or absence of abnormal images, and the quality of images were visually evaluated, and the results were classified into the following four grades.

[Evaluation Criteria]

A: No abnormal image was observed, and the output images were excellent in quality.

B: A slight difference in color tone and image density, and occurrence of background smear were recognized when compared with the original image used, however, the output images were excellent in quality, without any problem in practical use.

C: A difference in image density etc. was somewhat observed.

D: A difference in image density was clearly observed.

E: A difference in image density was conspicuous, and it was impossible to obtain normal images.

<Temporal Stability>

After continuously outputting 50,000 sheets of a character-image chart with an image area ratio of 15% using the image forming apparatus, and the output images were evaluated similarly to the evaluation on the initial image quality. The output images were compared to the images obtained in the initial stage, and the results were evaluated based on the following criteria.

[Evaluation Criteria]

A: Abnormal images were not observed at all, and the output images were excellent in quality.

B: A slight difference in color tone and image density was recognized when compared with the initial image used, but the result was on the level of no problem.

C: A difference in color tone (tint) and image density was somewhat observed when compared to the initial image.

D: A difference in color tone (tint) and image density was clearly observed when compared to the initial image, causing a problem.

E: A difference in color toner (tint) and image density was conspicuous when compared to the initial image, and it was impossible to obtain normal images.

<Carrier Contamination>

Carrier contamination resistance (called carrier spent resistance) is a property indicating contamination of the surface of carrier caused by toner. The higher the mechanical strength of toner, the lesser the carrier contamination becomes. The carrier contamination resistance of each of the toners was evaluated according to the following manner. Specifically, an image chart with an image area ratio of 50% was output on 30,000 sheets of paper using the image forming apparatus, and each developer that had undergone continuous outputting 100 sheets and the developer that had undergone continuous outputting 30,000 sheets were sampled from the image forming apparatus. An appropriate amount of the developer was placed in a gauge provided with a mesh having a sieve opening of 32 μm, followed by air-blowing treatment so as to separate toner from carrier. Into a 50 mL of glass bottle, 1.0 g of the obtained carrier was poured, 10 mL of chloroform was added into the glass bottle. The glass bottle was shaken 50 times by hand and then left at rest for 10 minutes. Thereafter, the supernatant chloroform solution was poured into a glass cell, and the transmittance of the chloroform solution was measured using a turbidimeter, and the carrier contamination resistance was evaluated based on the following criteria.

[Evaluation Criteria]

In the order of excellence of carrier contamination resistance, the results were graded as follows.

A: The transmittance was 95% or higher.

B: The transmittance was 90% to 94%.

C: The transmittance was 80% to 89%.

D: The transmittance was 70% to 79%.

E: The transmittance was 69% or lower.

<Photoconductor Filming>

The state of filming of toner on the surface of the photoconductor was visually observed after continuously outputting an image chart with an image area ratio of 50% on 100 sheets of paper and after continuously outputting the image chart on 50,000 sheets of paper. In view of presence or absence of abnormal images, the results were classified into the following five grades.

[Evaluation Criteria]

A: Abnormal images were not observed at all, and there was no toner filming observed on the photoconductor surface.

B: Abnormal images were not observed at all, however, light toner filming was observed on the photoconductor surface.

C: Very slight occurrence of abnormal images was observed, and toner filming on the photoconductor was clearly evident.

D: Occurrence of abnormal images was clearly observed, and toner filming on the photoconductor was conspicuous, resulting in a problematic level.

E: Occurrence of abnormal images was clearly observed, toner filming on the photoconductor was conspicuous, and it was impossible to obtain normal images.

<Heat Resistance/Storage Stability>

Into a 30 mL glass bottle, 4 g of each of the toners was poured, the glass bottle was tapped 150 times and stored under the environment of a temperature of 45° C. and a relative humidity of 60% for 24 hours. The glass bottle was left at room temperature for 2 hours, and the toner was sampled on white paper, and presence or absence of agglomerate in the toner was visually observed and confirmed. The results were classified into the following four grades.

[Evaluation Criteria]

A: Toner agglomerates were not observed at all.

B: A slight amount of agglomerates was observed, but in a light state, the agglomerates fell apart through slight vibration.

C: Agglomerates were observed, but they fell apart at a touch with a pair of tweezers.

D: Agglomerates were clearly observed, but part of which caused toner blocking, and they did not fall apart even when touched with a pair of tweezers.

<Odor>

Odor generated in fixing process was evaluated based on the following criteria.

[Evaluation Criteria]

A: Unpleasant odor was not detected.

B: Unpleasant odor was detected.

TABLE C4-1

| | Toner | Low-temperature fixing property | Hot-offset resistance | Initial image quality | Temporal stability | Carrier contamination |
|---|---|---|---|---|---|---|
| Ex. C1 | Toner C1 | A | B | A | B | B |
| Ex. C2 | Toner C2 | B | A | A | B | B |
| Ex. C3 | Toner C3 | B | A | A | A | B |
| Ex. C4 | Toner C4 | B | A | A | B | C |
| Ex. C5 | Toner C5 | A | B | B | B | C |
| Ex. C6 | Toner C6 | A | B | B | B | C |
| Ex. C7 | Toner C7 | A | C | B | C | C |
| Ex. C8 | Toner C8 | B | B | B | B | C |
| Ex. C9 | Toner C9 | C | A | B | B | B |
| Ex. C10 | Toner C10 | A | B | B | B | B |
| Ex. C11 | Toner C11 | A | B | A | A | A |
| Ex. C12 | Toner C12 | C | A | B | B | B |
| Ex. C13 | Toner C13 | A | B | B | B | B |
| Ex. C14 | Toner C14 | A | B | A | A | B |
| Compara. Ex. C1 | Toner C15 | C | D | D | C | D |
| Compara. Ex. C2 | Toner C16 | B | C | C | D | D |

TABLE C4-2

| | Toner | Photoconductor filming | Heat resistance/ storage stability | Odor | Amount of abietic acid contained in toner (% by mass) |
|---|---|---|---|---|---|
| Ex. C1 | Toner C1 | B | B | A | 0.14 |
| Ex. C2 | Toner C2 | B | B | A | 0.14 |
| Ex. C3 | Toner C3 | B | B | A | 0.21 |
| Ex. C4 | Toner C4 | C | B | A | 0.63 |
| Ex. C5 | Toner C5 | C | B | A | 0.63 |
| Ex. C6 | Toner C6 | C | C | A | 0.35 |
| Ex. C7 | Toner C7 | C | C | A | 0.35 |
| Ex. C8 | Toner C8 | C | A | A | 0.35 |

TABLE C4-2-continued

| | Toner | Photoconductor filming | Heat resistance/ storage stability | Odor | Amount of abietic acid contained in toner (% by mass) |
|---|---|---|---|---|---|
| Ex. C9 | Toner C9 | B | B | A | 0.091 |
| Ex. C10 | Toner C10 | B | B | A | 0.049 |
| Ex. C11 | Toner C11 | B | A | A | 0.07 |
| Ex. C12 | Toner C12 | B | A | A | 0.06 |
| Ex. C13 | Toner C13 | B | A | A | 0.075 |
| Ex. C14 | Toner C14 | B | C | A | 0.07 |
| Compara. Ex. C1 | Toner C15 | D | D | A | 0.021 |
| Compara. Ex. C2 | Toner C16 | D | D | B | 5.04 |

Since the image forming apparatus, the image forming method and the process cartridge of the present invention make it possible to form extremely high-quality images, without substantially causing change in color tone for a long period of time, and without substantially causing abnormal images such as a reduction in image density, and background smear, they can be used in wide range of applications, for example, in laser printers, direct digital platemakers, full-color copiers employing a direct or an indirect electrophotographic multi-color image developing system, full-color laser printers, and full-color plain paper facsimiles.

Since the toner of the present invention is capable of maintaining excellent charge build-up property, charge stability and transferability for a long period of time without substantially causing carrier contamination and charge roller contamination, it can be suitably used in developers, electrophotographic image forming apparatuses, and image forming methods based on electrophotography.

The image forming apparatus of the present invention is capable of forming extremely high-quality images without substantially causing change in color tone and without substantially causing abnormal images such as a reduction in image density, and fogging for a long period of time, it can be used in wide range of applications, for example, in laser printers, direct digital platemakers, full-color copiers employing a direct or an indirect electrophotographic multi-color image developing system, full-color laser printers, and full-color plain paper facsimiles.

Since the toner of the present invention is excellent in low-temperature fixing property, causes almost no contamination of toner and releasing agents on carrier surface and other members and combines excellent low-fixing property with excellent heat resistance/storage stability, it can be suitably used in development of latent images which are formed by electrophotography, electrostatic recording method, electrostatic printing method, or the like.

Since the image forming apparatus, the image forming method, and the process cartridge of the present invention use the toner of the present invention and are capable of forming extremely high-quality images, they can be used in wide range of applications, for example, in laser printers, direct digital platemakers, full-color copiers employing a direct or an indirect electrophotographic multi-color image developing system, full-color laser printers, and full-color plain paper facsimiles.

What is claimed is:

1. A toner comprising:

a binder resin which comprises a polyester resin obtained by polycondensation of an alcohol component with a carboxylic acid component, wherein the alcohol component comprises a divalent alcohol containing 65 mole % or more of an aliphatic diol, a colorant, and a charge controlling agent containing a metal compound composed modified with an unsaturated fatty acid of a trivalent or higher polyvalent aromatic oxycarboxylic acid as a center metal, wherein the carboxylic acid component comprises a rosin compound, the amount of the rosin compound contained in the carboxylic acid component is 5% by mass or more based on the total mass of the alcohol component and carboxylic acid component, and the amount of an abietic acid contained in the toner is 1% by mass or less.

2. The toner according to claim 1, wherein the metal compound composed of a trivalent or higher polyvalent aromatic oxycarboxylic acid is represented by General Formula (1), General Formula (1)

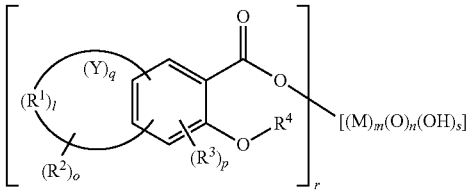

where $R^1$ represents any one of a carbon atom, a methine group and a methylene group, the methine group and the methylene group may include a hetero atom selected from N, S, O, and P; Y represents a cyclic structure bonded through a saturated bond or an unsaturated bond; each of $R^2$ and $R^3$ represents any one of a hydrogen atom, a halogen atom, a hydroxyl group, a nitro group, a nitroso group, a sulfonyl group, a cyano group, an alkyl group, an alkenyl group, an alkoxy group, an aryl group, an aryloxy group, an aralkyl group, an aralkyloxy group, an amino group, a carboxyl group and a carbonyl group, when each of "o" and "p" is an integer of 1 or more, $R^2$ and $R^3$ may be the same or different from each other, and $R^2$ and $R^3$ may be further substituted by a substituent; $R^4$ is hydrogen; "l" is 0 or an integer of 3 to 12; "m" is an integer of 1 to 20; "n" is an integer of 0 to 20; "o" is an integer of 0 to 4; "p" is an integer of 0 to 4; "q" is an integer of 0 to 3; "r" is an integer of 1 to 20; "s" is an integer of 0 to 20; and M is a trivalent or higher center metal.

3. The toner according to claim 1, wherein the aliphatic diol comprises 1,2-propanediol at a concentration of 65 mole % or more.

4. The toner according to claim 1, wherein the carboxylic acid component further comprises an aromatic dicarboxylic acid compound.

5. The toner according to claim 1, wherein the polyester resin has an acid value of from 10 to 50 mg KOH/g.

6. A toner comprising:

a binder resin containing a styrene-acrylic resin and a polyester resin, a colorant, and a releasing agent, wherein the polyester resin is obtained by polycondensation of an alcohol component with a carboxylic acid component, wherein the alcohol component comprises a divalent alcohol containing 65 mole % or more of an aliphatic diol, the carboxylic acid comprises a rosin compound modified with an unsaturated fatty acid, the amount of the rosin compound contained in the carboxylic acid component is 5% by mass or more based on the total mass of the alcohol component and carboxylic acid component, and the amount of an abietic acid contained in the toner is 1% by mass or less.

7. The toner according to claim 6, wherein the aliphatic diol comprises 1,2-propanediol at a concentration of 65 mole % or more.

8. The toner according to claim 6, wherein the carboxylic acid component further comprises an aromatic dicarboxylic acid.

9. The toner according to claim 6, wherein the polyester resin is obtained by polycondensation of an alcohol component with a carboxylic acid component, the alcohol component comprises a divalent alcohol containing 65 mole % or more of 1,2-propanediol, the carboxylic acid component comprises a purified rosin, and the polyester resin has a softening point of 80° C. or more and less than 120° C.

10. The toner according to claim 6, wherein the styrene-acrylic resin comprises any one of a styrene-methylacrylate copolymer and a styrene-butylacrylate copolymer.

11. The toner according to claim 6, wherein the polyester resin has an acid value of from 10 to 50 mg KOH/g.

* * * * *